US007117621B2

(12) United States Patent
Chang

(10) Patent No.: US 7,117,621 B2
(45) Date of Patent: Oct. 10, 2006

(54) THREE DIMENSIONAL FRAMED DISPLAY AND FRAME CALENDAR

(76) Inventor: Cherng Chang, P. O. Box 693, Miamisburg, OH (US) 45343

( * ) Notice: Subject to any disclaimer, the term of this patent is extended or adjusted under 35 U.S.C. 154(b) by 0 days.

(21) Appl. No.: 10/618,287

(22) Filed: Jul. 11, 2003

(65) Prior Publication Data

US 2004/0159031 A1 Aug. 19, 2004

Related U.S. Application Data

(60) Provisional application No. 60/397,259, filed on Jul. 19, 2002, provisional application No. 60/398,857, filed on Jul. 26, 2002, provisional application No. 60/412,904, filed on Sep. 23, 2002, provisional application No. 60/444,463, filed on Feb. 3, 2003.

(51) Int. Cl.
*A47G 1/06* (2006.01)

(52) U.S. Cl. ..... 40/738; 40/743; 40/800; 428/13

(58) Field of Classification Search ..... 40/711, 40/717, 743, 738, 800, 768, 769; 428/13, 428/14

See application file for complete search history.

(56) References Cited

U.S. PATENT DOCUMENTS

| | | | | |
|---|---|---|---|---|
| 956,916 | A | 5/1910 | Wiederseim, Jr. | |
| 2,565,553 | A | 8/1951 | Foley | |
| 2,731,749 | A | 1/1956 | Tarzian | |
| 3,324,997 | A | 6/1967 | Bonanno | |
| 3,596,391 | A | 8/1971 | Knight | |
| 3,663,808 | A * | 5/1972 | Baatz | 362/152 |
| 3,713,237 | A * | 1/1973 | Thomson et al. | 40/575 |
| 4,356,650 | A | 11/1982 | Antonczyk et al. | |
| 4,407,083 | A * | 10/1983 | Hartgrave | 40/414 |
| 5,337,119 | A | 8/1994 | Tanibata | |
| 5,587,740 | A | 12/1996 | Brennan | |
| 5,617,663 | A * | 4/1997 | Miki et al. | 40/738 |
| 5,666,712 | A * | 9/1997 | Cvetkov | 29/458 |
| 5,726,736 | A | 3/1998 | DeWolff | |
| 5,831,590 | A | 11/1998 | Ikedo | |
| 5,855,499 | A | 1/1999 | Yamazaki et al. | |
| 6,293,038 | B1 | 9/2001 | Chang | |

(Continued)

FOREIGN PATENT DOCUMENTS

| | | |
|---|---|---|
| FR | 1250672 A | 1/1961 |

(Continued)

OTHER PUBLICATIONS

Mrs. Grossman's, Sticker Art Ideas, www.mrsgrossmans.com/thinking_of_younew.htm.

*Primary Examiner*—Gary C. Hoge

(57) ABSTRACT

A 3D picture frame for making a 3D framed display. A mounted background picture is bent into a concavo-convex shape for adding a 3D effect to the displayed picture. A mounted bottom edge picture achieves a depth of the field and a wrap-around effect. A floating picture, which is preferably a self trimmed composite picture for bearing a customer's image, obtained without manual trimming process, is displayed in front of and spaced apart from the background picture. A created arch-shaped void space in this frame can house one or more magnetically held 3D arts therein. A toy platform can be installed to turn the 3D picture frame into a play-and-display station. An animated 3D art with a built-in insert will add "live" to the 3D framed display. All above contents can be mounted or removed without taking down the frame body from the wall.

20 Claims, 29 Drawing Sheets

U.S. PATENT DOCUMENTS

| | | | |
|---|---|---|---|
| 6,348,940 | B1 | 2/2002 | Sano et al. |
| 2002/0000058 | A1 | 1/2002 | Chang |

FOREIGN PATENT DOCUMENTS

| | | | |
|---|---|---|---|
| FR | 2791800 | A | 10/2000 |

* cited by examiner

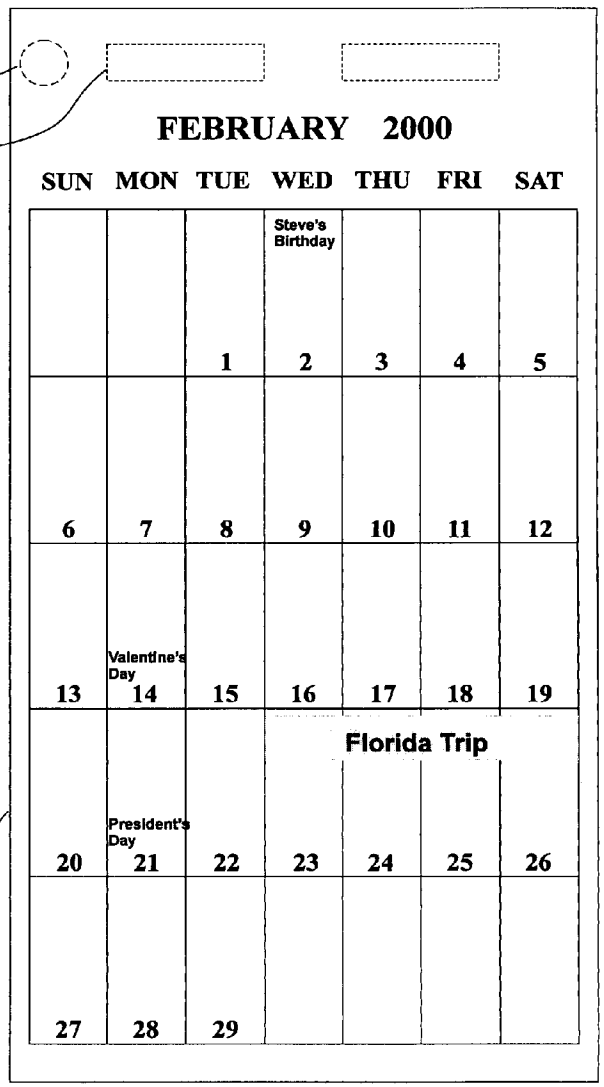
FIG 23
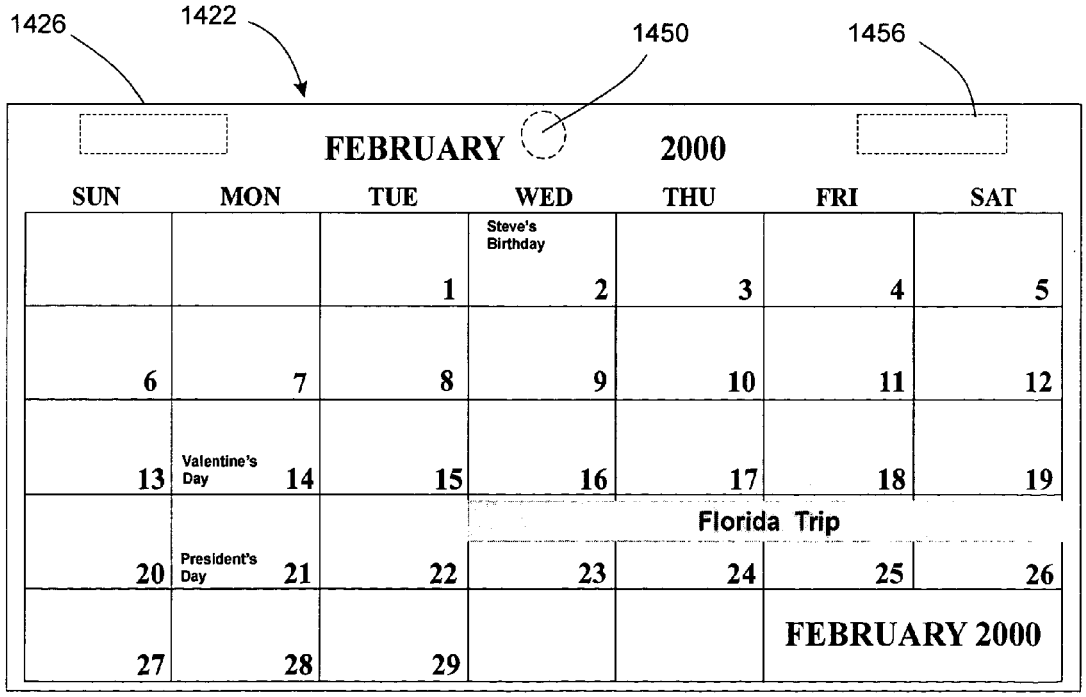

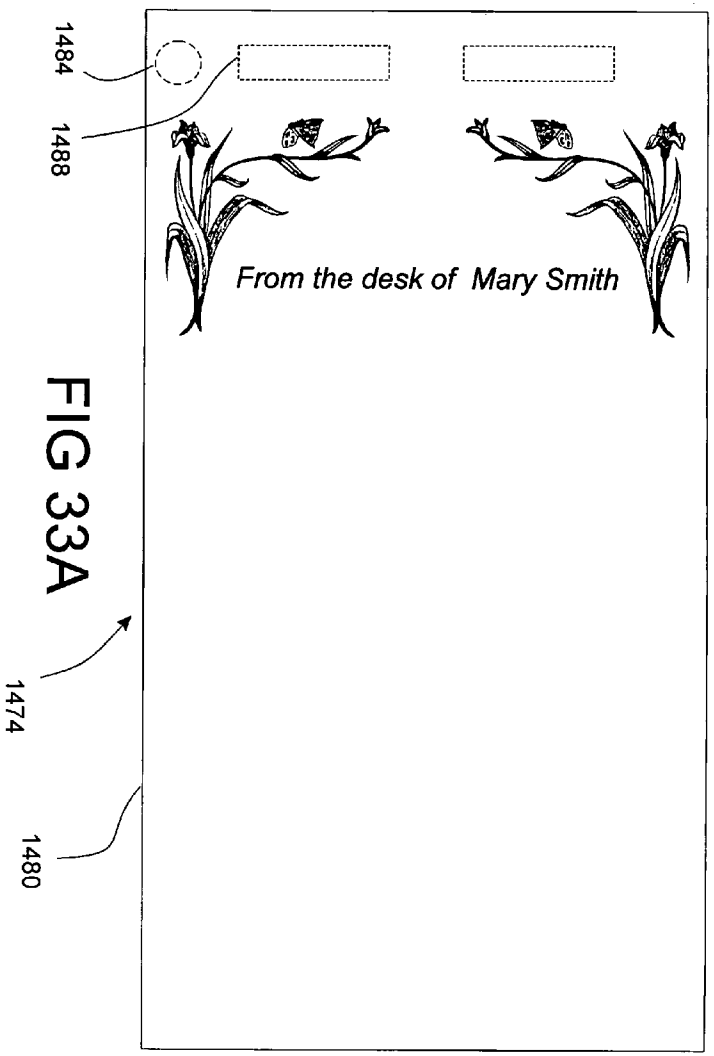
FIG 33A
FIG 33B
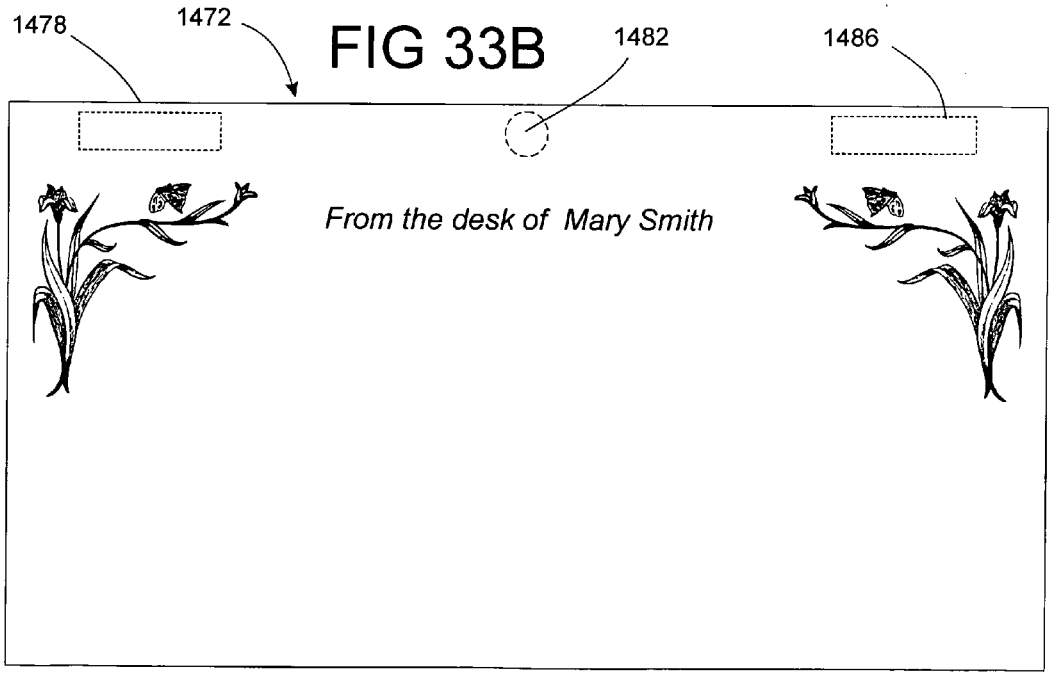

THREE DIMENSIONAL FRAMED DISPLAY AND FRAME CALENDAR

CLAIM PIORITY

Provisional Patent Application No. 60/397,259, filed 2002 Jul. 19, Provisional Patent Application No. 60/398,857, filed 2002 Jul. 26, Provisional Patent Application No. 60/412,904, filed 2002 Sep. 23, Provisional Patent Application No. 60/444,463, filed 2003 Feb. 3.

BACKGROUND OF THE INVENTION

This invention relates in general to picture frames, and more specifically, three dimensional framed display (3DFD) and 3D picture frame for making such 3D framed displays. Here the picture frame refers to a frame capable of displaying a picture sheet. The 3D picture frame refers to said picture frame capable of imparting a 3D effect to one or more displayed picture sheets and/or capable of displaying a 3D art. The 3D framed display refers to the display made possible with said 3D picture frame.

U.S. Pat. No. 6,293,038 discloses a novel 3D framed display. In this 3D framed display a 3D picture frame is employed which comprises a frame body typically formed by joining four frame moldings. In one embodiment a regular picture sheet is sandwiched between a curved transparent plate and a curved backing plate and bent into a concavo-convex shape for creating a 3D effect to the displayed picture sheet. In this 3D picture frame a top edge picture and a bottom edge picture can also be displayed. It creates a depth of the field and wrap-around effect which further strengthen the 3D feeling in the mind of the viewer.

In this prior art 3D picture frame an arch shaped void space is also created in front of the displayed picture sheet. This space can allow one or more 3D arts to be magnetically held and displayed in complementing the picture sheet. These displayed 3D arts will also further enhance the overall 3D effect of the framed display.

In spite of the above-stated novel features this prior art 3D picture frame still has several problems. One most serious problem is the fact that a shadow of the frame top wall may be cast on the displayed picture. The size of this shadow will vary depending on the position of the external lighting in relation to the 3D picture frame.

A second problem of this prior art 3D picture frame is also related to the source of lighting. If this lighting is above the top of the 3D picture frame very little light may reach to the top edge picture. This may render the top edge picture virtually invisible.

A 3D picture frame for the present 3D framed display is typically wall mounted due to its large size. It is very inconvenient to remove this bulky 3D picture frame from the wall whenever the display of the picture sheet is to be changed. If the displayed 3D arts can only be accessed from the back of the frame this frame must also be removed from the wall if the display of the 3D arts is to be changed. It is therefore very desirable that all such display contents replacement can be achieved without taking down the 3D picture frame from the wall.

Metal, porcelain and glass are all preferred materials for making picture frames. However, such materials are rarely employed for making large wall mounted picture frames because of its weight and/or fragileness. Instead of hanging, more secure mounting of such 3D picture frame will be desired.

In a 3D framed display it is often desirable that a picture sheet bearing the image of the customer be placed in front of and spaced apart from the background picture. One standard way to include a customer's image into a 3D framed display is through photographically taking the picture of the customer. Any other way such as hand painting or drawing would be prohibitively expensive.

One typical output of such photographical process is a rectilinear photo bearing the image of the customer along with the background such as a back drop, wall or simply empty sky. To place such a rectilinear photo as is in the 3D framed display would totally ruin the aesthetical atmosphere painstakingly created by the background picture and the 3D picture frame.

A more pleasing way to bring the customer's image into the 3D framed display is to trim or crop the rectilinear photo to create a trimmed photo showing only the customer without the unwanted background in the photo. Unfortunately the process of trimming a photo for the above purpose is usually a manual, tedious and time consuming procedure. Due to different shapes of the customers appeared in the photos there is no easy way to automate or speed up such a trimming process. Once a mistake is made in the trimming, the entire photo may have to be discarded.

It is therefore highly desirable that a process be devised so that once the customer's image is taken photographically a trimmed photo bearing the customer's image can be created easily, quickly and without the manual trimming procedure.

SUMMARY OF THE INVENTION

In the present invention a new type of 3D picture frame is disclosed for making a 3D framed display. In this 3D framed display there are four contents that can be displayed in this 3D picture frame. The first content is a plane background picture which when mounted in the 3D picture frame will be bent into a concavo-convex shape for adding a 3D effect to this picture. The second content is a bottom edge picture which is positioned at right angle with respect to the background picture for creating a depth of the field and a wrap-around effect. The third content includes one or more floating pictures positioned in front of and spaced apart from the background picture. The last displayed content includes one 3D art which is placed in a space bound by the above three displayed contents.

The floating picture is preferably a self trimmed composite picture. The composite picture is created by merging a customer's image into a base picture. This base picture typically has an object with a cut out opening through which the customer's image is revealed. Once printed, this composite picture may be trimmed, by using an scissors for example, to produce a trimmed composite picture. But it is preferred that the same composite picture be printed on a printer sheet with a pre-existing perforation or die cut line outlining the object in the base picture. A self trimmed composite picture can thus be obtained by simply removing the unwanted sheet portion outside the perforation or die cut line. This allows the trimmed composite picture bearing the customer's image to be produced easily by this self trimming process without the tedious manual trimming.

The 3D picture frame of the present invention includes a molded frame body which is preferably made of metal, porcelain, glass or plastics. A plurality of mounting holes are provided for securely mounting the frame body on a vertical wall. All above mentioned contents can be mounted on or removed from this frame body without taking down the frame body from the wall.

This frame body mainly comprises a curved back wall, two side walls, and a front wall. Formed within these walls is a cavity with a top opening, a front opening and a bottom opening. This cavity will accommodate one or more said 3D arts to be displayed.

A flexible background transparent plate is coupled with the background picture to be loaded in the frame body and shaped by the curved back wall to create a 3D effect to the displayed background picture.

The third component of the 3D picture frame is a frame glass assembly which may comprise a molded frame glass and a flexible frame glass or two flexible frame glasses. One or more floating pictures are sandwiched between these two glasses. The frame glass assembly, along with the sandwiched floating pictures, can be removably placed on the wall-mounted frame body for covering the top opening and the front opening of the frame body. Since the top opening of the frame body is covered only by clear glasses there will be no shadow cast on the displayed background picture regardless of the direction of the surrounding light.

The fourth component of the 3D picture frame is a bottom edge magnetic plate to be screw-mounted on the frame body for covering the bottom opening of the frame body. The bottom edge picture can be placed on this magnetic plate and covered by a bottom edge glass. One or more 3D arts can be placed on this bottom edge glass and magnetically held by the bottom edge magnetic plate to enhance the overall 3D effect in the display.

The present novel 3D picture frame can also be converted into a toy play-and-display station. A toy platform similar in shape as the bottom edge magnetic plate but unique to the toy to be played can be screw mounted on the frame body. With the frame glass assembly removed the 3D picture frame becomes a toy play station. After the play the assembled toy can be readily displayed along with the background picture and the trimmed composite picture, a great 3D framed display centered on the player's personal image.

The present 3D picture frame can also be designed for displaying an animated 3D art to add "live" to the 3D framed display. In this case an animated 3D art including an insertion box can be inserted through the bottom opening of the frame body, replacing the bottom edge magnetic plate. Mounting or removing of the animated 3D art can be achieved without taking down the frame body from the wall.

The 3D framed display and the 3D picture frame of the present invention make a giant leap forward in the states of the arts of the picture frames. There is an old saying that a picture is worth a thousand words. Now it can be said that a 3D framed display is worth ten thousands words. We live in a 3D world and the 3D framed display simply reflects such a fact.

In summary, the 3D framed display of the present invention basically provides the following four advantages over the conventional 2D framed display. First, it enriches the contents of a framed display. Baring the size requirement, there is virtually nothing cannot be displayed in the present 3D framed display. By properly putting all needed contents together and displayed in a 3D picture frame, a central theme will be presented and a story will be told.

The second advantage of the present 3D framed display is that it presents a curved background picture and a bottom edge picture. These two pictures create a vivid 3D presentation not seen before and a world apart from the traditional 2D picture display.

The third advantage of the present 3D framed display is that it places a floating picture, and more specifically a self trimmed composite picture containing the image of the person central to the theme and central to the story to be told, in front of and spaced apart from the background picture. It further enhances the 3D presentation. It shifts the emphasis from the background picture to the floating picture which can be more flexible in its presentation and can be more economically made. Except for a few cases, the background picture can be professionally made with good quality but also mass produced at low per unit cost. The use of professional background pictures allow customer more choice in selecting the 3D framed display to be created.

The fourth advantage of the present 3D framed display is that it can be broaden to include sound, light, animation, etc. This 3D framed display is not just a display any more. It may turn into a toy, a game, and many other things yet to be invented.

BRIEF DESCRIPTION OF THE DRAWINGS

FIG. 23 is an elevational view, showing a horizontal calendar sheet and a vertical calendar sheet.

FIGS. 33A and 33B are elevational views, showing a vertical blank note sheet and a horizontal blank note sheet, respectively.

REFERENCE NUMERALS IN DRAWINGS

Figure 7:
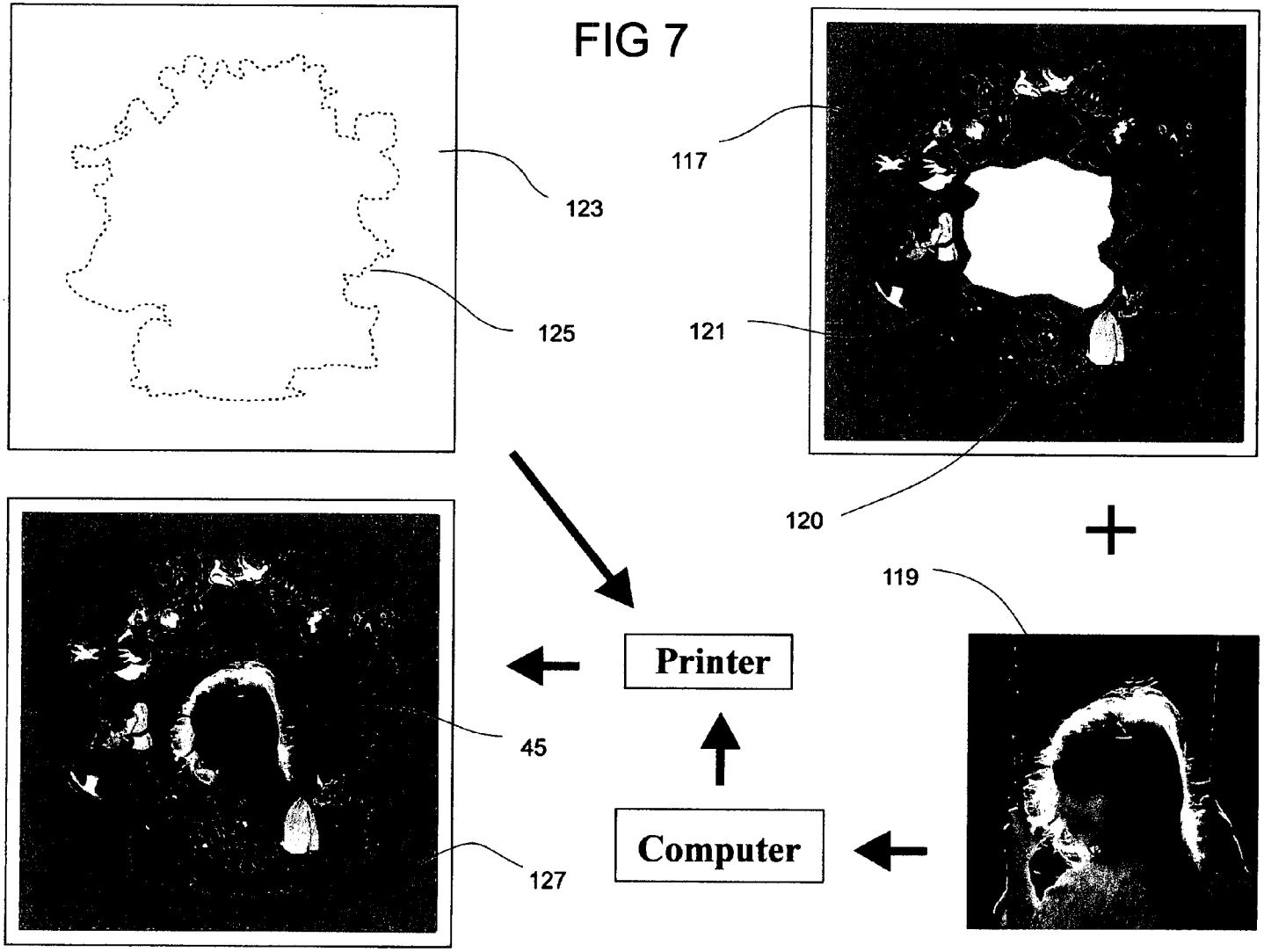
FIG. 7 is a schematic presentation showing the making of a self trimmed composite picture.
Figure 8:
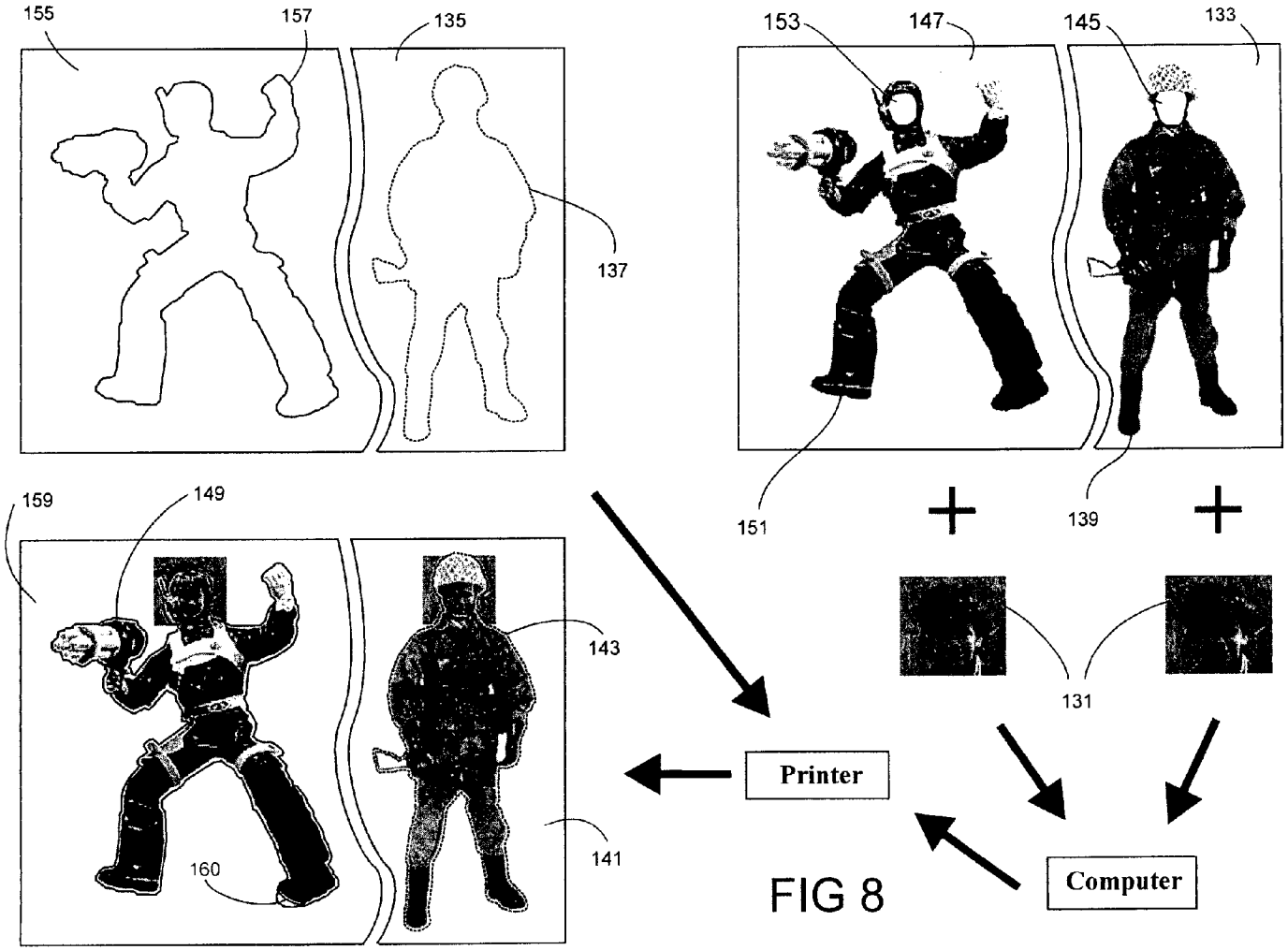
FIG. 8 is a schematic presentation showing the making of another self trimmed composite picture.
Figure 9:
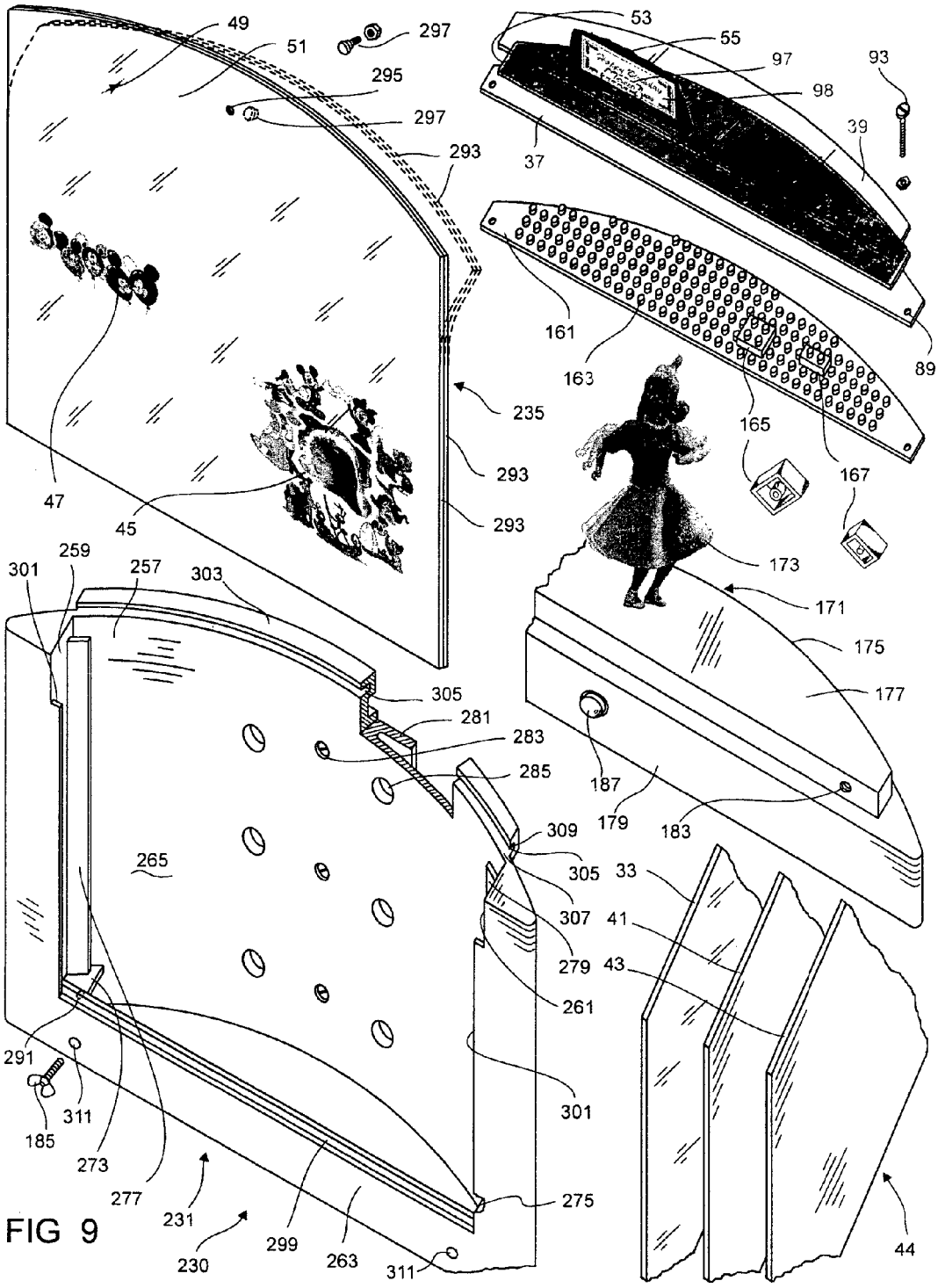
FIG. 9 is a perspective view of a second embodiment of the 3D picture frame of the present invention. Part of the 3D picture frame is cut off to reveal the hidden details of the frame body 231.
Figure 10:
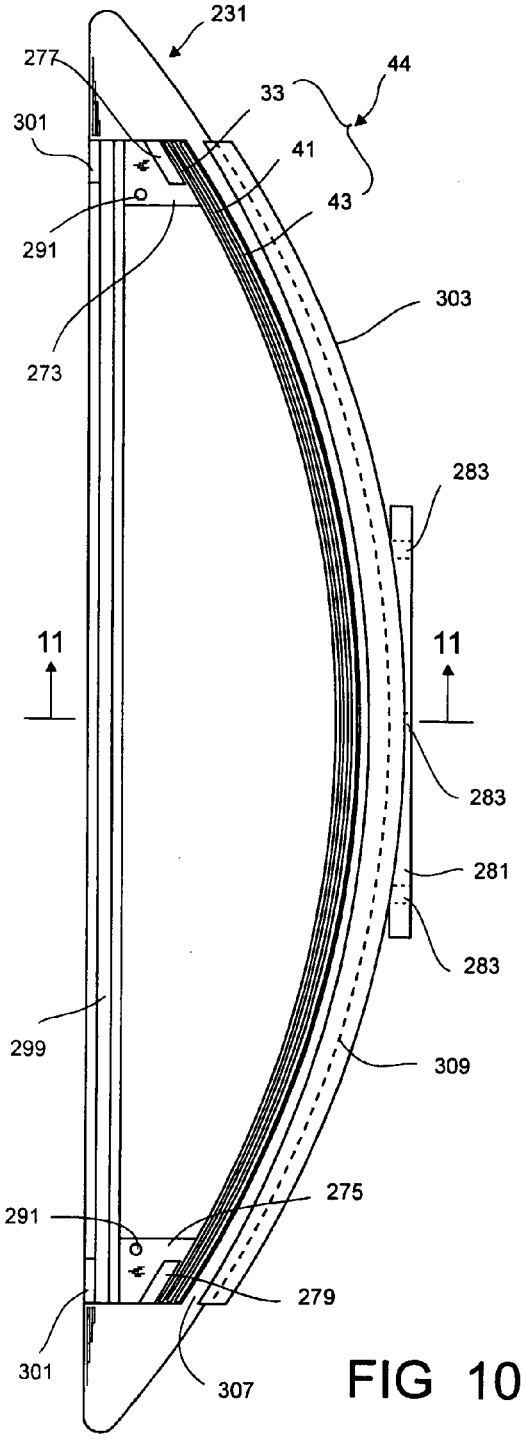
FIG. 10 is an enlarged top view of the frame body 231 shown with the installed background picture assembly 44.
Figure 11:
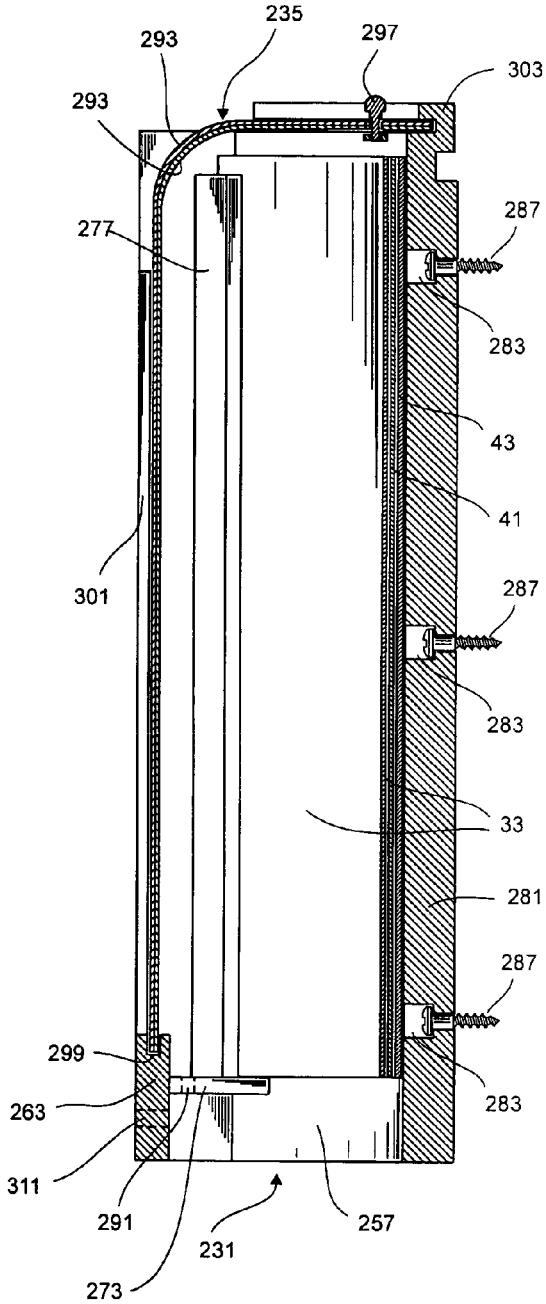
FIG. 11 are sectional views of the frame body 231 and the background picture assembly 44 taken substantially on the line 11—11 of FIG. 10. Also shown is a sectional view of the installed frame glass assembly 235.

| | | | | |
|---|---|---|---|---|
| FIGS. 1–8 | 30 | 3D picture frame | 31 | frame body |
| | 33 | background transparent plate | | |
| | 35 | frame glass assembly | 37 | bottom edge magnetic plate |
| | 39 | bottom edge glass | 41 | background picture |
| | 43 | background picture | 44 | background picture assembly |
| | 45 | floating picture (self trimmed composite picture) | 47 | floating picture (balloon sticker) |
| | 49 | floating picture (star sticker) | 51 | floating picture (star sticker) |
| | 53 | bottom edge picture | 55 | 3D art (display stand) |
| | 57 | curved back wall | 59 | left side wall |
| | 61 | right side wall | 63 | front wall |
| | 65 | cavity | 67 | top opening |
| | 69 | front opening | 71 | bottom opening |
| | 73 | left horizontal side plate | 75 | right horizontal side plate |
| | 77 | left vertical side plate | 79 | right vertical side plate |
| | 81 | mounting plate | 83 | mounting holes |
| | 85 | clearance holes | 87 | screws |
| | 89 | mounting holes | 91 | screw holes |
| | 93 | set of screw and nut | 97 | magnet |
| | 98 | self adhesive label | 99 | molded frame glass |
| | 101 | flexible frame glass | 103 | top portion |
| | 105 | front portion | 107 | curved portion |
| | 109 | handle knob | 111 | curved flange |
| | 113 | half cylinder | 115 | flat horizontal plane |
| | 117 | base picture | 119 | customer picture |
| | 120 | object (a cartoon characters circle) | | |
| | 121 | cut out opening | 123 | printer sheet |
| | 125 | perforation line | 127 | composite picture |
| | 129 | groove | 131 | customer picture |
| | 133 | base picture (template) | 135 | printer sheet |
| | 137 | perforation line | 139 | object (a soldier) |
| | 141 | composite picture | 143 | self trimmed composite picture |
| | 145 | cut out opening | 147 | base picture (template) |
| | 149 | self trimmed composite picture | 151 | object (an action figure) |
| | 153 | cut out opening | 155 | printer sheet |
| | 157 | die cut line | 159 | composite picture |
| | 160 | shoe section | 161 | bottom edge plate (toy platform) |
| | 163 | cylinder studs | 165 | 3D toy (toy building block) |
| | 167 | 3D toy (toy building block) | 171 | animated 3D art |
| | 173 | miniature Barbie | 175 | insertion box |
| | 177 | top portion | 179 | bottom portion |
| | 181 | mounting holes | 183 | screw holes |
| | 185 | wing head bolts | 187 | push button |
| FIGS. 9–11 | 230 | 3D picture frame | 231 | frame body |
| | 235 | frame glass assembly | 257 | curved back wall |
| | 259 | left side wall | 261 | right side wall |
| | 263 | front wall | 265 | cavity |

-continued

Figure 12:
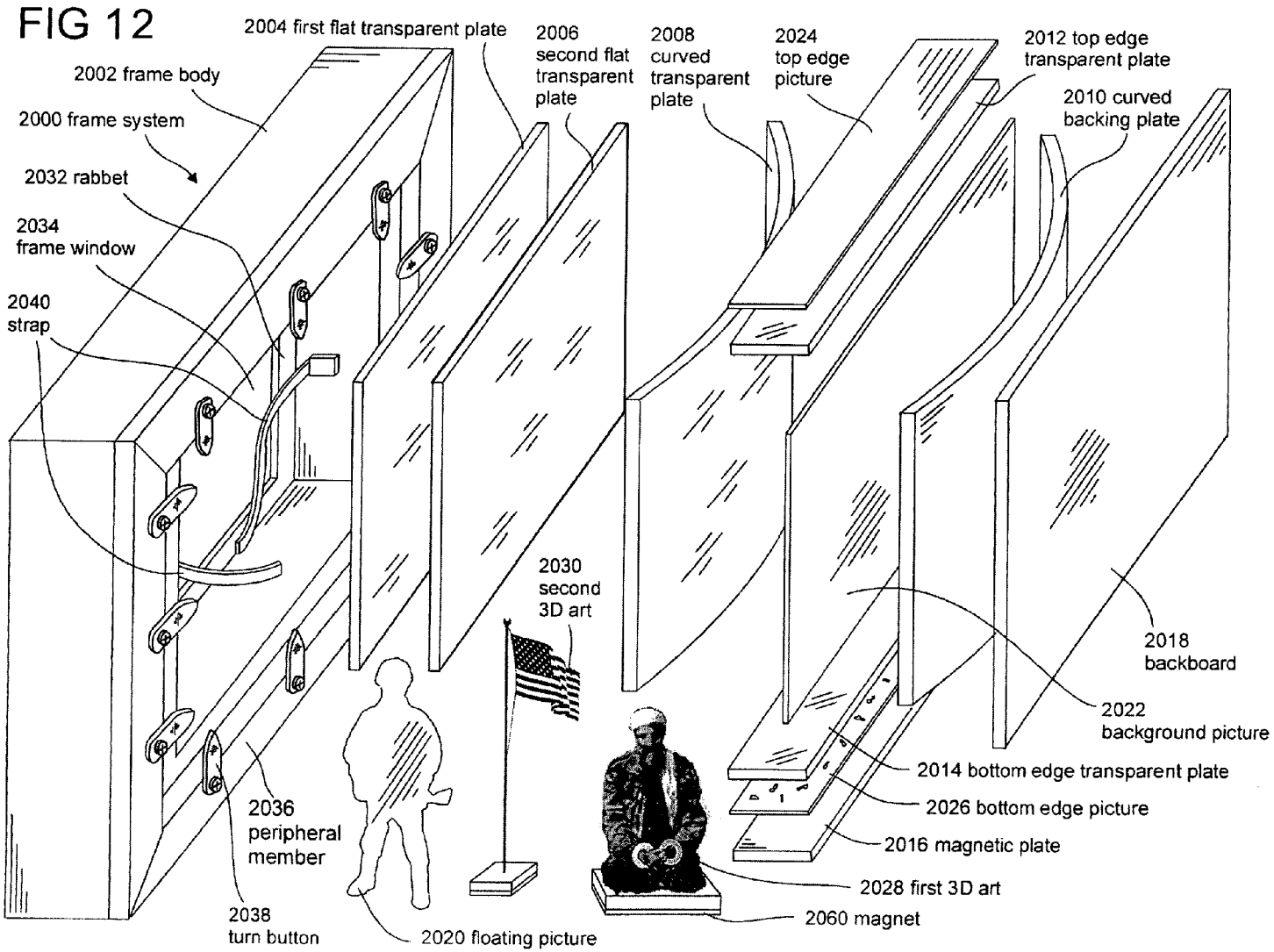
FIG. 12 is a perspective view of the third embodiment of the 3D picture frame of the present invention for making a 3D framed display.
Figure 13:
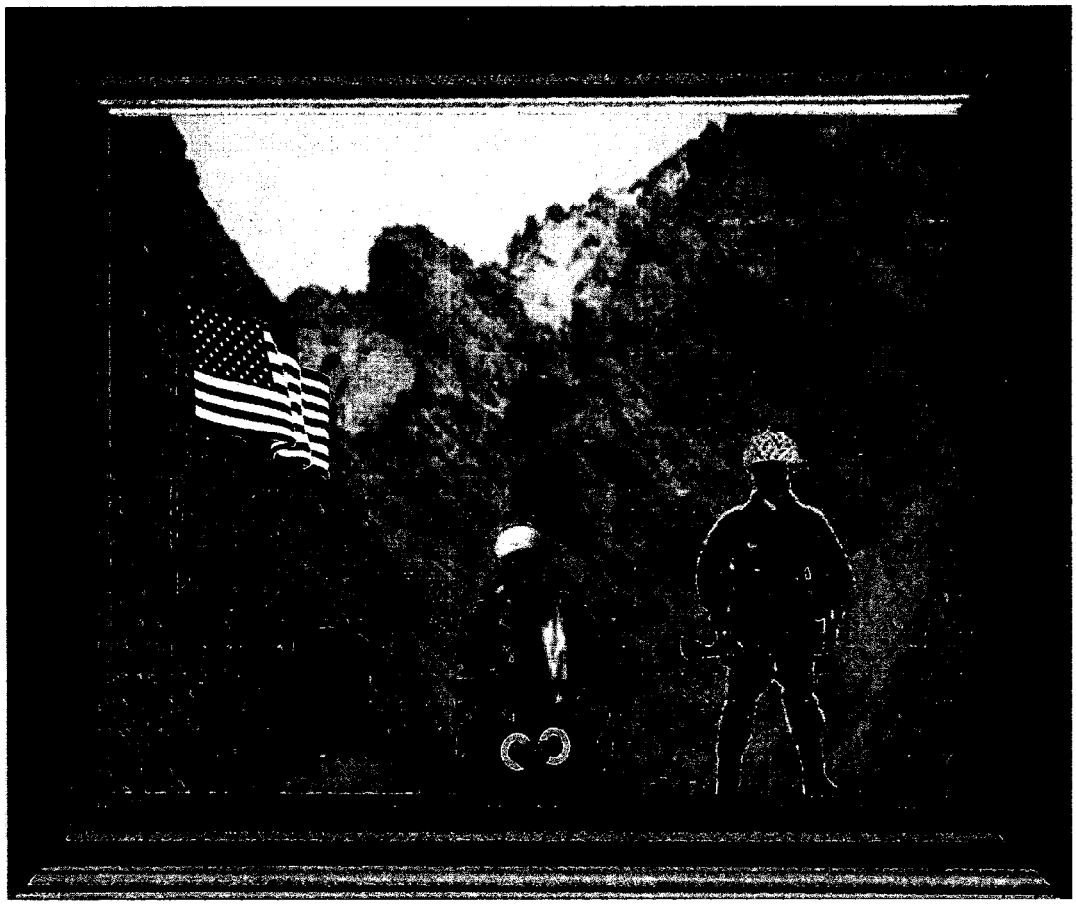
FIG. 13 is an elevational view showing one example of the 3D framed display of the present invention.
Figure 14:
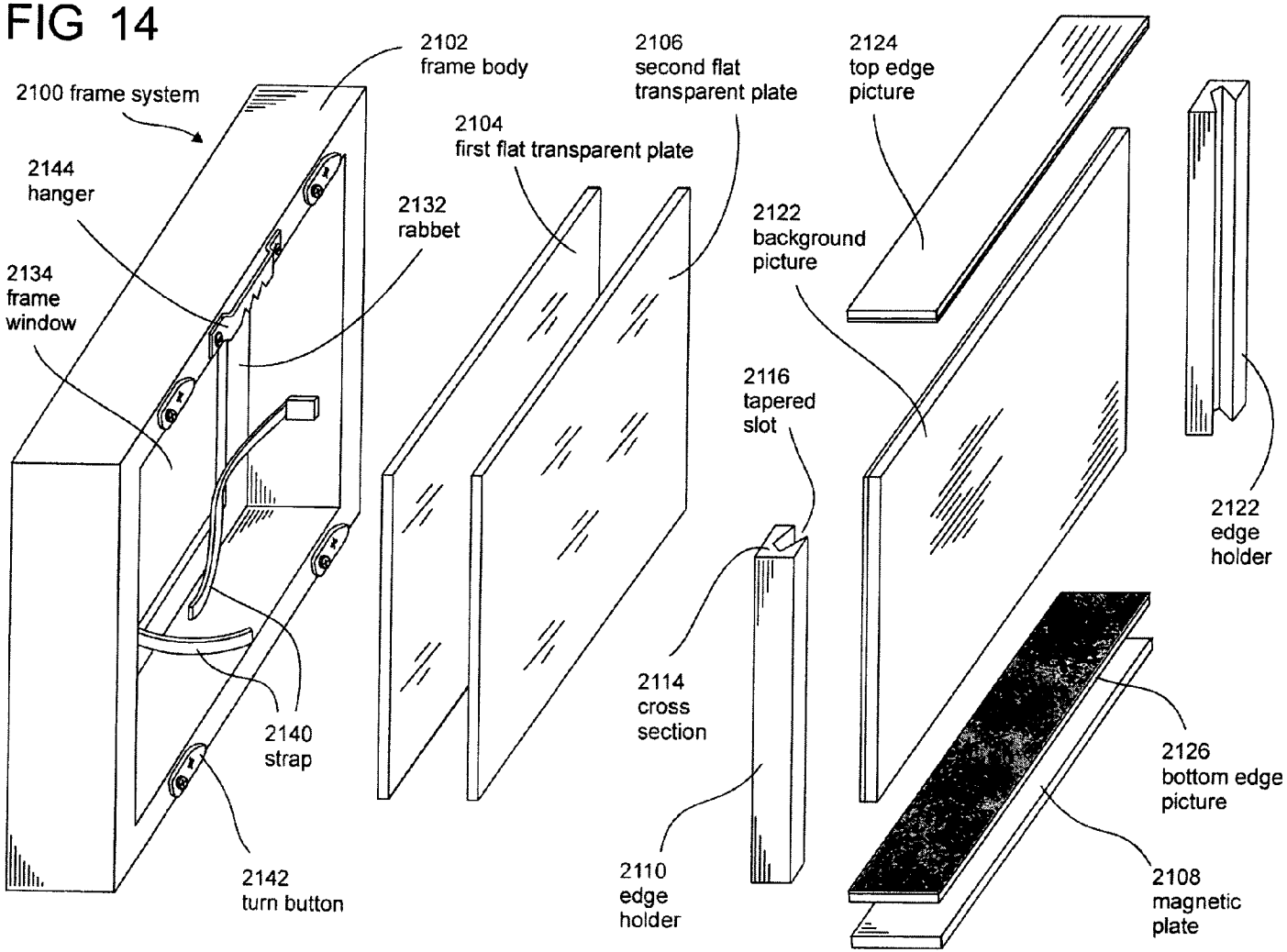
FIG. 14 is a perspective view of the fourth embodiment of the 3D picture frame of the present invention for making a 3D framed display.
Figure 15:
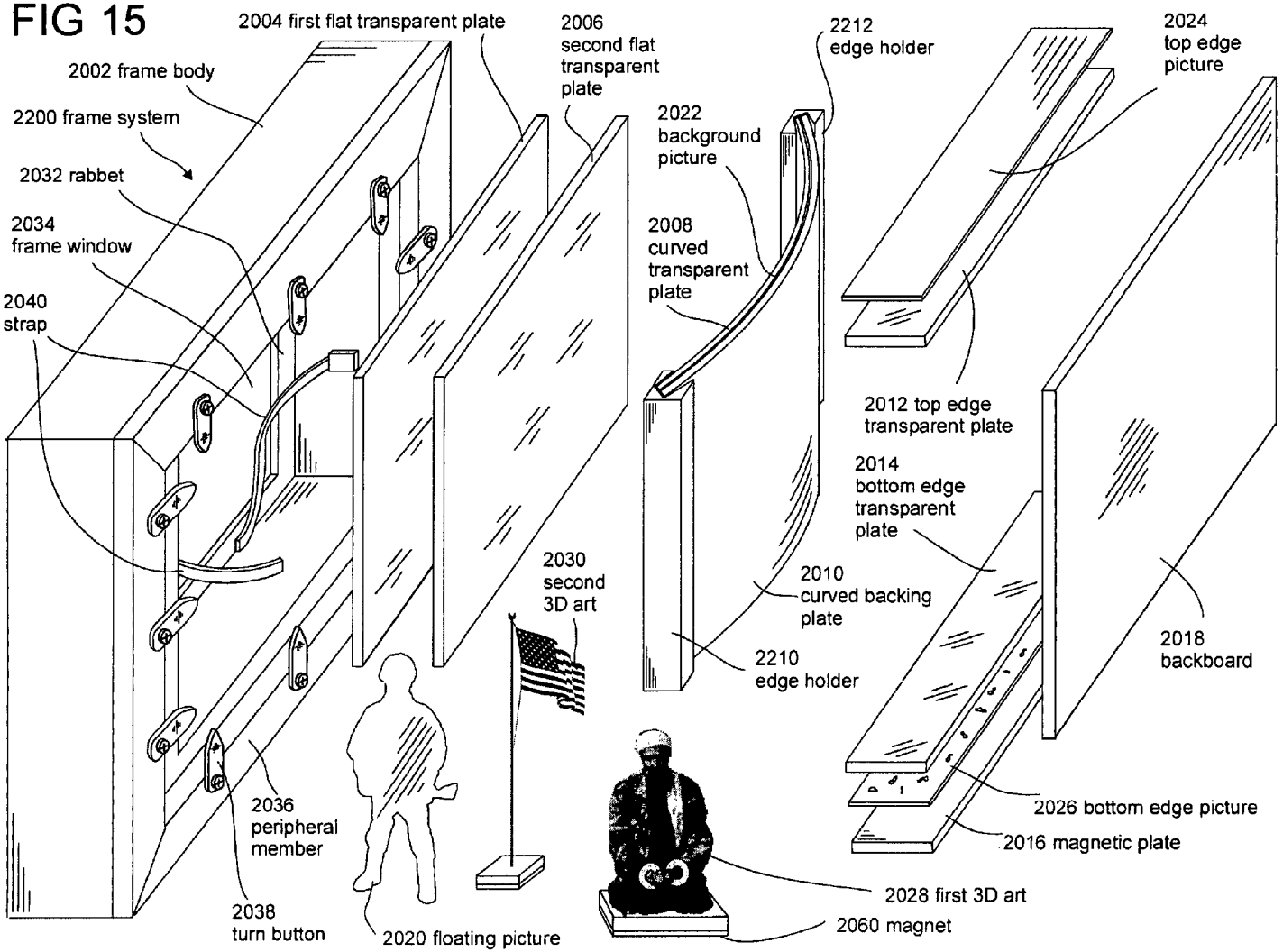
FIG. 15 is a perspective view of the fifth embodiment of the 3D picture frame of the present invention for making a 3D framed display.
Figure 16:
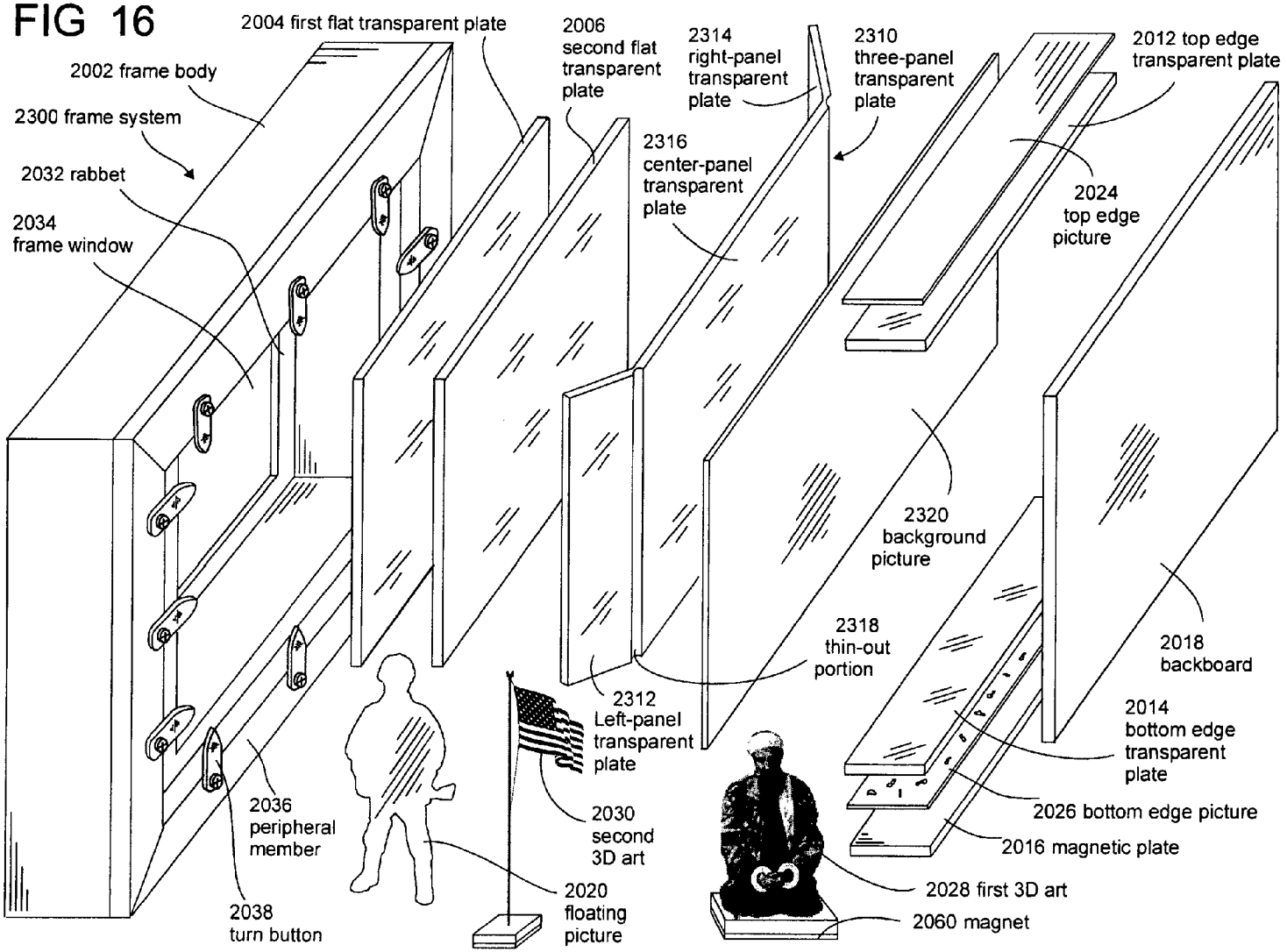
FIG. 16 is a perspective view of the sixth embodiment of the 3D picture frame of the present invention for making a 3D framed display.
Figure 20:
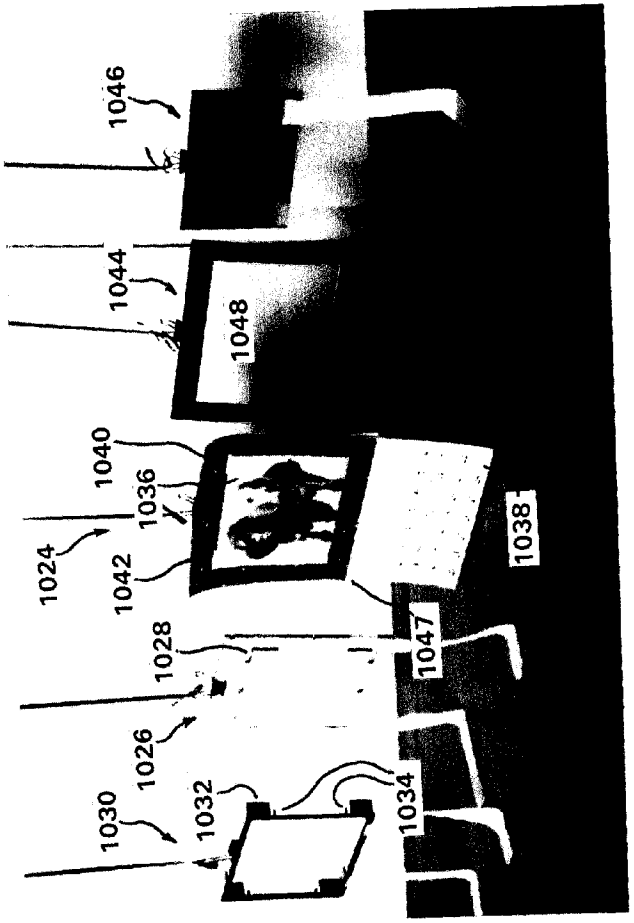
FIG. 20 is a perspective view showing the calendar sheet assembly of FIG. 19, disassembled to show its details.
Figure 21:
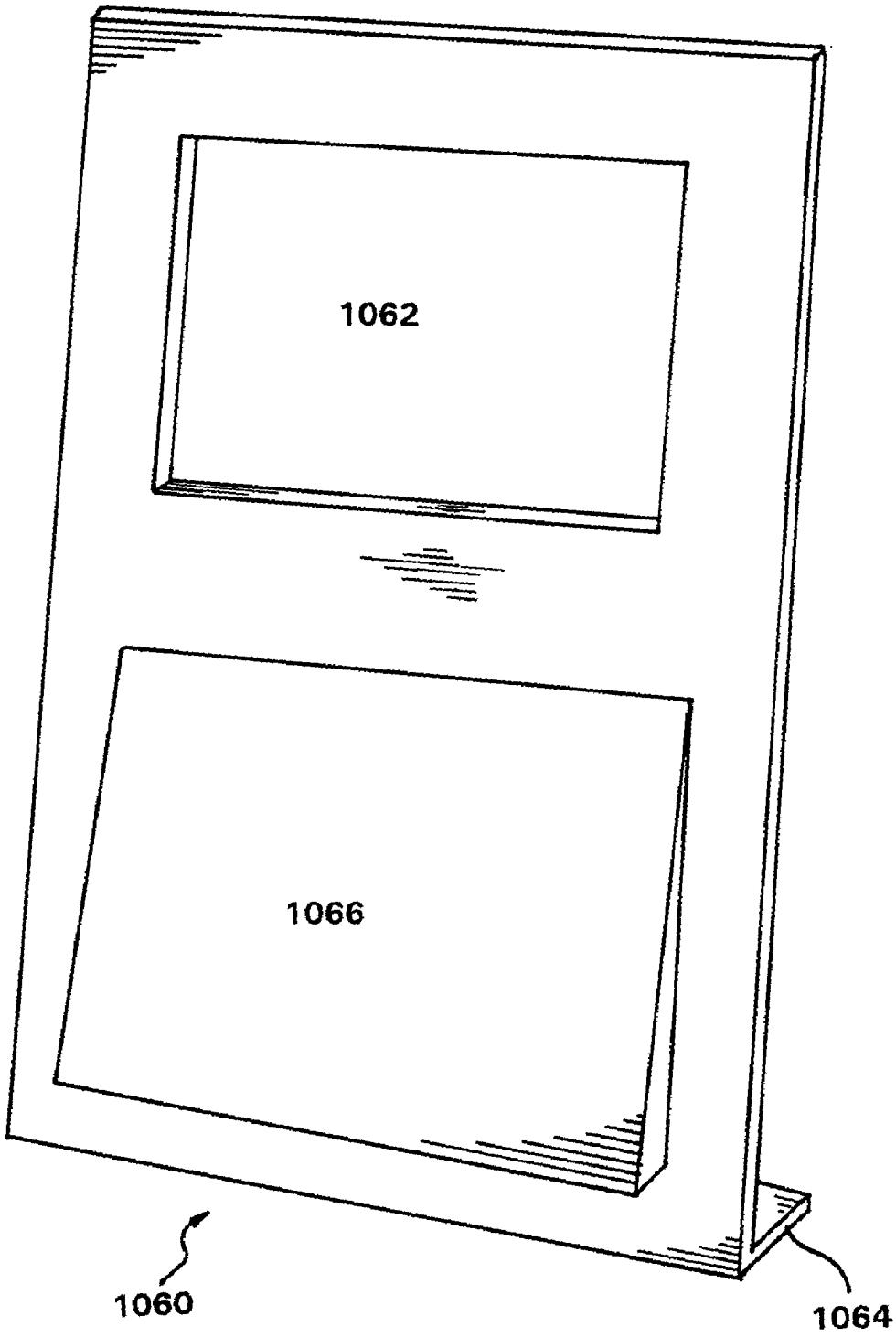
FIG. 21 is a perspective view showing a border backing plate of the present invention.
Figure 22:
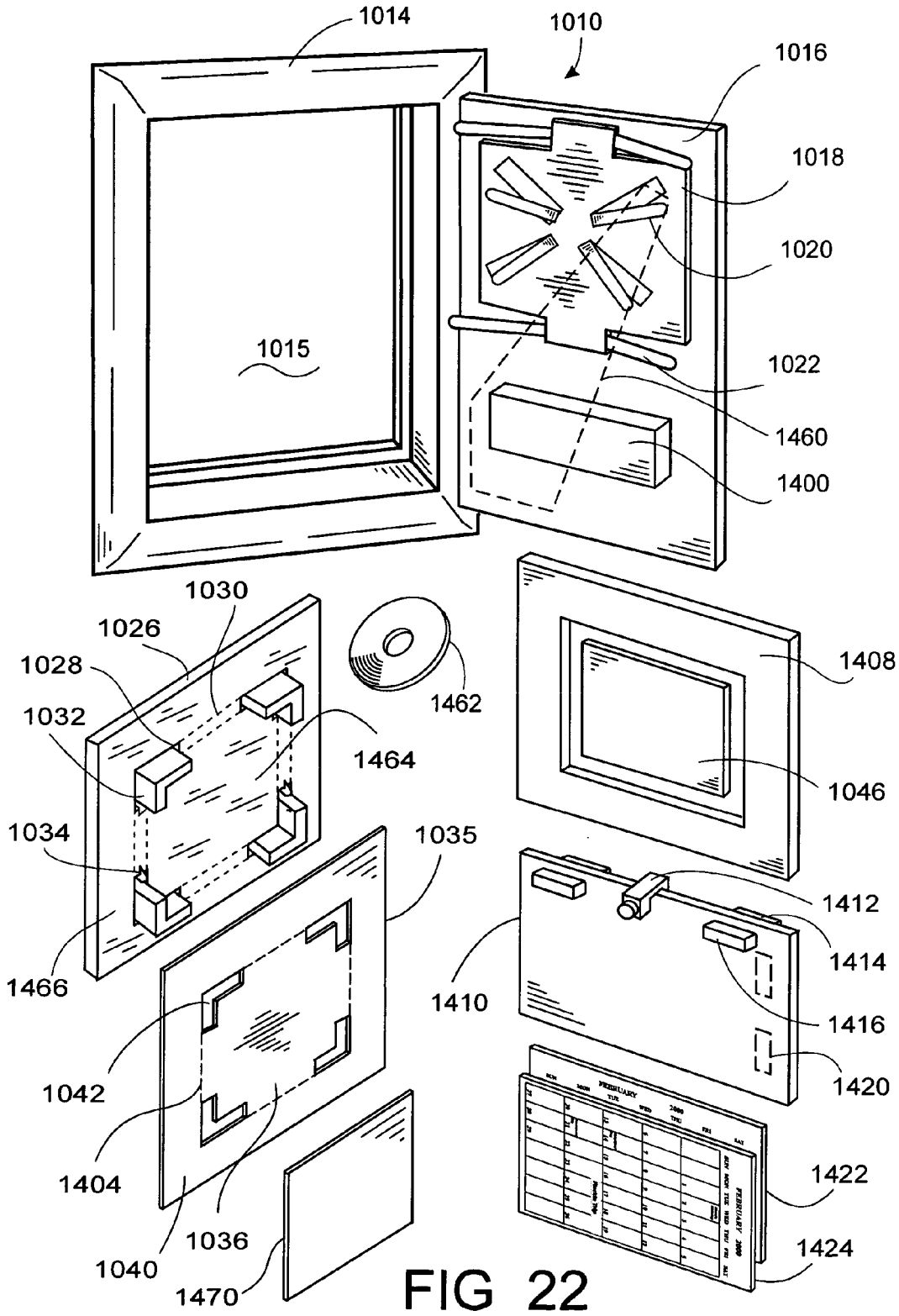
FIG. 22 is a perspective view, showing the disassembled frame calendar system previously shown in FIGS. 17–21. Several improvements are incorporated to enable a calendar sheet containing only the calendar date table to be mounted without opening the frame.
Figure 24:
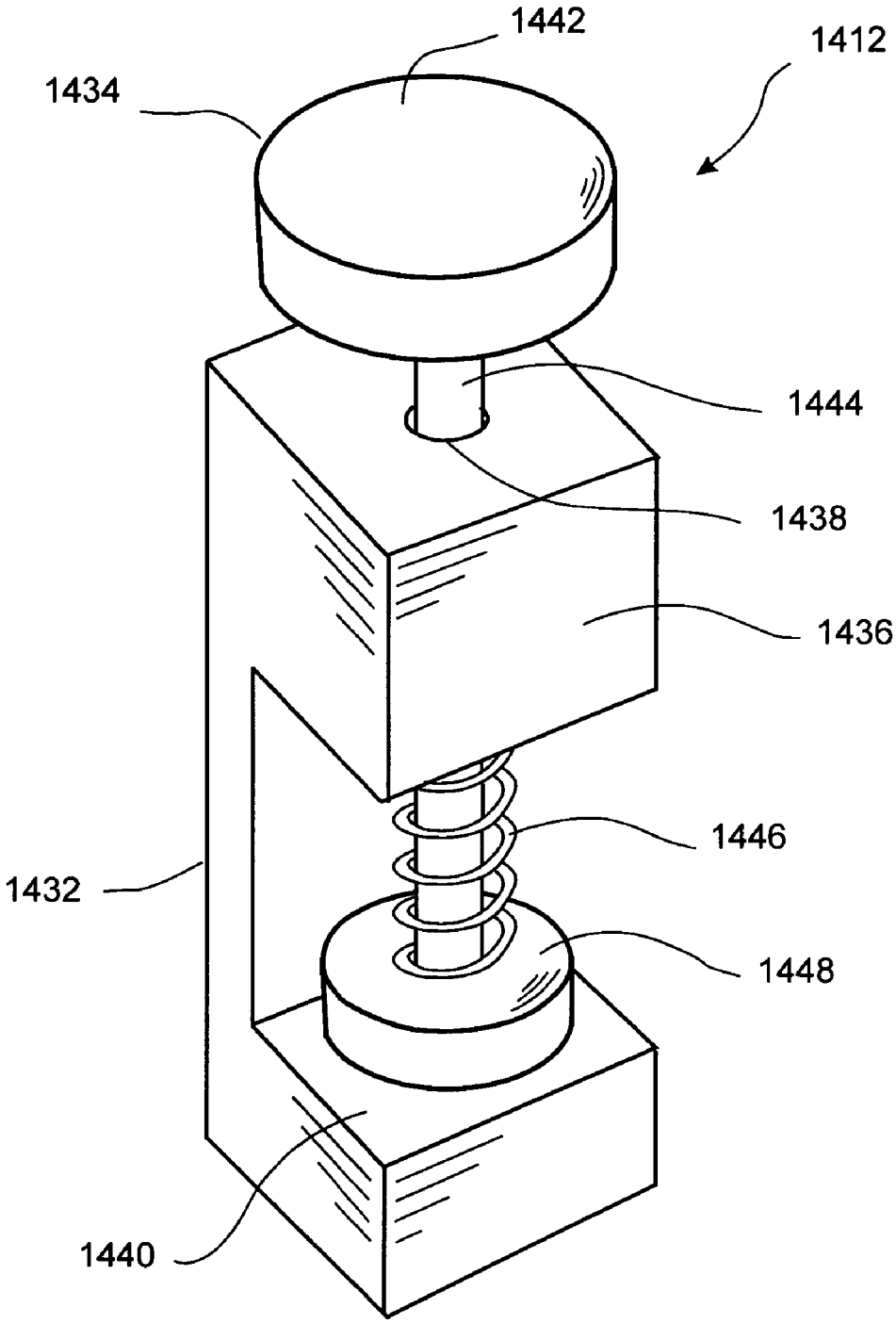
FIG. 24 is a perspective view, showing the details of a spring clamp.

| REFERENCE NUMERALS IN DRAWINGS | | | | |
|---|---|---|---|---|
| | 273 | left horizontal side plate | 275 | right horizontal side plate |
| | 277 | left vertical side plate | 279 | right vertical side plate |
| | 281 | mounting plate | 283 | mounting holes |
| | 285 | clearance holes | 287 | screws |
| | 291 | screw holes | 293 | flexible frame glass |
| | 295 | mounting holes | 297 | set of handle knob and nut |
| | 299 | groove | 301 | frame rabbets |
| | 303 | curved top lip | 305 | curved slot |
| | 307 | exposed top edge surface of the back wall 257 | | |
| | 309 | inside edge of the curved slot 305 | | |
| | 311 | mounting holes | | |
| FIGS. 12–13 | 2000 | 3D picture frame | 2002 | frame body |
| | 2004 | first flat transparent plate | 2006 | second flat transparent plate |
| | 2008 | curved transparent plate | 2010 | curved backing plate |
| | 2012 | top edge transparent plate | 2014 | bottom edge transparent plate |
| | 2016 | magnetic plate | 2018 | backboard |
| | 2020 | floating picture (self trimmed composite picture) | 2022 | background picture |
| | 2024 | top edge picture | 2026 | bottom edge picture |
| | 2028 | first 3D art | 2030 | second 3D art |
| | 2032 | rabbet | 2034 | frame window |
| | 2036 | peripheral member | 2038 | turn buttons |
| | 2040 | strap | 2060 | magnet |
| FIG. 14 | 2100 | 3D picture frame | 2102 | frame body |
| | 2104 | first flat transparent plate | 2106 | second flat transparent plate |
| | 2108 | magnetic plate | 2110 | edge holder |
| | 2112 | edge holder | 2120 | floating picture (not shown) |
| | 2122 | background picture | 2124 | top edge picture |
| | 2126 | bottom edge picture | 2128 | 3D art (not shown) |
| | 2132 | rabbet | 2134 | frame window |
| | 2140 | strap | 2142 | turn button |
| | 2144 | hanger | | |
| FIG. 15 | 2200 | 3D picture frame | 2210 | edge holder |
| | 2212 | edge holder | | |
| FIG. 16 | 2300 | 3D picture frame | 2310 | three-panel transparent plate |
| | 2312 | left-panel transparent plate | 2314 | right-panel transparent plate |
| | 2316 | center-panel transparent plate | | |
| | 2318 | thin-out portion | 2320 | background picture |
| FIGS. 17–21 | 1010 | frame | 1012 | calendar sheet assembly |
| | 1014 | frame body | 1015 | window |
| | 1016 | back door | 1018 | spring plate |
| | 1020 | inner spring leaf | 1022 | outer spring leaf |
| | 1024 | calendar sheets | 1026 | window glass |
| | 1028 | slot holes | 1030 | inner frame |
| | 1032 | L-shaped stud walls | 1034 | spring clips |
| | 1036 | calendar picture section | 1038 | calendar date table section |
| | 1040 | border section | 1042 | L-shaped slot holes |
| | 1044 | border backing plate | 1046 | picture backing plate |
| | 1047 | step | | |
| | 1048 | opening | 1050 | bent section |
| | 1060 | border backing plate | 1062 | opening |
| | 1064 | bent section | 1066 | raised section |
| FIGS. 22–24 | 1010 | frame or frame assembly or picture frame or photo frame | | |
| | 1014 | frame body | 1015 | frame window |
| | 1016 | back door or back board | 1018 | spring plate |
| | 1020 | inner spring leaf | 1022 | outer spring leaf |
| | 1026 | window glass | | |
| | 1028 | slot holes | 1030 | inner frame dash line outline |
| | 1032 | L-shaped stud walls | 1034 | spring clips |
| | 1035 | calendar picture sheet | | |
| | 1036 | calendar center picture section | | |
| | 1040 | calendar border picture section | | |
| | 1042 | L-shaped slot holes | | |
| | 1046 | picture backing plate | | |
| | 1400 | spacer | 1404 | perforation lines |
| | 1408 | border backing plate | | |
| | 1410 | calendar backing plate | | |
| | 1412 | spring clamp | 1414 | magnet blocks |
| | 1416 | magnet blocks | 1418 | magnet blocks (not shown) |
| | 1420 | dash line rectangles | 1422 | horizontal calendar sheet |
| | 1424 | vertical calendar sheet | 1426 | boundary line |
| | 1432 | clamp base | 1434 | clamp plunger |
| | 1436 | base handle | 1438 | straight hole |
| | 1440 | base plate | 1442 | plunger handle |
| | 1444 | plunger stem | 1446 | compression spring |
| | 1448 | disk | 1450 | dash line |
| | 1452 | boundary line | 1454 | dash line |
| | 1456 | rectangle dash lines | 1458 | rectangle dash lines |

-continued

Figure 25:
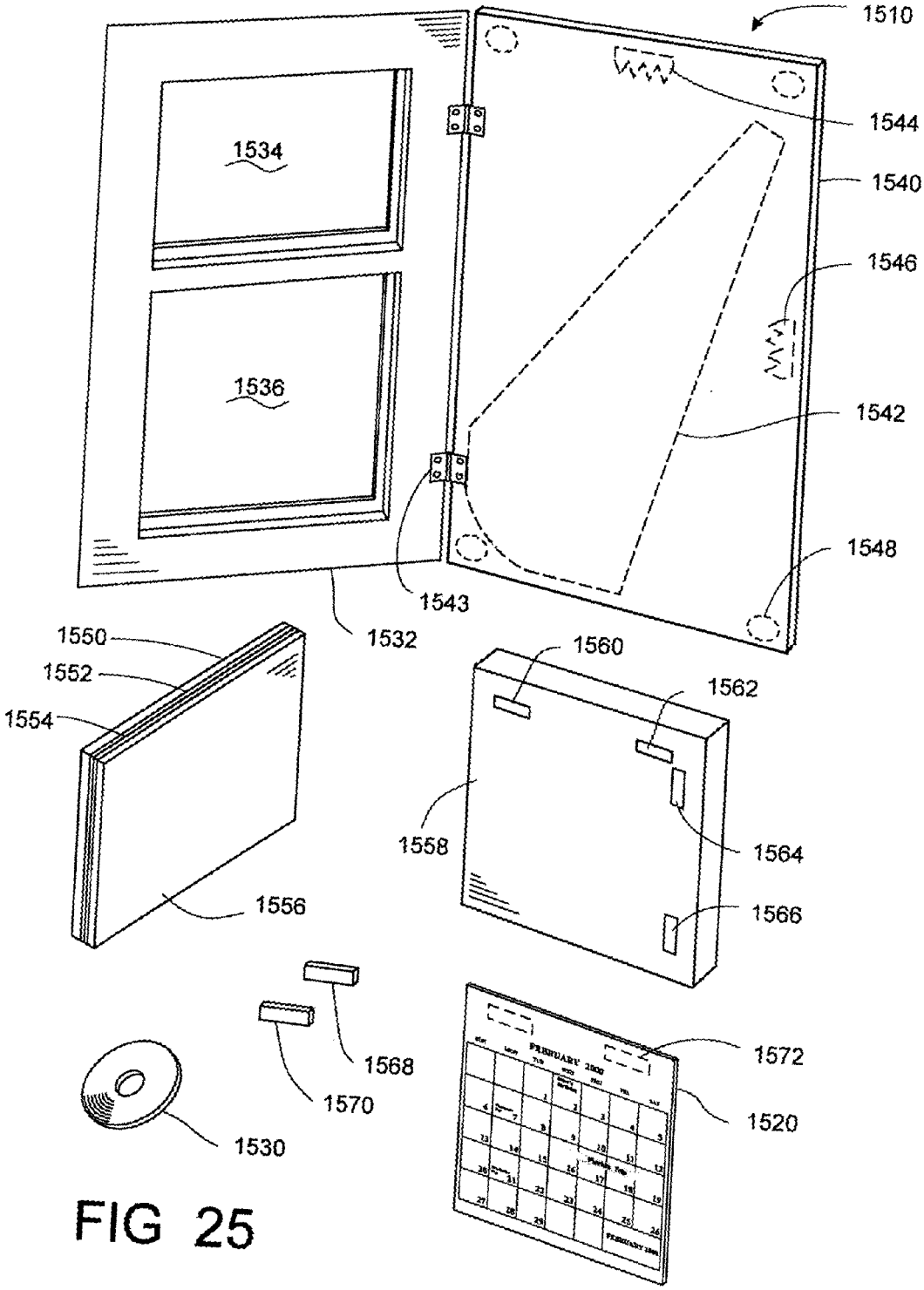
FIG. 25 is a perspective view, showing a second embodiment of the frame calendar system of the present invention.
Figure 26:
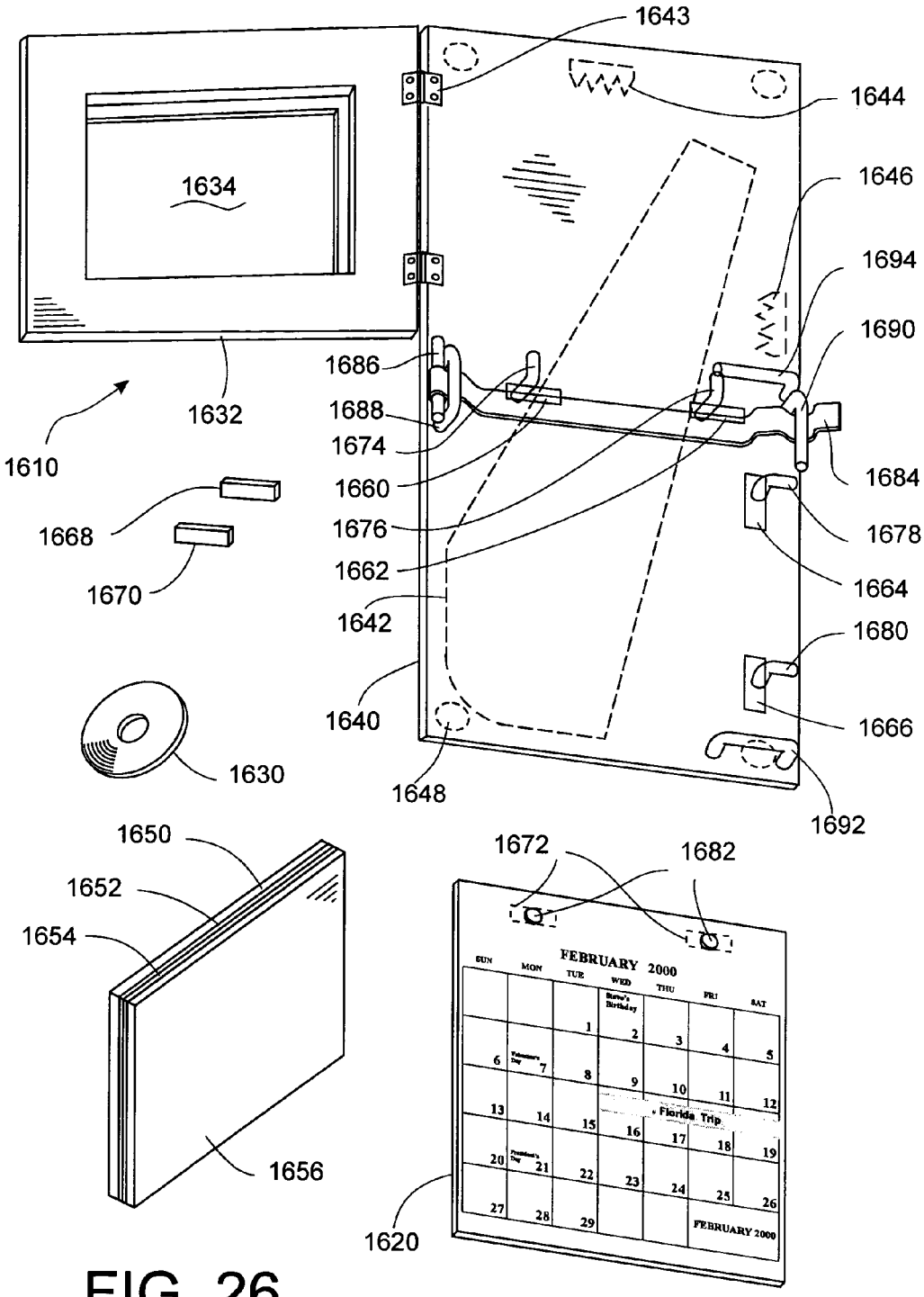
FIG. 26 is a perspective view, showing a third embodiment of the frame calendar system of the present invention.
Figure 27:
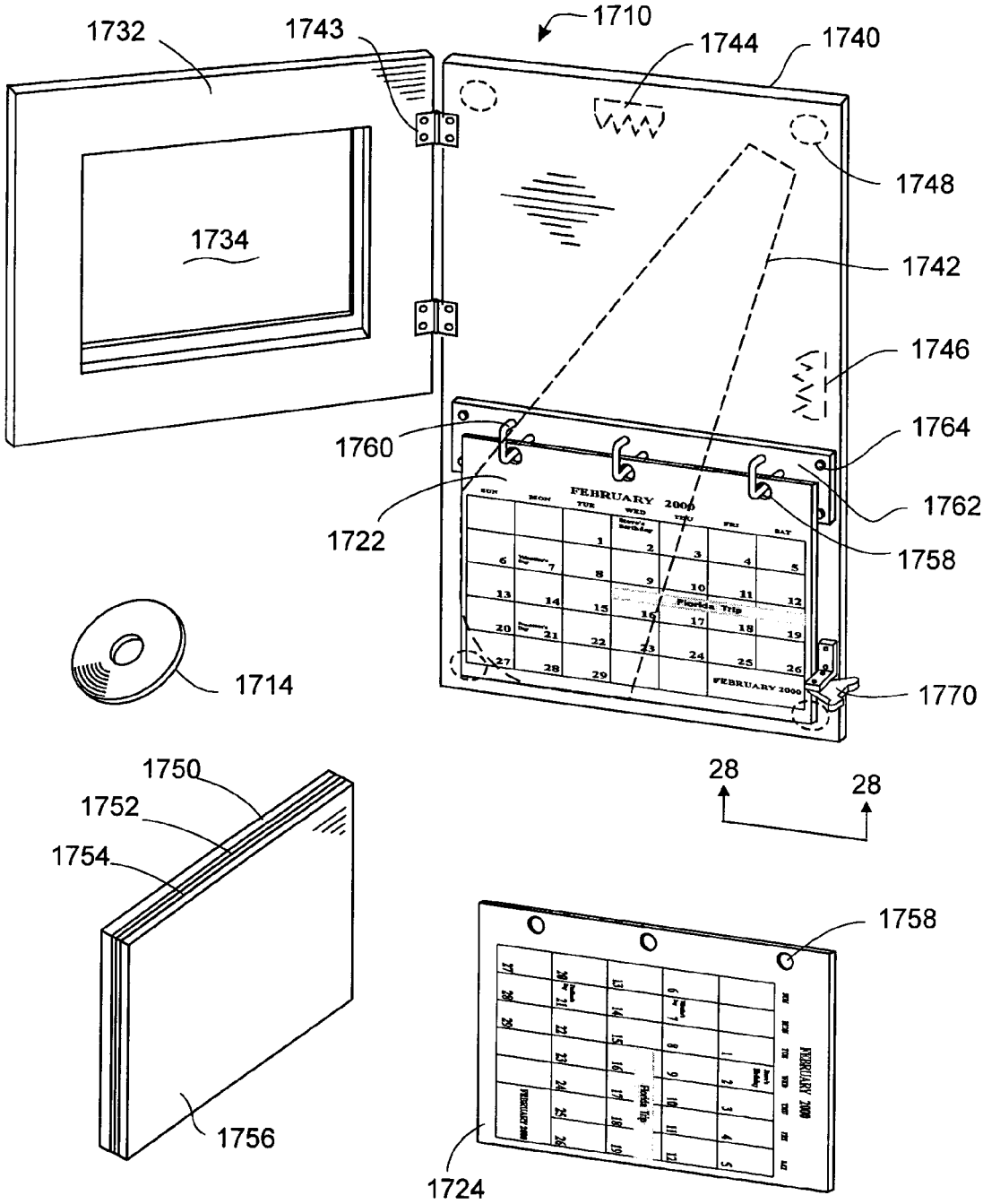
FIG. 27 is a perspective view, showing a fourth embodiment of the frame calendar system of the present invention.
Figure 28:
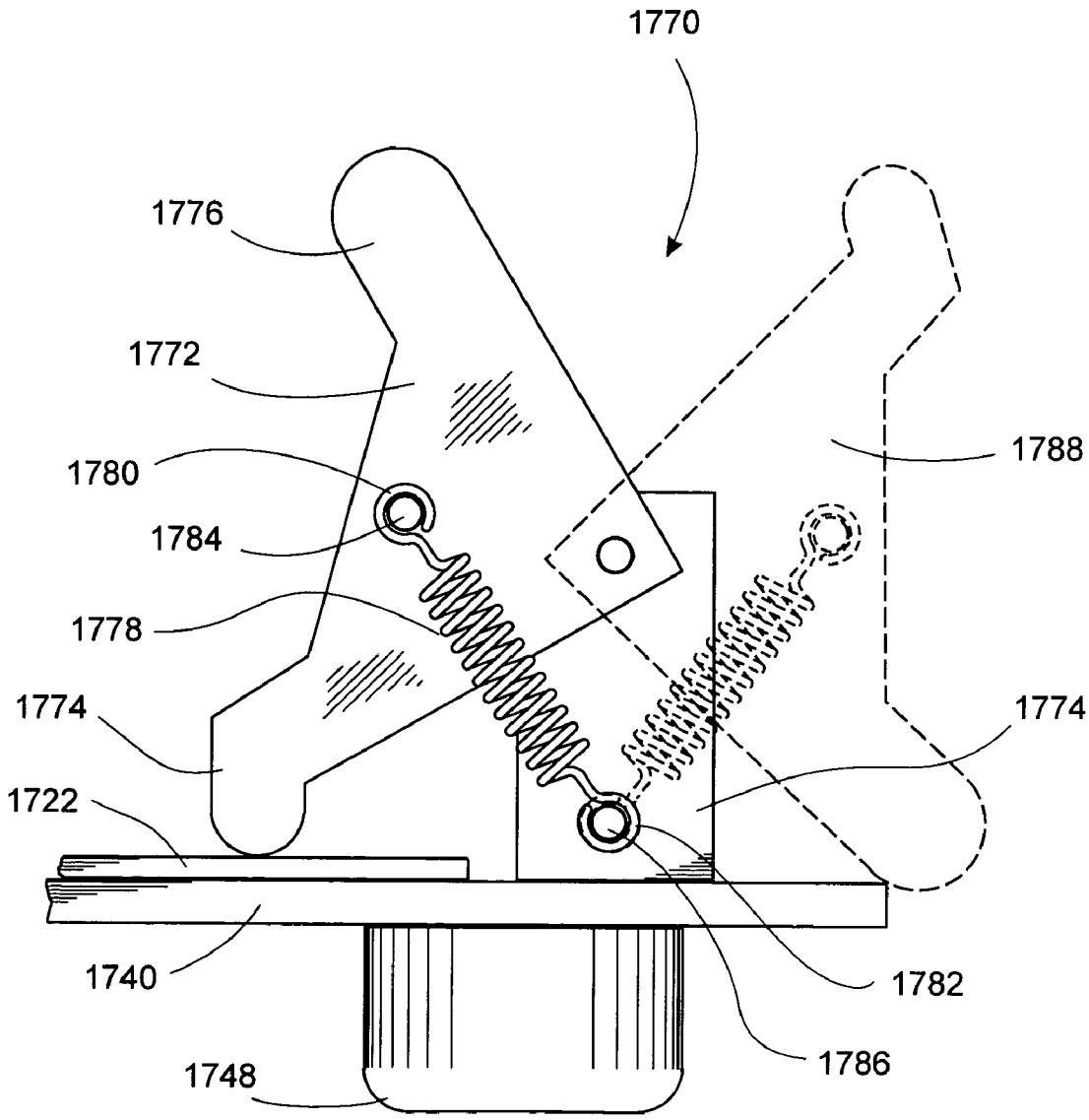
FIG. 28 is an enlarged side view of a portion of the frame calendar system of FIG. 27, as viewed along the line 28—28 of FIG. 27, showing the details of a toggle stop.
Figure 29:
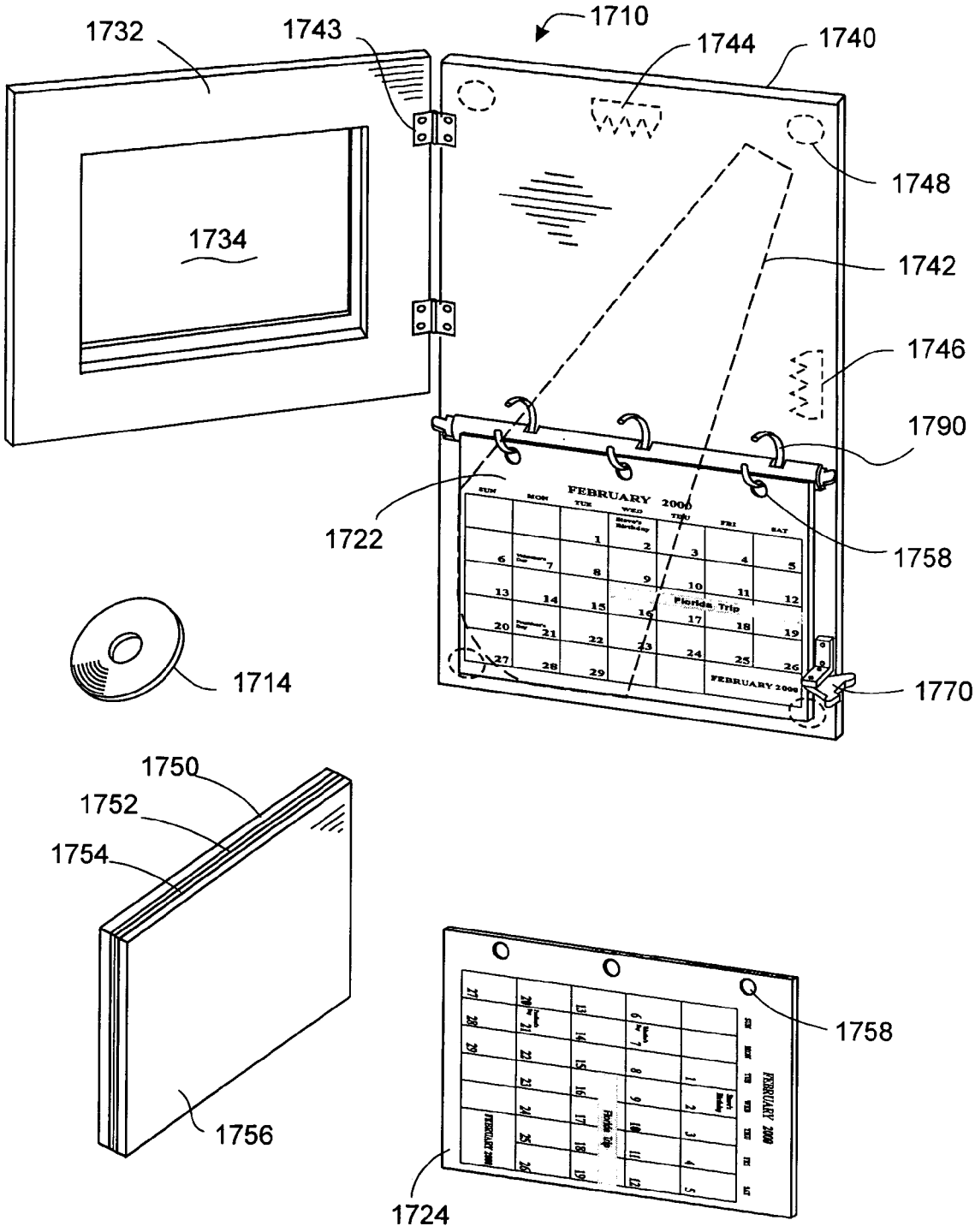
FIG. 29 is a perspective view, showing the frame calendar system of FIG. 27 in which three U-shaped hanging hooks are replaced by a three ring binder.
Figure 30:
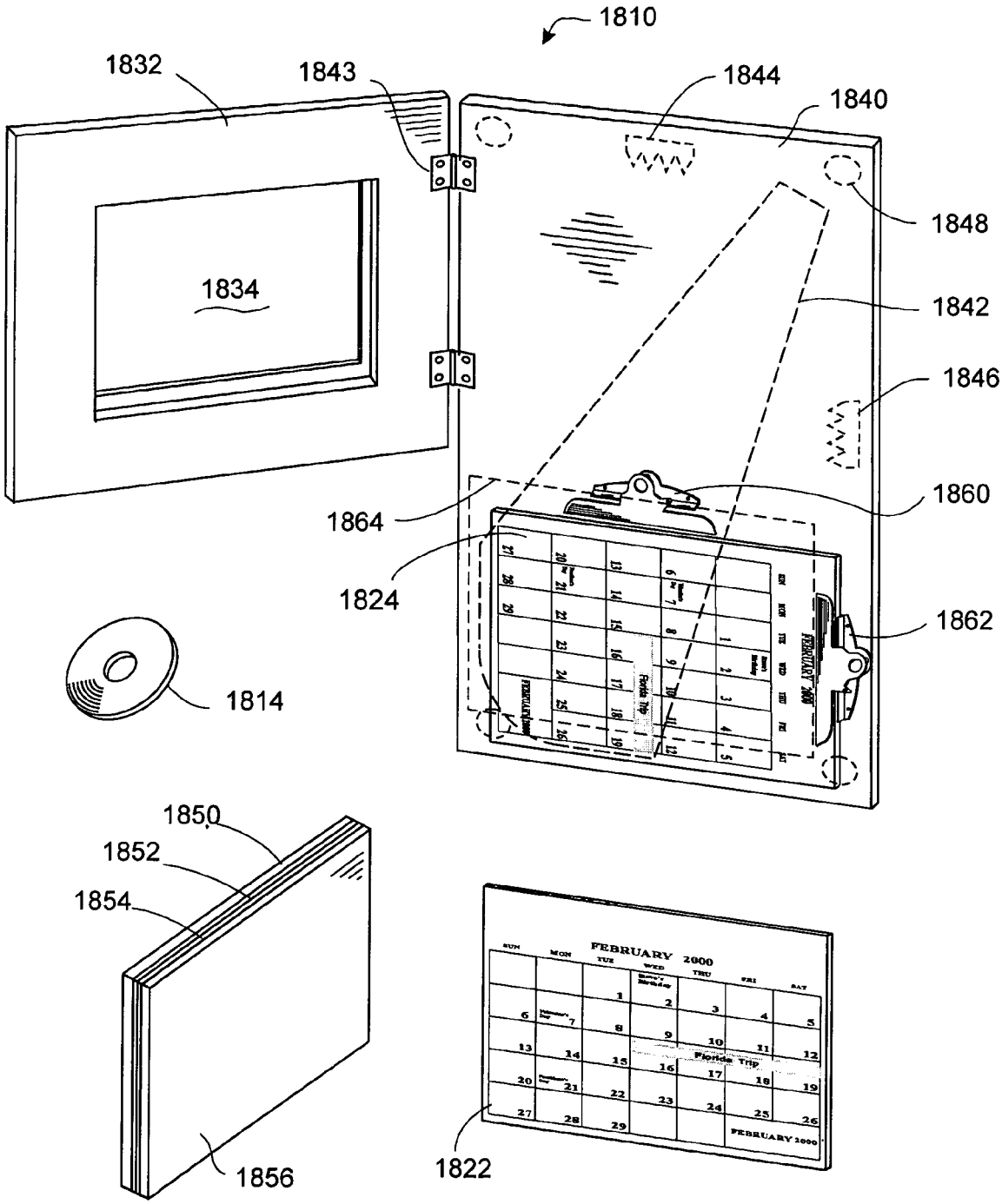
FIG. 30 is a perspective view, showing a fifth embodiment of the frame calendar system of the present invention.
Figure 31:
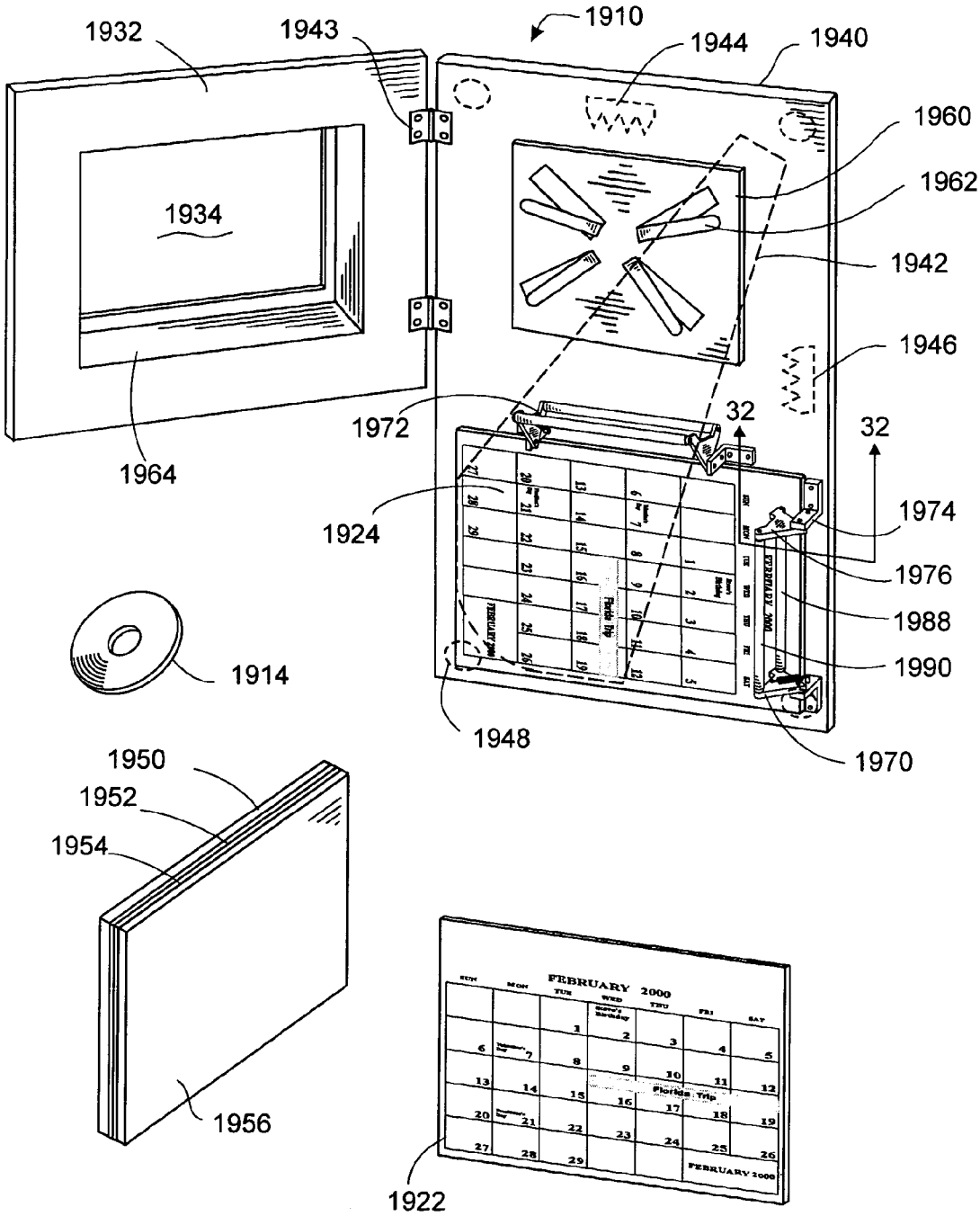
FIG. 31 is a perspective view, showing a sixth embodiment of the frame calendar system of the present invention.
Figure 32:
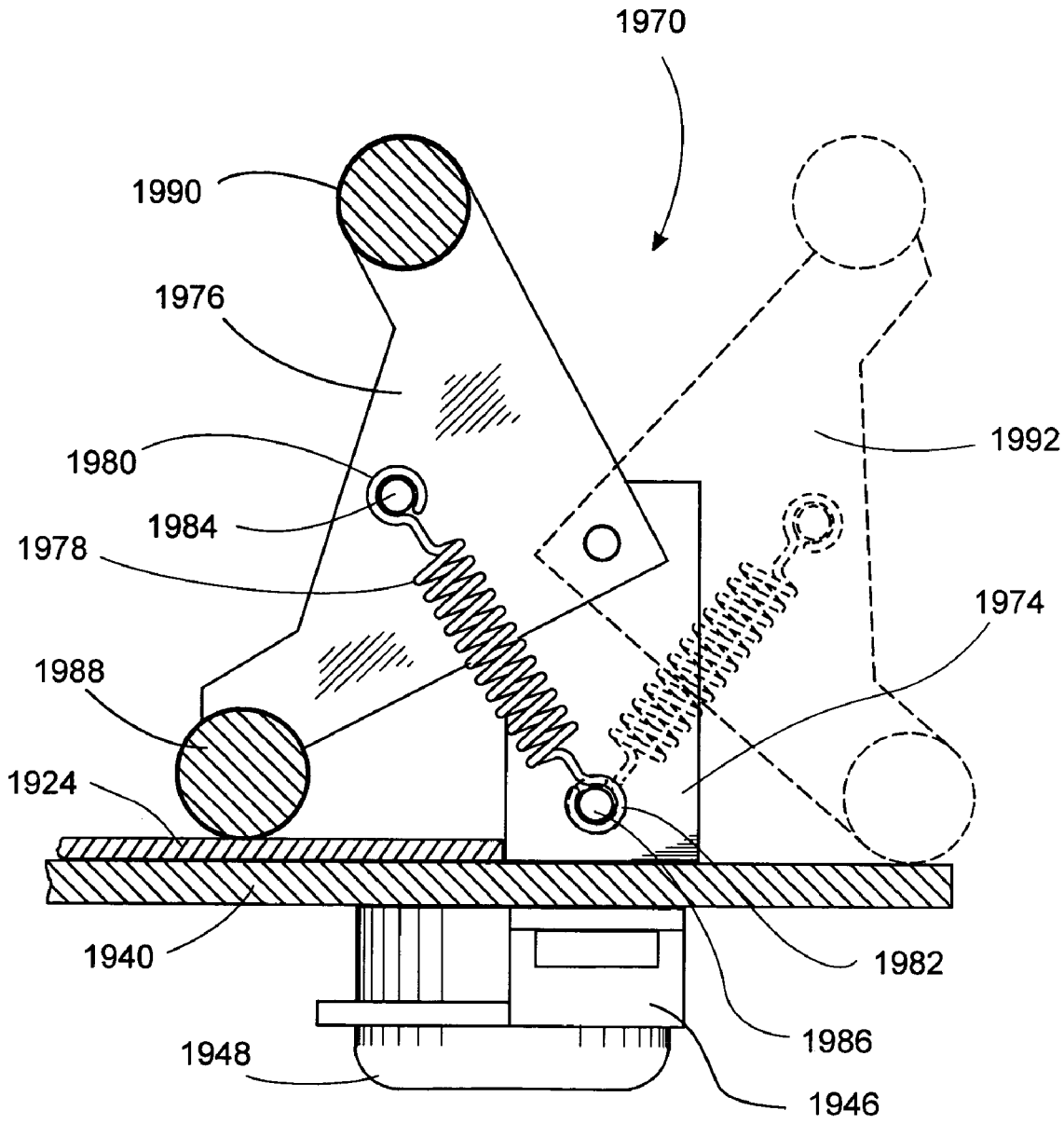
FIG. 32 is an enlarged cross sectional view of a portion of the frame calendar system of FIG. 31, as viewed along the line 32—32 of FIG. 31, showing the details of a toggle clamp.

| REFERENCE NUMERALS IN DRAWINGS | | | | |
|---|---|---|---|---|
| | 1460 | easel dash line outline | 1462 | electronic storage medium or compact disc (CD) |
| | 1464 | center display area | 1466 | border display area |
| | 1470 | personal photo or personal picture | | |
| FIG. 25 | 1510 | frame or frame assembly | 1520 | calendar sheet |
| | 1530 | electronic storage medium or compact disc or media | | |
| | 1532 | frame body | 1534 | first frame window |
| | 1536 | second frame window | 1540 | back door or back board |
| | 1542 | easel | 1544 | vertical hanger |
| | 1546 | horizontal hanger | 1548 | rubber feet |
| | 1550 | window glass | | |
| | 1552 | horizontal photo or horizontal picture | | |
| | 1554 | vertical photo or vertical picture | | |
| | 1556 | cardboard | 1558 | calendar backing plate |
| | 1560 | stationary magnet block | 1562 | stationary magnet block |
| | 1564 | stationary magnet block | 1566 | stationary magnet block |
| | 1568 | movable magnet block | 1570 | movable magnet block |
| | 1572 | rectangular dash line | | |
| FIG. 26 | 1610 | frame or frame assembly | 1620 | calendar sheet |
| | 1630 | electronic storage medium or compact disc or media | | |
| | 1632 | frame body | 1634 | frame window |
| | 1640 | back door or back board | | |
| | 1642 | easel | | |
| | 1643 | hinges | 1644 | vertical hanger |
| | 1646 | horizontal hanger | 1648 | rubber feet |
| | 1650 | window glass | | |
| | 1652 | horizontal photo or horizontal picture | | |
| | 1654 | vertical photo or vertical picture | | |
| | 1656 | cardboard | | |
| | 1660 | stationary magnet block | 1662 | stationary magnet block |
| | 1664 | stationary magnet block | 1666 | stationary magnet block |
| | 1668 | movable magnet block | 1670 | movable magnet block |
| | 1672 | rectangular dash line | 1674 | hanging hook |
| | 1676 | hanging hook | 1678 | hanging hook |
| | 1680 | hanging hook | 1682 | hanging holes |
| | 1684 | spring clamp | 1686 | stop bar |
| | 1688 | "U" shaped bar | 1690 | "L" shaped bar |
| | 1692 | "U" shaped bar | 1694 | "L" shaped bar |
| FIGS. 27–29 | 1710 | frame or frame assembly | | |
| | 1714 | electronic storage medium or compact disc or media | | |
| | 1722 | horizontal calendar sheet | 1724 | vertical calendar sheet |
| | 1732 | frame body | 1734 | frame window |
| | 1740 | back door or back board | | |
| | 1742 | easel | | |
| | 1743 | hinges | 1744 | vertical hanger |
| | 1746 | horizontal hanger | 1748 | rubber feet |
| | 1750 | window glass | | |
| | 1752 | horizontal photo or horizontal picture | | |
| | 1754 | vertical photo or vertical picture | | |
| | 1756 | cardboard | 1758 | mounting holes |
| | 1760 | hanging hooks | 1762 | metal plate |
| | 1764 | screws | 1770 | rotatable stop or toggle stop |
| | 1772 | toggle plate | 1774 | leg |
| | 1776 | leg | 1778 | spring |
| | 1780 | end hook | 1782 | end hook |
| | 1784 | stud | 1786 | stud |
| | 1788 | toggle plate dash outline | 1790 | three ring binder |
| FIG. 30 | 1810 | frame or frame assembly | | |
| | 1814 | electronic storage medium or compact disc or media | | |
| | 1822 | horizontal calendar sheet | 1824 | vertical calendar sheet |
| | 1832 | frame body | 1834 | frame window |
| | 1840 | back door or back board | | |
| | 1842 | easel | | |
| | 1843 | hinges | 1844 | vertical hanger |
| | 1846 | horizontal hanger | 1848 | rubber feet |
| | 1850 | window glass | | |
| | 1852 | horizontal photo or horizontal picture | | |
| | 1854 | vertical photo or vertical picture | | |
| | 1856 | cardboard | | |
| | 1860 | spring clamp or clipboard clamp | | |
| | 1862 | spring clamp or clipboard clamp | | |
| | 1864 | dash outline | | |
| FIGS. 31–32 | 1910 | frame or frame assembly | | |
| | 1914 | electronic storage medium or compact disc or media | | |
| | 1922 | horizontal calendar sheet | 1924 | vertical calendar sheet |
| | 1932 | frame body | 1934 | frame window |
| | 1940 | back door or back board | | |

-continued

Figure 34:
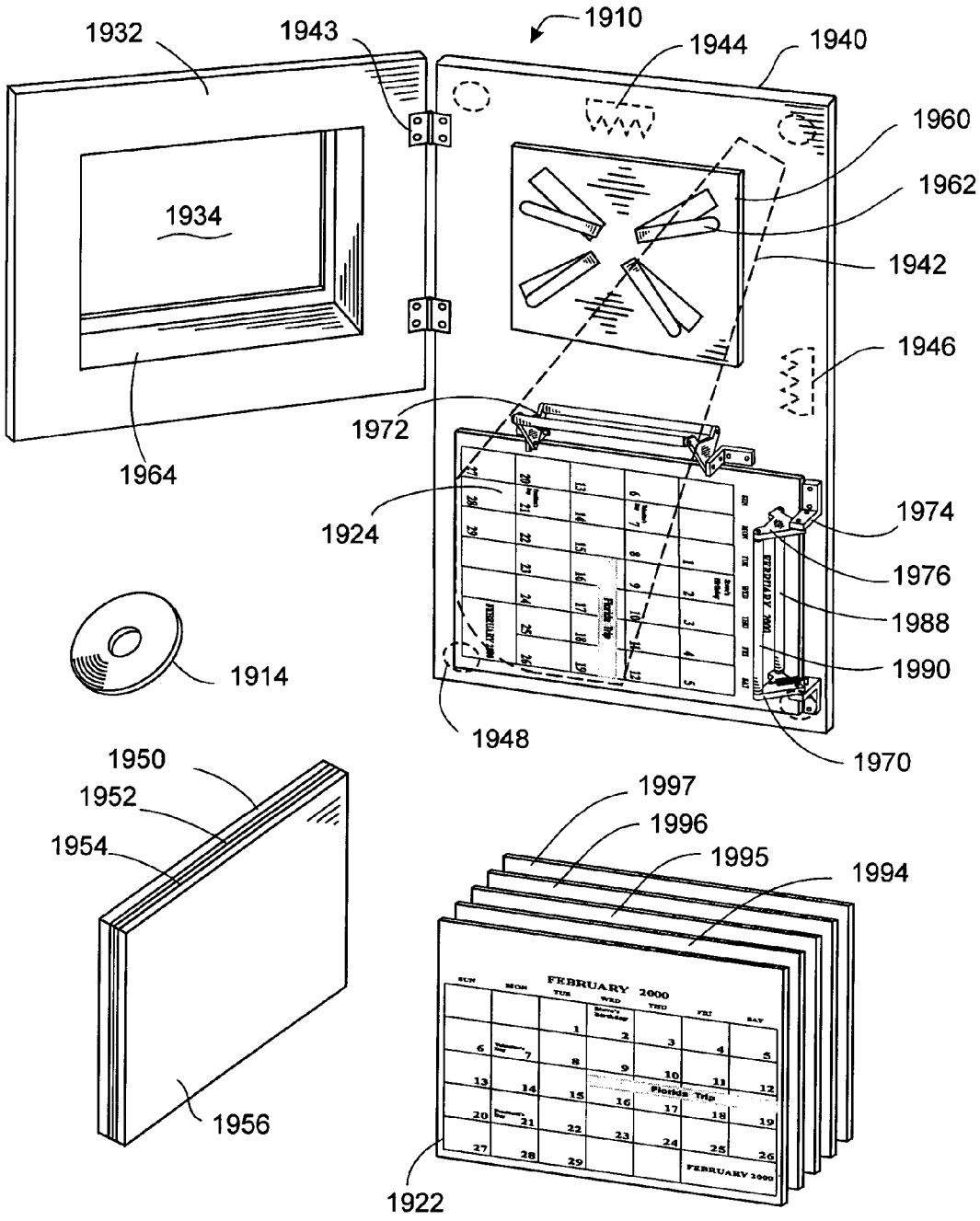
FIG. 34 is a perspective view, showing the same sixth embodiment of the frame calendar system of the present invention shown in FIG. 31, and two additional calendar sheets and two non-calendar sheets.

| REFERENCE NUMERALS IN DRAWINGS | | | |
|---|---|---|---|
| | 1942 | easel | |
| | 1943 | hinges | 1944 vertical hanger |
| | 1946 | horizontal hanger | 1948 rubber feet |
| | 1950 | window glass | |
| | 1952 | horizontal photo or horizontal picture | |
| | 1954 | vertical photo or vertical picture | |
| | 1956 | cardboard | 1960 spring plate |
| | 1962 | spring leaf | 1964 rabbet |
| | 1970 | spring clamp or toggle clamp | 1972 spring clamp or toggle clamp |
| | 1974 | angle bracket | 1976 toggle plate |
| | 1978 | tension spring | 1980 end hook |
| | 1982 | end hook | 1984 stud |
| | 1986 | stud | 1988 cylindrical rod |
| | 1990 | cylindrical rod | 1992 toggle plate dash outline |
| FIGS. 33A–33B | 1472 | horizontal blank note sheet (or non-calendar sheet) | |
| | 1474 | vertical blank note sheet (or non-calendar sheet) | |
| | 1478 | boundary line | 1480 boundary line |
| | 1482 | dash line | 1484 dash line |
| | 1486 | rectangle dash lines | 1488 rectangle dash lines |
| FIG. 34 | 1910–1992 | See FIGS. 31–32 | |
| | 1994 | second horizontal calendar sheet | |
| | 1995 | second vertical calendar sheet | |
| | 1996 | first non-calendar sheet | 1997 second non-calendar sheet |

DETAILED DESCRIPTION

FIGS. 1–8

FIGS. 1–8 show an preferred embodiment of the 3D picture frame 30 of the present invention for making a variety of 3D framed displays. The 3D picture frame 30 shown in FIGS. 1–6 comprises a frame body 31, a flexible background transparent plate 33, a frame glass assembly 35, a bottom edge magnetic plate 37 and a bottom edge glass 39.

There are several contents shown in FIGS. 1–6 that can be displayed in the 3D picture frame 30. These contents may include background pictures 41 and 43, floating pictures 45, 47, 49 and 51, a bottom edge picture 53 and a 3D art 55.

The frame body 31 can be made by conventional molding process. It is preferably made of metal, porcelain, glass or plastics. This frame body 31 has a curved back wall 57, a left side wall 59, a right side wall 61, and a front wall 63. Formed within these walls is a cavity 65 which has a top opening 67, a front opening 69 and a bottom opening 71. These openings can be thought of as imaginary sheets of space that form the boundary of the cavity 65.

A left horizontal side plate 73 is integrally joined to the back wall 57, front wall 63, and the left side wall 59. A right horizontal side plate 75 is integrally joined to the back wall 57, front wall 63, and the right side wall 61. A left vertical side plate 77 is integrally joined to the left side wall 59, and the left horizontal side plate 73. A right vertical side plate 79 is integrally joined to the right side wall 61 and the right horizontal side plate 75.

Figure 2:
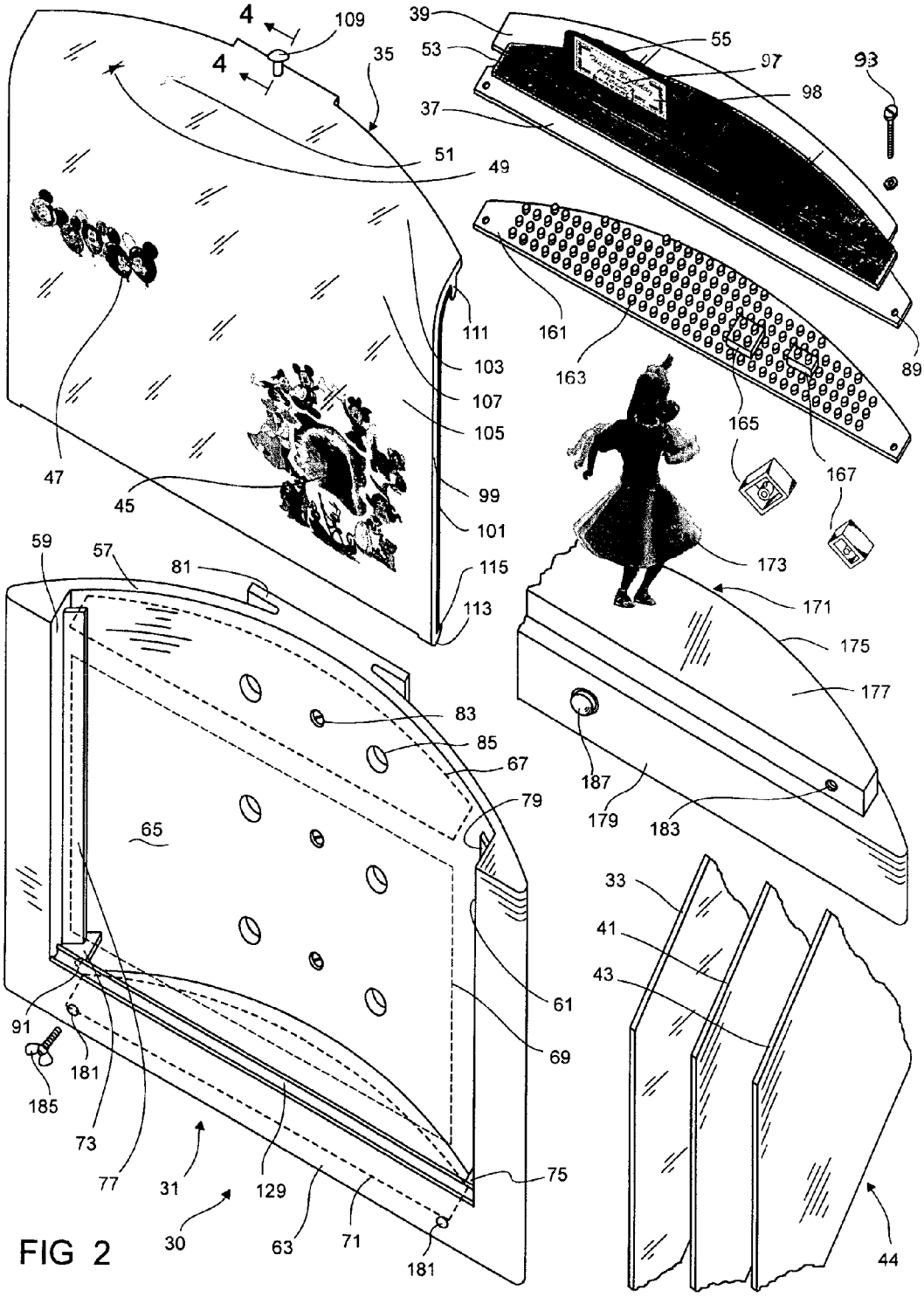
FIG. 2 is a perspective view of a first embodiment of the 3D picture frame of the present invention for making a 3D framed display.
Figure 3:
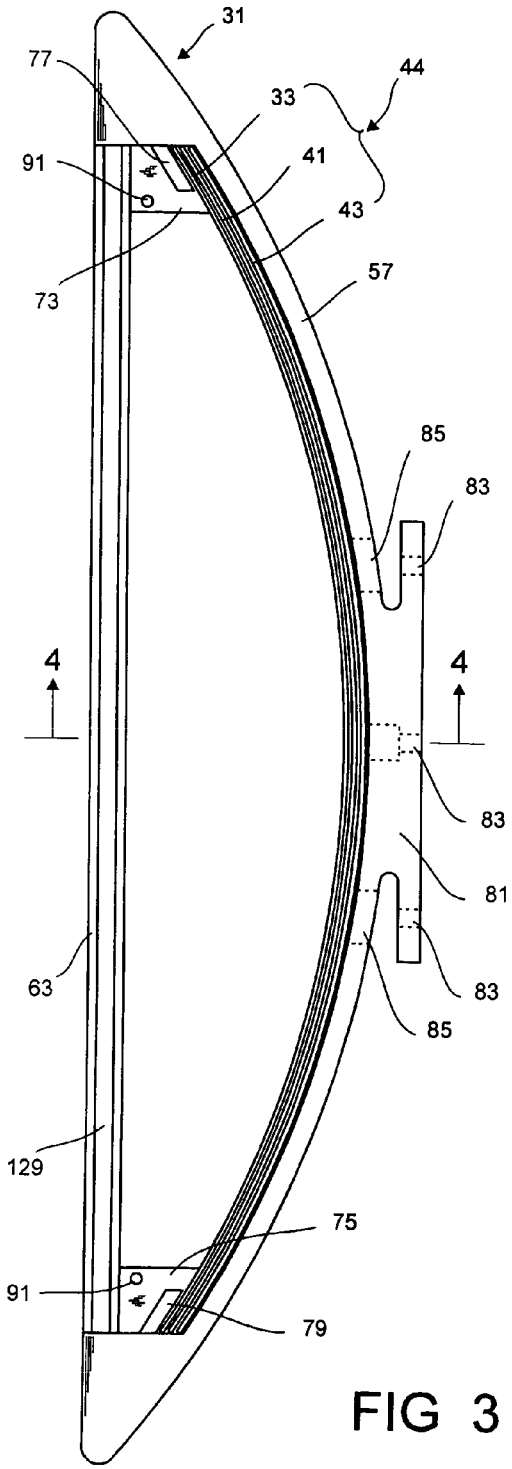
FIG. 3 is an enlarged top view of the frame body 31 shown with the installed background picture assembly 44.
Figure 4:
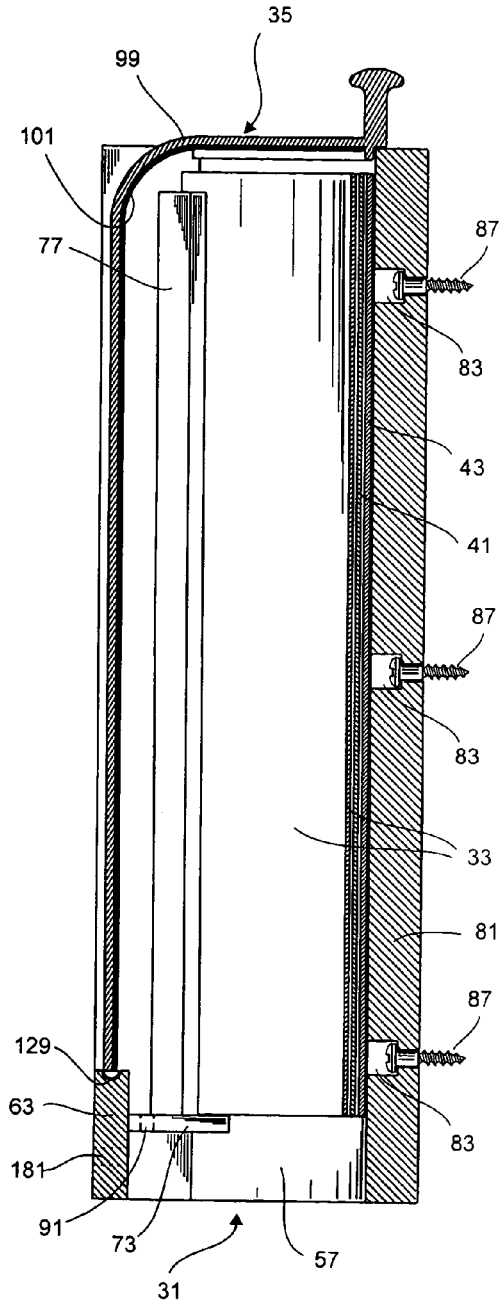
FIG. 4 are sectional views of (1) the frame glass assembly 35 taken substantially on a vertical plane containing the line 4—4 of FIG. 2, and (2) the frame body 31 and the background picture assembly 44 taken substantially on the line 4—4 of FIG. 3.

As seen in FIGS. 2–4 a mounting plate 81 is integrally joined to the back of the curved back wall 57 of the frame body 31. A total of up to nine mounting holes 83 are provided on the mounting plate 81. The three center mounting holes 83 are clear through the back wall 57 and the mounting plate 81 since in this region the back wall 57 and the mounting plate 81 are fused together. For the other six mounting holes 83 in which region the back wall 57 is separated from the mounting plate 81, six clearance holes 85 are required on the back wall 57 for the entry of screws 87.

A total of up to nine screws 87 or fastening devices will be used for securely mounting the frame body 31 to a vertical wall. This is a much more secure mounting of the frame body 31 than the conventional frame mounting in which the frame is merely hung on a wall. This will virtually allow any frame material regardless of its weight or fragileness to be used for the present frame body 31. For smaller frame a minimum of two screws 87 along the center line of the mounting plate 81 or four screws 87 on the four corners of the mounting plate 81 can be used.

The first content to be mounted on the frame body 31 is the background pictures 41 and 43. FIG. 3 shows a cross sectional view of the background pictures 41 and 43 and the flexible background transparent plate 33 as they are mounted on the frame body 31. It is seen here that the width of the background pictures 41 and 43 and the flexible background transparent plate 33 is about the same as the arc length of the curved back wall 57.

To begin the mounting the background pictures 41 and 43 and the flexible background transparent plate 33 are gathered together in a stack as a background picture assembly 44. This assembly is then bent while inserted into the clearance between the vertical side plates 77 and 79 and the curved back wall 57. Once inserted the assembly 44 is pushed down along the clearance until it is stopped at the two horizontal side plates 73 and 75 shown in FIGS. 2–4. As retained between the two vertical side plates 77 and 79 and the flexible background transparent plate 33 and the curved back wall 57, the background pictures 41 and 43 will remain curved with a curvature about the same as the curvature of the back wall 57.

As taught in the U.S. Pat. No. 6,293,038 once a picture sheet is bent into a concavo-convex shape, a 3D effect will be created for the displayed curved picture sheet. This prior art also provides the guidance in designing the curvature of the back wall for achieving the desired 3D effect in the displayed picture.

Once mounted as above described, the flexible background transparent plate 33 serves to flex the background picture 41 to a curvature about the same as that of the back wall 57. But this flexible background transparent plate 33 may not be needed if the background picture 41 is printed on a heavy gauge photographic paper or a paper laminated on a thick cardboard sheet. Because such background picture would be physically strong enough to be properly flexed and maintain its curved shape by itself. Similar example will also be discussed later in connection with FIG. 14.

The background picture 43 is not on display and just stored behind the displayed background picture 41. The clearance between the vertical side plates 77 and 79 and the back wall 57 can be made wide enough so more background pictures can be stored similarly if desired. A flexible card board can be inserted to take up the slack if there is no additional background pictures to be stored. Obviously, all stored background pictures can be displayed at any later time if desired.

The background picture assembly 44 can be removed from the frame body 31 by first pulling back the center top edge of the assembly slightly and then grab the assembly and pull it out of the frame body 31. Clearly, the background picture assembly 44 can be installed in and removed from the frame body 31 without taking down the frame body 31 from the wall.

The next component of the 3D picture frame 30 to be installed in the frame body 31 is the bottom edge magnetic plate 37. This bottom edge magnetic plate 37, as seen in FIG. 2, has three straight sides and one curved side. It can be typically produced from soft steel through conventional stamping or die cutting operation. A layer of coating is desirable to minimize rusting of the steel from long term use.

There are two mounting holes 89 provided on the bottom edge magnetic plate 37. Two matching screw holes 91 are provided on the two horizontal side plates 73 and 75. As is clear from FIGS. 2–4 this bottom edge magnetic plate 37 is to be mounted on the two horizontal side plates 73 and 75 with the use of two sets of screws and nuts 93.

After the installation of the bottom edge magnetic plate 37 the bottom edge picture 53 and the bottom edge glass 39 can now be placed on the bottom edge magnetic plate 37. This will allow the bottom edge picture 53 to be displayed through the bottom edge glass 39.

The bottom edge picture 53 and the bottom edge glass 39 can also be cut out from a large picture sheet and a large glass sheet, respectively, by die cutting process. A low cost hand operated die cutter can be acquired for in house production of such picture sheet. They have the shape similar to the bottom edge magnetic plate 37 but slightly shorter. This will allow the finger to pry up the bottom edge glass 39 and the bottom edge picture 53 when needed for removing the bottom edge picture 53 and the bottom edge glass 39.

It should be pointed out that the bottom edge magnetic plate 37 can be installed on or removed from the frame body 31 without interfering the installed background picture assembly 44. The background picture assembly 44 can also be installed on or removed from the frame body 31 without interfering the installed bottom edge magnetic plate 37. On the other hand, the bottom edge picture 53 and the bottom edge glass 39 are freely sitting on the bottom edge magnetic plate 37 and may occasionally shift its position if no background picture assembly 44 is present. This bottom edge picture 53 and the bottom edge glass 39 need to be pushed back against the front wall 63 before installing the background picture assembly 44.

The concept of the bottom edge picture 53 opens up a totally new dimension in the concept of framed display. User will have total freedom in choosing the bottom edge picture 53 to complement the main background picture 41 on display.

Since the image in the bottom edge picture 53 is perpendicular to the image in the background picture 41, a sense of depth is created which further enhances the 3D feeling in the mind of the viewer.

Most professional cameras generally yield photographs with square or near square formats. It is possible to trim one such photo sheet to produce both the background picture 41 and the bottom edge picture 53. One obvious advantage in this approach is the cost economy and convenience. It is also assured that the obtained bottom edge picture will match the main background picture in color and pattern since they are all obtained from a single picture sheet. One other important advantage is that the scene in the bottom edge picture is often a continuation of the scene in the background picture. It will achieve a wrap-around effect which further strengthens the 3D feeling in the mind of the viewer.

One of the major feature in the present 3D picture frame 30 is the creation of a 3D space or cavity 65 in the shape of an arch. The 3D art 55 can be magnetically held in this 3D space and be displayed. In the present example the 3D art 55 is a miniature porcelain display stand. The inside of this porcelain display stand is hollow and can be imbedded with a small magnet 97. This porcelain display stand 55 can be placed anywhere on the bottom edge glass 39 and be held in place firmly due to the magnetic force between the magnet 97 and the bottom edge magnetic plate 37.

The front surface of this display stand is flat and can be applied with a self adhesive label 98 widely available commercially. This label can be printed with graphics and message desired by the customer. This is an elegant way of displaying a written message to commemorate the event.

Figures 5, 6:
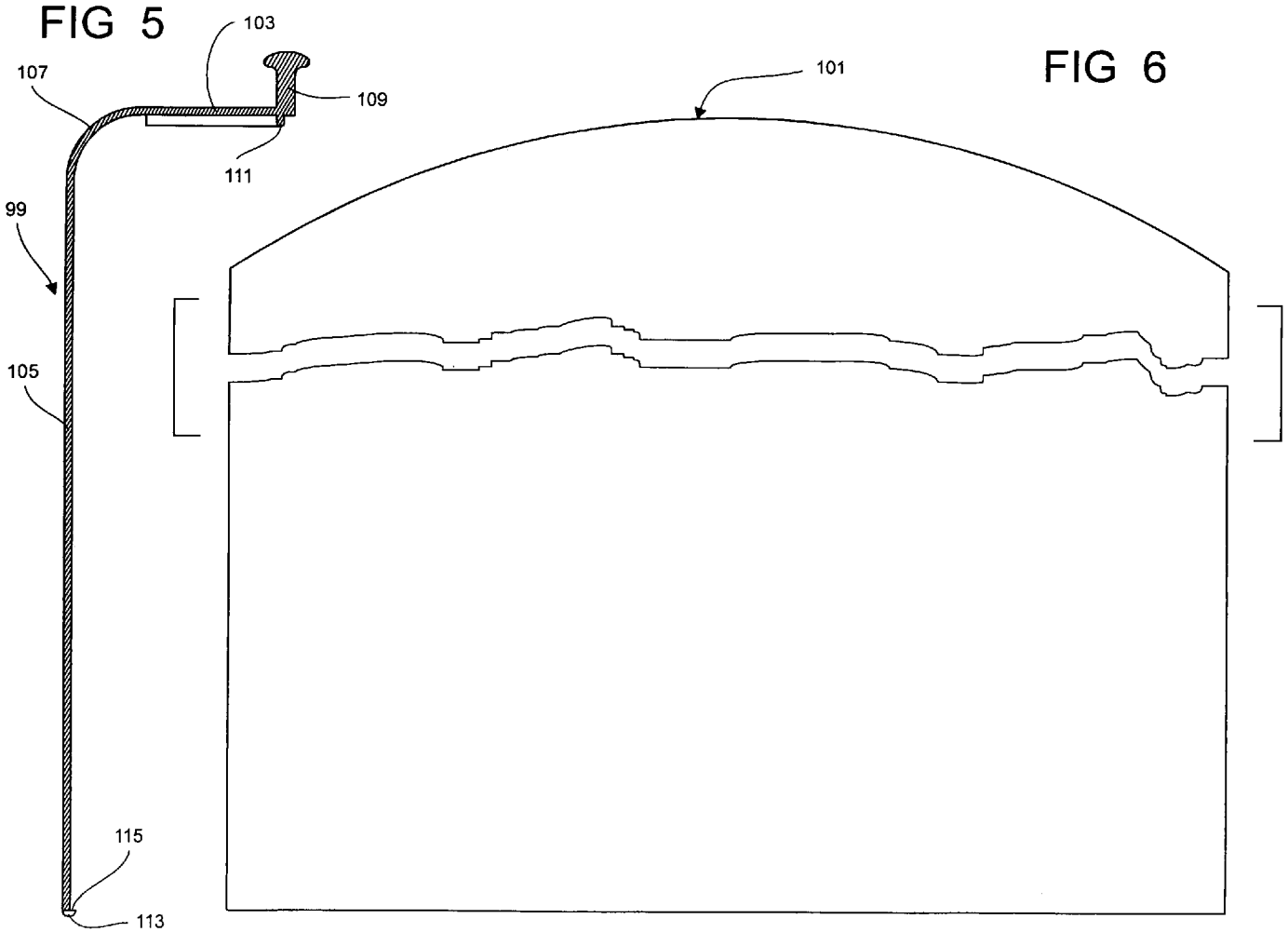
FIG. 5 is the same sectional view of the molded frame glass 99 as shown in FIG. 4.
FIG. 6 is an elevational view of the flexible frame glass 101, partially broken, separated from the molded frame glass 99.

The next component of the present 3D picture frame 30 is the frame glass assembly 35 which may include a molded frame glass 99 and a flexible frame glass 101. FIG. 4 shows a cross sectional view of the frame glass assembly 35 when it is mounted on the frame body 31. FIG. 5 shows the cross sectional view of the molded frame glass 99 by itself, while FIG. 6 shows the elevational view of the flexible frame glass 101 alone by itself.

The molded frame glass 99 is preferably made of transparent and high impact resistant plastic such as polycarbonate. It has a top portion 103, front portion 105 and a curved portion 107. A curved flange 111 is shown projected outward and beneath the top portion 103 of the molded frame glass 99. This curved flange 111 has a curvature matching that of the curved back wall 57 of the frame body 31. A handle knob 109 is shown on the top portion 103.

The front portion 105 is a flat sheet with a uniform thickness. The bottom of the front portion 105 at each corner is molded to form a short horizontal half cylinder 113. The radius of this half cylinder 113 is equal to the thickness of the front portion sheet 105. This results into a flat horizontal plane 115 at right angle to and inside of the front portion sheet 105.

The flexible frame glass 101 is a flat thin plastic sheet such as polycarbonate preferably with a thickness of 0.03" (0.8 mm) or less. As seen in FIG. 6 the top of the flexible frame glass 101 is curved with its curvature matching that of the curved flange 111 of the molded frame glass 99. The width of the flexible frame glass 101 is the same as the width of the molded frame glass 99.

The flexible frame glass 101 can be mounted on the molded frame glass 99 by first placing the curved top portion of the flexible frame glass 101 behind the molded frame glass 99 and against the curved flange 111. With one hand pressing the flexible frame glass 101 against the curved portion 107 of the molded frame glass 99, the other hand pushes the lower part of the flexible frame glass 101 toward the front portion 105 of the molded frame glass 99 until the bottom edge of the flexible frame glass 101 snaps into engagement with the flat horizontal plane 115 of the half cylinder 113. The exact length of the flexible frame glass 101 should be such that when the flexible frame glass 101 is mounted behind the molded frame glass 99 with the top edge of the flexible frame glass 101 engaged with the curved flange 111 of the molded frame glass 99 and the bottom edge of the flexible frame glass 101 engaged with the two flat horizontal planes 115. Also the entire flexible frame glass 101 should closely cling onto the back of the molded frame glass 99 as shown in FIG. 4. The flexing force exerted by the flexible frame glass 101 will maintain it engaged with the molded frame glass 99 indefinitely. The installed flexible frame glass 101 can be removed from the molded frame glass 99 by prying the bottom edge of the flexible frame glass 101 away from the molded frame glass 99.

Obviously, before the molded frame glass 99 and the flexible frame glass 101 are assembled together all floating pictures to be inserted must first be placed between these two glasses 99 and 101. In the present example there are four floating pictures 45, 47, 49, and 51 as shown in FIG. 2 are to be inserted.

The floating picture 45 is shown in FIG. 2 as a girl surrounded by a group of Disney cartoon figures forming a circle. This picture is generally termed as a trimmed composite picture. The composite picture is defined as a picture created by merging two or more images together. The trimmed composite picture is defined as a composite picture trimmed in certain way, usually to remove the unwanted portion of the composite picture sheet. FIG. 7 is a schematic presentation showing a novel way of making the trimmed composite picture 45.

Showing in FIG. 7 are a base picture 117 and a customer picture 119, both of which are picture files stored in a computer. The base picture 117 was created in a computer graphic software such as Corel Draw™ and Photo Paint™ by Corel Corporation, Ontario, Canada. It contains the images of several famous Disney cartoon characters gathered together in a circle 120 and painted on a color background. A portion of the base picture 117 at its center is cut out thus forming a cut out opening 121. In the above graphic software the customer picture 119 and the base picture 117 are treated as two separate graphic layers independent of each other. The cartoon characters circle 120 is treated as a graphic object. In this software program the customer picture 119 is placed behind the base picture 117 and is adjusted in its size and position so that the head portion of the customer picture 119 is shown through the cut out opening 121 of the base picture. A composite picture is created in the program and can be saved in the computer memory.

Before printing this composite picture in a printer, a printer sheet 123 is placed in the printer. This printer sheet 123 has a preexisting perforation line 125. This perforation line 125 was initially made by first drawing a line tracing the outline of a desired object, in the present case, the cartoon characters circle 120 in the base picture 117. A perforation die is then made based on this line. Printer sheets with this perforation line can be mass produced by die cutting using this perforation die.

After printing, the same printer sheet 123 now becomes a composite picture 127 as shown in FIG. 7. The preexisted perforation line 125 should accurately outline the image of the cartoon characters circle 120. A trimmed composite picture 45 is produced by simply removing the unwanted portion of the composite picture 127 outside the perforation line 125.

Clearly, it is important that the position of the perforation line 125 in relation to the printer sheet 123 must be aligned with the position of the cartoon characters circle 120 in relation to the base picture 117. During the software image merging process the size and relative position of the cartoon characters circle 120 must remain unchanged. The printer used must also be calibrated frequently to assure the desired result.

Obviously, the trimmed composite picture can also be made by any conventional trimming process such as using a scissors to manually trim off the unwanted sheet portion. But such a manual trimming process is usually tedious and time consuming. Once a mistake is made in the trimming, the entire photo may have to be discarded.

On the other hand, the trimming process presently proposed can be termed a "self trimming process". This self trimming process allows user to easily obtain a trimmed composite picture by simply tearing off the sheet portion outside the perforation line. The trimmed composite picture so obtained can be termed a "self trimmed composite picture".

The concept of self trimming by itself is not new, which is commonly seen in the making of an address or CD label. The concept of composite picture is not new either, as seen in many tourist photo shops where a customer's face image is imbedded in a movie star's body. What is new is the application of the concept of the self trimming to a composite picture so that a self trimmed composite picture can be produced.

Such self trimmed composite picture is most ideally used in the present 3D framed display by placing it in front of, and spaced apart from, a background picture. This is different from the conventional composite picture which is usually the final product by itself to be displayed in a rectilinear frame. To place such a rectilinear composite picture as is without any trimming would totally ruin the aesthetical atmosphere painstakingly created by the background picture and the 3D picture frame.

When a PC CAM or digital camera is connected to a computer and a software such as FunHouse™ from ArcSoft Inc., Fremont, California, a live image of the customer can be caught directly into a selected base picture or template such as the base picture 117. The computer monitor will show the base picture 117 with the live image of the customer behind the cut out opening 121. Real time adjustment can be made to the studio light, the position and size of the customer, and the camera settings until the customer's image is seamlessly merged with the base picture 117. The finally obtained composite picture can be saved and outputted to the printer loaded with the printer sheet 123.

It is clear from the present disclosure that once the composite picture is created in the computer, it can be printed on a printer sheet with a preexisting perforation line. This allows a self trimmed composite picture to be obtained easily and quickly without the manual trimming process.

In the present composite picture 127 the image of the customer is embedded inside and within the boundary of the image of the cartoon characters circle object 120, or more precisely, the cut out opening 121 in the object 120. This means that the self trimmed composite pictures for different customers are of different content but of the same overall size and shape as long as identical printer sheets with identical perforation lines are used. Such identical printer sheets can be mass produced at low per unit cost.

It is clear from the above discussion that the trimmed composite picture preferred for the present application is a composite picture trimmed along the outline of an object such as the cartoon characters circle 120. The printer sheet with one preexisting perforation line is specific to only one unique object. Base pictures with different objects must require different printer sheets with different preexisting perforation lines.

The floating picture 47 is a mass produced balloon sticker. The floating picture 49 is a star sticker facing upward while the floating picture 51 is a star sticker facing downward. Both star stickers 49 and 51 are placed beneath the top portion 103 of the molded frame glass 99. Depending on the physical location of the 3D picture frame 30 in relation to the eye level of the viewer only one of the two star stickers 49 and 51 is preferred.

Once all floating pictures 45, 47, 49 and 51 are sandwiched between the molded frame glass 99 and the flexible frame glass 101 and assembled as above described, the final frame glass assembly 35 will be a stand alone unit as shown in FIG. 2. This frame glass assembly 35 can now be installed in the frame body 31.

As shown in FIGS. 2–4 the top edge of the front wall 63 has a rounded groove 129. This groove 129 has a shape that will match the rounded bottom of the two half cylinders 113 of the molded frame glass 99. To mount the frame glass assembly 35 on the frame body 31 one simply grab the handle knob 109 and guide the bottom of the frame glass assembly 35 to rest on the groove 129 of the front wall 63. Once properly seated the frame glass assembly 35 is swung forward until the curved end of the top portion 103 is rest on the back wall 57 as shown in FIG. 4. The assembling of the 3D picture frame 30 is now completed.

The completed 3D picture frame with the displayed contents is indeed an interesting one. The center theme of the display is the celebration of a young girl Teresa's birthday as is expressed in the message on the porcelain stand. Teresa's image is surrounded by a ring of Disney characters joining in the celebration. The background picture may show a scene in the Disney Magic Kingdom with a 3D effect as it is mounted in the 3D picture frame. The bottom edge picture shows the garden of the Disney Magic Kingdom in the foreground. Many Disney balloons fill in the air. Stars are shining down from the sky. All these contents displayed in the present beautiful 3D picture frame will provide a memorable 3D framed display.

One advantage of the present 3D picture frame 30 is the fact that the top opening 67 of the frame body 31 is covered by the frame glass assembly 35 which is a clear glass, there will be no shadow ring formed on the displayed background picture 41. However, depending on its curvature, some incoming light passing through the curved portion 107 of the frame glass assembly 35 may not be evenly diffused which still may form a lighter shadow ring on the background picture 41.

It was found that the radius (r) of the outside curvature of the curved portion 107 in relation to the total thickness (d) of the frame glass assembly 35 is critical to the formation of this lighter shadow ring on the displayed background picture 41. It is preferable that the radius-to-thickness ratio (r/d) be 10 or more in order to avoid or minimize the formation of such shadow ring regardless of the direction of the incoming light.

Figure 1:
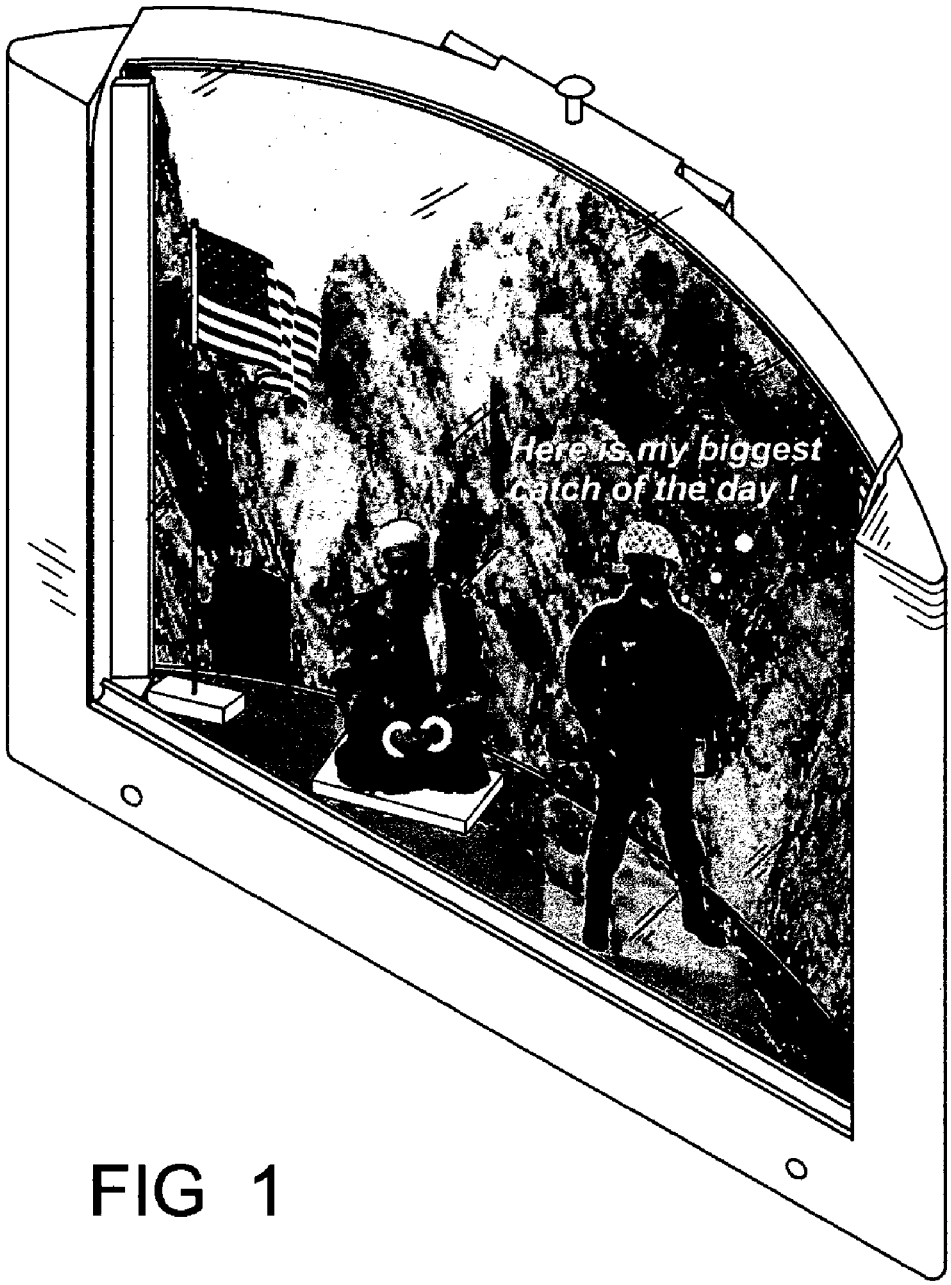
FIG. 1 is a perspective view showing one example of the 3D framed display of the present invention.

FIG. 1 shows one other example of the 3D framed display of the present invention. Shown in the background of this display is a picture of Afghanistan mountain showing an entrance to an underground cave. A 3D effect is added to this picture as it is mounted in the present 3D picture frame. The bottom edge picture is cropped from the same Afghanistan photo and is creating a depth of the field and a wrap-around effect which further strengthen the 3D feeling in the mind of the viewer. A miniature sculpture of the terrorist Osama bin Laden is shown captured, handcuffed, and kneeled on a support plate. A miniature US flag with pole is displayed next to the cave entrance. A trimmed composite picture showing a young soldier proudly showing off his or her biggest catch of the day.

The trimmed composite picture shown in FIG. 1 may require some more explanation. FIG. 8 is a schematic presentation showing the making of this trimmed composite picture.

In FIG. 8 a customer picture 131 is merged with a base picture or template 133 to create a composite picture which is printed on a printer sheet 135. This printer sheet 135 has a preexisting perforation line 137 outlining an object 139 which is an image of a soldier on the base picture 133. Once the printed composite picture 141 is obtained a self trimmed composite picture 143 can be obtained by simply removing the unwanted portion on the composite picture 141 along the perforation line 137.

The above-described procedure in obtaining the self trimmed composite picture 143 is virtually identical to the procedure in obtaining the self trimmed composite picture 45 described above as shown in FIG. 7. The only main difference is that in the case of trimmed composite picture 45 the employed base picture 117 has a cut out opening 121 which is to be imbedded with customers's image including the girl's head and the surrounding area. On the other hand, in the case of the trimmed composite picture 143, the employed base picture 133 only has the object's face portion cut out to obtain a cut out opening 145. This cut out opening 145 is to be imbedded with the customer's facial portion. This is a much more critical procedure which is to be discussed further below.

As seen in FIG. 8, the customer can also choose the base picture 147 for making a self trimmed composite picture 149. This base picture 147 has an image of an object 151 which is an action figure whose face is also similarly removed for creating a cut out opening 153. The corresponding composite picture can also be similarly created in the computer.

As shown in FIG. 8 a printer sheet 155 is to be used for the printing of the composite picture. This printer sheet 155 has a self adhesive top sheet adhered to a lower substrate sheet. On this top sheet is a die cut line 157 outlining the action figure 151. Once a composite picture 159 is printed on the printer sheet 155 the self trimmed composite picture 149 can be obtained by simply lifting it away from the remaining part of the printed composite picture 159 along the die cut line 157. This is indicated by the shoe section 160 of the trimmed composite picture 149 already partially lifted.

The self trimmed composite picture 149 is also to be inserted and held between the molded frame glass 99 and the flexible frame glass 101. Since this trimmed composite picture 149 has adhesive applied to its back side it can be even more securely held in place.

It is interesting to compare the two self trimmed composite pictures 143 and 149. In the trimmed composite picture 149 because of the heavy head protection gear only a portion of the customer's face is revealed. The same image of the action figure 151 can be used for different customers with different facial shape because in such case only the central portion of the customer's face will be revealed.

On the other hand, in the trimmed composite picture 143, in spite of the use of high uniform collar and the heavy helmet a significant portion of the customer's facial outline is still revealed.

In this case one base image of the soldier 139 may not be equally suitable for customers with different facial outline shapes. It would be desirable that several images of the soldier with different facial opening shapes be made available. This would allow the user to choose one particular base image to best fit with each individual customer.

Compared with the trimmed composite picture 45 shown in FIG. 7 and described above, the making of the trimmed composite pictures 143 and 149 may require even more consideration. There is a large difference in size and height between a seven years kid and a fifteen years old kid. It is desirable to have several templates showing the soldier 139 or action FIG. 151 with different size and height in reference to the bin Laden figurine to be placed on its side. This would allow the customer to choose one most suitable template for use. Obviously, more printer sheets with perforations or die cut lines of different sizes and height must also be provided.

In the following discussion two more examples of the 3D framed display of the present invention will also be described. The first example is a 3D framed display for a wedding couple. In this 3D framed display the background picture could be a scene during the wedding ceremony. The trimmed composite picture may show a close up image of the wedding couple surrounded by a flower wreath. A plaque may be displayed recording the affectionate words such as "He: You are my angel; She: You are my castle." used by the couple toward each other during the ceremony.

Perhaps a more meaningful background picture for a wedding 3D framed display is a large group photo including all attending guests surrounding the couple. A large photo of this type will certainly bring in additional income to the professional photographer. But more importantly, the wedding couple will be offered an once in a life time everlasting memorable picture showing the blessing by so many relatives and friends toward the couple in a single event.

One ideal way to achieve the best 3D effect is to take a picture of a large group of people packed together against a structureless background such as wall, lawn, sky, etc. The image of these people, when curved up in the present 3D picture frame, will appear to "float" above the background—an interesting 3D phenomenon.

One other example of the 3D framed display is for senior photography. In this display the background picture could be a graduation ceremony showing the senior receiving a diploma or an artistic photo of the school campus, a campus the senior has spent so many past years with so much memory. A trimmed composite picture will show the senior student surrounded by some artistic graphics. A 3D art will be a plaque bearing the message "Class of 2003, Go Michael!". This same large campus background picture and the bottom edge picture can be sold again and again to every senior of the school year after year.

Funereal activity, an important milestone in a person's life, may also offer many opportunities to studios and professional photographers as illustrated in the following two examples. In the first example, a 3D framed display may be prepared for a man's funereal viewing activity. A background picture is provided by restoring and enlarging an old black and white photo showing one military activity the man engaged in. A trimmed composite picture is also made from a restored photo showing the man in military uniform. A tray is also shown holding the man's memorabilia such as his honorary discharge document in a roll and his old military pocket knife.

One other example may be a 3D framed display for a beloved grandma during her funereal viewing activity. The displayed background picture is a new photo professionally taken and was digitally converted to a soft watercolor picture showing her last residence. A trimmed composite picture is displayed showing one of her recent close-up photos. A tray is also included displaying her knitted dolls and her frequently worn necklaces.

In the above cited wedding and funereal viewing examples the obtained 3D framed displays are very expensive because each background picture needed is made specifically for one customer and usually only one copy can be sold. This background picture is termed a "personal background picture", although expensive, is justified for each special occasion.

On the other hand, in the examples of the Teresa's birthday and young soldier 3D framed displays, each background picture is mass produced because many copies can be sold to many customers. This type of background picture can be termed "professional background picture" because it is usually made by top notch professional photographers or artists. In spite of its high quality it is usually sold at very low price because of its mass production nature.

Although the professional background picture is not personal because is doesn't show image of one particular customer, the final 3D framed display can still be made personal because a floating picture, and more specifically, a self trimmed composite picture bearing the customer's image is displayed in front of, and spaced apart from, the professional background picture. Since this floating picture is a very small picture it can be made inexpensively. This is one important advantage of the 3D framed display of the present invention which often enables a large wall mounted framed display to be obtained not only at low cost, but also with rich contents and personal flavor. The availability of large number of professional background pictures also allows customer many choice to design his 3D framed display.

The present novel 3D picture frame 30 can also be converted to a toy play-and-display station. Shown in FIG. 2 is a toy platform 161 which is similar in size as the bottom edge magnetic plate 37 and can be screw-mounted on the frame body 31 in lieu of the bottom edge magnetic plate 37.

This bottom edge plate 161 is molded to form some unique up-and-down structure such as a plurality of cylinder studs 163 on its top surface. These cylinder studs 163 can be used to engage and hold various type of 3D toys such as commonly available toy building blocks 165 and 167. Many interesting toy structures can be so built and supported on this toy platform 161.

A 3D picture frame 30 can be mounted on a wall at height comfortable for a young child at either sitting or standing position. With the frame glass assembly 35 removed the frame body 31 with the mounted toy platform 161 will become a toy play station. After the play the assembled toy can be readily displayed along with the background picture and the floating pictures.

For a child aspired to become an astronaut a space station toy builder kit can be acquired. It will come with many piece of building blocks and a dedicated toy platform. It may also come with a large earth background picture and several sheets of floating star stickers. It will offer the child many hours of fun time in building the space station model and associated display items. To heighten the interest a trimmed composite picture can also be displayed showing the child in full astronaut gear doing a space walk next to the completed space station.

It should be pointed out that the toy platform can also be used for many non-toy type 3D arts. Instead of relying on magnetic force to hold down these 3D arts, the bottom of these 3D arts can be molded or otherwise made to engage with the stud cylinders on the toy platform. For example, several 3D arts including an old country house covered with snow, a tree with Christmas lighting, and several children playing on a sled, coupled with a beautiful background picture with 3D effect, and a trimmed composite picture carrying the user's image will create a stunning and everlasting 3D framed display.

The 3D picture frame of the present invention can also be converted for mounting and displaying an animated 3D art to add "live" to the 3D framed display. Shown in FIG. 2 is an animated 3D art 171 which in the present example includes a miniature Barbie™ and an insertion box 175. This insertion box will contain all the electric system needed including push button, movement mechanism, wiring, and batteries to activate the Barbie™ to dance and sing one of ten same happy birthday songs but of different languages at the push of a button.

Such an animated Barbie™ is already available commercially by Kash N Gold Ltd., Ronkonkoma, N.Y. In this product the Barbie™ is mounted on a turn table box for housing the needed electric system. A button is provided to activate Barbie™ to dance and sing a Chubby Checker music. It is just an engineering effort to rearrange this electric system to fit it into the insertion box 175 for the present application and reprogram it to sing the happy birthday songs.

The insertion box 175 has a top portion 177 and a bottom portion 179. The top portion 177 has a shape as shown in FIG. 2 and is intended to be inserted through the bottom opening 71 of the frame body 31 and for the Barbie™ to be displayed in the cavity 65 of the frame body 31. Two mounting holes 181 are provided on the frame body 31 near the bottom of the front wall 63. Two corresponding screw holes 183 are located on the top portion 177. Two wing head bolts 185 can be employed for firmly mounting the insertion box 175 on the frame body 31.

The bottom portion 179 of the insertion box 175 is external and appears as an extension of the frame body 31. A push button 187 is shown in the middle of the bottom portion 179. The size of the bottom portion 179 is designed to house the needed electric system for the animated 3D art 171.

Obviously, before inserting the animated 3D art 171 into the frame body 31, any bottom edge magnetic plate 37 or toy platform 161 and their supported contents must all be removed from the frame body 31. But smaller 3D art such as the porcelain display stand 55 can still be placed on the installed insertion box 175 and even be held magnetically if the surface of the insertion box 175 is made of magnetic material.

It is clear from the above disclosure that it is just a simple matter of mounting the animated 3D art 171 on the frame body 31 using two screws or bolts for displaying it in the present 3D picture frame 30. Replacing the installed animated 3D art 171 by other animated 3D art or bottom edge magnetic plate 37 can also be easily achieved without taking down the frame body 31 from the wall.

It should be pointed out that the animated 3D art 171 is not just limited to a 3D art that can move in certain way. It should be broaden to include any 3D art that can be actuated to perform an action by certain internal signal such as a timer or external signal such as sound, heat from a viewer. One example is a miniature lamp which will automatically turn on its light upon sensing an approaching viewer.

It is interesting when the concept of toy play-and-display station is combined with the concept of the animated 3D arts with insertion box. One possible outcome is a "display-while-play" station. The display of a great and relevant background picture with 3D effect will certainly enhance the game atmosphere during the play. Since the toys to be played is remote controlled, the frame glass assembly can be either installed or removed during the play. The top surface of the insertion box can be made unique for the toys to be played. The insertion box may also house a game controller or keyboard which can be pulled out for the play. One example of the display-while-play station may include two miniature race tracks supporting two competing racing cars controlled by two game controllers. The possibility is just unlimited.

The addition of a 3D picture frame to a 3D toy or game will make it more organized and manageable. Each toy or game will be played and displayed in its own space. Very little pre-play setup or after-play clean up will be needed. Several toys and/or games each with its own frame will turn a room corner into a small toy or game arcade.

FIGS. 9–11

FIGS. 9–11 show a second preferred embodiment of the 3D picture frame 230 of the present invention for making a variety of 3D framed display. The 3D picture frame 230 shown in FIGS. 9–11 comprises a frame body 231 and a frame glass assembly 235. It may also comprise the flexible background transparent plate 33, the bottom edge magnetic plate 37, the bottom edge glass 39, and the toy platform 161, all of which have been described previously as shown in FIGS. 1–6.

All contents displayable in the 3D picture frame 30 can also be displayed in the present 3D picture frame 230. These contents may include the background pictures 41 and 43, the floating pictures 45, 47, 49 and 51, the bottom edge picture 53, the 3D art 55 and the animated 3D art 171, all of which have been described previously as shown in FIGS. 1–8.

The frame body 231 can be made by conventional molding process. It is preferably made of metal, porcelain, glass or plastics. This frame body 231 has a curved back wall 257, a left side wall 259, a right side wall 261, and a front wall 263. Formed within these walls is a cavity 265 which has a top opening, a front opening and a bottom opening.

A left horizontal side plate 273 is integrally joined to the back wall 257, front wall 263, and the left side wall 259. A right horizontal side plate 275 is integrally joined to the back wall 257, front wall 263, and the right side wall 261. A left vertical side plate 277 is integrally joined to the left side wall 259, and the left horizontal side plate 273. A right vertical side plate 279 is integrally joined to the right side wall 261 and the right horizontal side plate 275.

As seen in FIGS. 9–11 a mounting plate 281 is integrally joined to the back of the curved back wall 257 of the frame body 231. A total of up to nine mounting holes 283 are provided on the mounting plate 281. The three center mounting holes 283 are clear through the back wall 257 and the mounting plate 281 since in this region the back wall 257 and the mounting plate 281 are fused together. For the other six mounting holes 283 in which region the back wall 257 is separated from the mounting plate 281, six clearance holes 285 are required on the back wall 257 for the entry of screws 287.

A total of up to nine screws 287 or fastening devices will be used for securely mounting the frame body 231 to a vertical wall. This is a much more secure mounting of the frame body 231 than the conventional frame mounting in which the frame is merely hung on a wall. This will virtually allow any frame material regardless of its weight or fragileness to be used for the present frame body 231. For a smaller frame a minimum of two screws 287 along the center line of the mounting plate 281 or four screws 287 on the four corners of the mounting plate 281 can be used.

The background picture assembly 44 can be mounted in the frame body 231 in virtually the same manner as its mounting in the frame body 31. As taught in the U.S. Pat. No. 6,293,038, once the background picture 41 is bent into a concavo-convex curved shape as that of the curved back wall 257, a 3D effect will be created for the background picture 41 in display. Again, the background picture assembly 44 can be installed in or removed from the frame body 231 without taking down the frame body 231 from the wall.

The bottom edge magnetic plate 37, the bottom edge picture 53 and the bottom edge glass 39 can all be installed in the frame body 231 in the same manner as they are installed in the frame body 31. The presence of the bottom edge picture 53 will complement the displayed background picture 41. It will achieve a depth of the field and wrap-around effect, both of which will strengthen the 3D feeling in the mind of viewer.

The cavity 265 within the frame body 231 will house one or more 3D arts which will further enhance the overall 3D effect in the framed display. The miniature display stand 55 is again held magnetically on the bottom edge glass 39. A label 98 can be elegantly applied for displaying a written message to commemorate the event.

As shown in FIG. 9 the frame glass assembly 235 comprises two identical flexible frame glasses 293. These flexible frame glasses 293 are preferably made of thin transparent plastic sheet with high impact resistance such as polycarbonate. They will stay flat when not mounted on the frame body 231. A mounting hole 295 is provided on each flexible frame glass 293. A set of handle knob screw and nut 297 will bind these two flexible frame glass 293 together through these mounting holes 295.

Just as the frame glass assembly 35, the frame glass assembly 235 serves the function of holding the floating pictures 45, 47, 49 and 51. These floating pictures are inserted between these two flexible frame glasses 293 by first lifting the top flexible frame glass. Once all floating pictures are properly placed on the bottom flexible frame glass 293 the top flexible frame glass 293 is then lowered and aligned with the lower flexible frame glass 293.

As shown in FIGS. 9–11 a groove 299 is provided on the top edge of the front wall 263. A frame rabbet 301 is integrally formed on each of the frame side walls 259 and 261. These frame rabbets 301 have the same thickness and on a same vertical plane as the outside wall of the groove 299.

Also shown in FIGS. 9–11 is a curved top lip 303 integrally formed on top of the curved back wall 257. A curved slot 305 is created between the curved top lip 303 and a portion of the top edge surface of the curved back wall 257. The remaining portion 307 of the top edge surface is not covered under the curved top lip 303 and therefore is exposed.

The inside edge of the curved slot 305 is shown in FIG. 10 as a dash line 309. This inside edge 309 has a curvature radius same as that of the curved back wall 257. However, the frontal edge of the curved top lip 303 has a curvature radius slightly larger than that of the curved back wall 257. As a result, as shown in FIG. 10, the width of the exposed top edge surface 307 in the middle section is slightly narrower than the width at the two ends of the exposed top edge surface 307.

As seen in FIG. 9, the frame glass assembly 235 has three straight sides and one curved side. The width of the frame glass assembly 235 is slightly narrower than the distance between the left side wall 259 and the right side wall 261. The curved side of the frame glass assembly 235 has a curvature radius same as that of the curved back wall 257.

The assembled frame glass assembly 235 loaded with all floating pictures is now ready to be installed in the frame body 231. With one hand holding the handle knob-297 and the other hand holding the middle bottom edge of the frame glass assembly 235, the frame glass assembly 235 is inserted into the frame body 231 and slowly down along and behind the two frame rabbets 301 until the bottom edge of the frame glass assembly 235 is inserted into the groove 299 of the front wall 263.

At this time the hand holding the handle knob 297 will start to bend the frame glass assembly 235 down until the curved side of the frame glass assembly 235 is touching the curved top lip 303. The handle knob 297 is next pulled slightly back and down to further deform the elbow section or curved portion of the frame glass assembly 235 until the curved side is resting on the exposed top edge surface 307 of the curved back wall 257.

As guided by the hand holding the handle knob 297, the middle section of the curved side of the frame glass assembly 235 can now be first allowed to enter the curved slot 305. The flexing force within the flexible frame glasses 293 as well as a slight hand push will advance the frame glass assembly 235 until the entire curved side of the frame glass assembly 235 enters the curved slot 305 and seats against the inside edge 309 of the curved slot 305. The installation of the frame glass assembly 235 on the frame body 231 is now completed. It will cover the front opening and the top opening of the frame body 231 as it is mounted on the frame body 231.

With the present design of the curved top lip 303, the width of the exposed top edge surface 307 at the center is slightly narrower than the width at two ends of the exposed top edge surface 307. This means that the middle section of the curved side of the frame glass assembly 235 will always enter the curved slot 305 first. The curved top slot 303 will gradually bend down the rest of the curved side of the frame glass assembly 235 as it further advances into the curved slot 305.

With the frame glass assembly 235 installed in the frame body 231, the bottom edge of the frame glass assembly 235 is seated inside the groove 299 of the front wall 263. The two vertical sides of the frame glass assembly 235 is held between the left side wall 259 and the right side wall 261 and guided by the two frame rabbets 301. The length of the flexible frame glasses 293 is such that when they are mounted on the frame body 231 the entire curved side of the frame glass assembly 235 will fully seat inside the curved slot 305 and against the inside edge 309 of the curved slot 305. In the mean time the elbow section or the curved portion of the frame glass assembly 235 will maintain a curvature radius-to-thickness (r/d) of 10 or more. As discussed above this ratio is desired to avoid or eliminate the formation of light shadow ring on the displayed background picture.

Also shown in FIG. 9 is the toy platform 161. The installation of this toy platform 161 on the frame body 231 is essentially the same as in the case of frame 31. With this installation the present 3D picture frame will turn into a toy play-and-display station.

For the sake of completeness the animated 3D art 171 above described is also included in FIG. 9. This or any other animated 3D arts of similar insertion box design can all be installed in the present 3D picture frame 230 to add "live" to the 3D framed display. Change of the displayed 3D arts in this frame body 231 can be easily achieved without taking down the frame body 231 from the wall.

There are several advantages in the present 3D picture frame 230. The frame glass assembly 235 comprises two identical flexible frame glasses 293 which can be made by simple die cutting process. The thickness of each flexible frame glass is only about 0.03" (0.8 mm) or less which will achieve excellent light transmission efficiency.

For purpose of illustration several trademark figures are included in the present drawings. FIGS. 2 and 9 show items 47 and 120 containing trademark figures by Disney™, and item 173 containing trademark figure by Barbie™.

FIGS. 12–13

FIGS. 12–13 show a third embodiment of the 3D picture frame of the present invention and a 3D framed display produced with this 3D picture frame. This 3D picture frame is an improvement over the prior art frame disclosed in the U.S. Pat. No. 6,293,038. Although this 3D picture frame lacks some features provided by the 3D picture frames 30 and 230 shown in FIGS. 1–11, it is still capable of making most of the 3D framed displays of the present invention.

The 3D picture frame 2000 shown in FIG. 12 comprises a frame body 2002, a first flat transparent plate 2004, a second flat transparent plate 2006, a curved transparent plate 2008, a curved baking plate 2010, a top edge transparent plate 2012, a bottom edge transparent plate 2014, a magnetic plate 2016, and a backboard 2018.

The 3D framed display shown in FIGS. 12–13 comprises the 3D picture frame 2000 and several contents to be displayed in the 3D picture frame 2000. These contents are a floating picture 2020, a background picture 2022, a top edge picture 2024, a bottom edge picture 2026, a first 3D art 2028 and a second 3D art 2030.

The frame body 2002 is typically formed by four frame moldings. A rabbet 2032 of the frame body 2002 is shown which defines a frame window 2034 through which all contents of the present framed display are displayed. A peripheral member 2036 is seen on the back side of the frame body 2002 on which a plurality of turn buttons 2038 are mounted for removably holding the backboard 2018.

There are two unique features in the frame body 2002. The first feature is that the depth of the frame body 2002, herein termed depth of the rabbet, is very deep compared with most conventional frame body. This is required in order to accommodate the 3D framed display of the present invention. The second unique feature is the use of one or more straps 2040 which will be further described below.

The first flat transparent plate 2004 and the second flat transparent plate 2006 are two identical rectangular plates. The curved transparent plate 2008 has a width and height same as that of the first flat transparent plate 2004 but is curved. The curved backing plate 2010 has a size and shape same as that of the curved transparent plate 2008. Both these two plates 2008 and 2010 can be made of plastics or glasses through conventional molding or plastic thermal curving process.

As seen in FIGS. 12 the curved transparent plate 2008 has a curvature in the shape of an arc. This curvature is termed "one dimensional concavo-convex" or "concavo-convex" for simplicity. The term "one dimensional" is derived from the fact that only the plate's cross section perpendicular to the vertical axis will produce a curvature. This is in sharp contrast with the conventional "three dimensional concavo-convex" characterized by a curvature of such as an egg shell in which the cross section perpendicular to any one of the X, Y, and Z axes will produce a curvature.

The top edge transparent plate 2012 and the bottom edge transparent plate 2014 are two identical rectangular plates. They have a width and depth same as the width and depth of the inside bottom frame wall of the frame body 2002, respectively, not counting the peripheral member 2036.

The magnetic plate 2016 has a width and depth same as that of the bottom edge transparent plate 2014. It can be made of iron or steel and preferably laminated to minimize rusting and to ease the handling.

For the sake of clarity, in the following section a description of the assembling of the 3D picture frame 2000 alone will be provided. This is started by placing the bottom edge transparent plate 2014 and the magnetic plate 2016 in the frame body 2002 resting on the bottom inside frame wall of the frame body 2002. The two flat transparent plates 2004 and 2006, the curved transparent plate 2008, and the curved backing plate 2010 are then placed in the frame body 2002 in the order as above stated. The top edge transparent plate 2012 is finally inserted into the clearance just beneath the top inside frame wall of the frame body 2002. In this position the top edge transparent plate 2012 is simply resting on the plates 2004, 2006, 2008, and 2010.

The strap 2040 shown in FIG. 12 may include a pair of ribbons. Each ribbon may include a elastic ribbon portion and a Velcro ribbon portion sewed together. The free end of the elastic ribbon portion of each ribbon will be the anchoring end. Each anchoring end will be anchored on the inside frame wall at a position as close as possible to the edge of the curved backing plate 2010 along its straight side. Two free ends of the two Velcro ribbon portions will be pulled toward each other and locked together. The length of the two elastic ribbon portions are such that once the two Velcro ribbon portion are locked together the two elastic portions are stretched and will tightly wrap around the curved backing plate 2010 from edge to edge to securely fasten the stack to the frame body 2002.

Obviously, with the present teaching many other types of straps can also be adopted. This may include a conventional two-ring buckle that allows a ribbon to be locked between the two rings. Snap-on buckle is also an acceptable choice.

The unique advantage in the use of strap 2040 as opposed to any conventional turn buttons or stops for the present 3D picture frame is that the soft ribbon in the strap will tightly wrap around the entire width of the curved backing plate from one straight side edge to the other. This will prevent the entire stack from popping loose or out of position during shipping or heavy handling.

One other advantage in the use of one or preferably two straps 2040 is that instead of the permanently curved transparent plate 2008 and the permanently curved backing plate 2010 some normally flat but flexible transparent plate and backing plate can also be used in the present application. Once flexed and placed in the frame body 2002, they can be securely held by these straps 2040.

After the straps 2040 are properly secured the backboard 2018 can then be installed in the frame body 2002 and held in place by the turn buttons 2038. It should be pointed out that this backboard 2038 merely serves as a back cover and is not in contact with the straps 2040 or the curved backing plate 2010. Such gap is desirable in case the presently used curved transparent plate and curved backing plate are to be replaced by some other plates with deeper curvature.

The assembling of the 3D picture frame 2000 by itself is now completed. The description so far is provided only for the sake of explanation of the assembling of the 3D picture frame 2000. Obviously, during the actual assembling procedure numerous contents to be displayed in this 3D picture frame must also be added at various stages.

The first content to be displayed in the present 3D picture frame 2000 is the floating picture 2020 which is to be inserted and held between the first flat transparent plate 2004 and the second flat transparent plate 2006. This floating picture 2020 is preferably trimmed to show the subject to be displayed and to remove any unneeded portion in order for all other contents placed behind the floating picture 2020 to be visible through the transparent plates 2004 and 2006.

In order to maximize the value of the framed display in the mind of customer it is preferred that the image of the customer, mainly the face of the customer, to be brought into the floating picture 2020. This floating picture 2020 can be a self trimmed composite picture 2020 similar to the self trimmed composite picture 143 as shown in FIG. 8 and described above.

The placement of the floating picture 2020, and more specifically the self trimmed composite picture 2020, in front of, and spaced apart from the background picture, adds a new important element to the 3D framed display of the present invention. It further enhances the 3D presentation. Since the self trimmed composite picture will carry an image of the customer, it now becomes the center of attention of the 3D framed display. In many occasions the background pictures can be professionally made with high quality but low per unit cost because it can be mass produced and sold to many customers. The availability of large number of professional background pictures will allow customer more choice in selecting 3D framed display to be created.

The background picture 2022 shown in FIG. 12 is a flexible and normally flat picture sheet. It is to be mounted between the curved transparent plate 2008 and the curved backing plate 2010. Once the 3D picture frame is fully assembled the force exerted by the strap 2040 will be transmitted to the curved backing plate 2010 which in turn will bend the background picture 2022 to a curvature same as that of the curved transparent plate 2008. The resulted one dimensional concavo-convex shape will impart a 3D effect to the displayed background picture 2022.

Furthermore, the floating picture 2020 is positioned in front of and spaced apart from the background picture 2022. When these two pictures are viewed together the achieved 3D effect is even more pronounced.

In FIG. 12 the background picture 2022 is to be sandwiched between the curved transparent plate 2008 and the curved backing plate 2010 to be bent into the desired curved shape. If the background picture 2022 is printed on a heavy gauge photographic paper it is possible to bend this photographic paper to the curvature same as that of the curved transparent plate 2008 by using just two sets of the straps 2040 without the curved backing plate 2010. On the other hand, it is also possible to mount this photographic paper directly on the curved backing plate 2010 with means such as double sided adhesive tape or mounting corners and conform its shape to that of the curved backing plate 2010 without the need of the curved transparent plate 2008.

The top edge picture 2024 and the bottom edge picture 2026 are of the same size as that of the bottom edge transparent plate 2014. They are mounted behind the top edge transparent plate 2012 and the bottom transparent plate 2014, respectively. They are positioned at right angle with respect to the background picture 2022.

The concept of the edge pictures opens up a totally new dimension in the concept of picture frame. Users will have total freedom in choosing the two edge pictures to complement the main background picture 2022 and to further enhance the 3D effect of the overall display. It is also possible to include text message on the bottom edge picture 2026 to commemorate the event associated with the framed display.

Many professional cameras yield photographs with square or near square format. It is possible to trim a top portion and a bottom portion of one such photograph to make the top edge picture and the bottom edge picture, respectively, while leaving the middle section as the main background picture in a 3D picture frame of rectangular shape.

There are several advantages in the use of one single picture to satisfy the need of both the main background picture and two edge pictures in the 3D framed display of the present invention. The first one is the cost economy and convenience. But more importantly, it will be assured that the obtained edge sheets will more likely match the main background picture in color and pattern since they are all obtained from a single picture sheet.

There is one other unique advantage associated with the single sheet concept in the 3D framed display of the present invention. Once mounted on the 3D picture frame 2000 the scene shown on the two edge pictures is literally a continuation of the scene shown in the center main background picture. The displayed floating picture will appear to be surrounded by one continuous scene to the top, bottom, left, right of and behind the floating picture. It achieves a wrap-around effect which further strengthens the 3D feeling in the mind of the viewer.

As clearly seen in FIG. 12 the assembled 3D picture frame 2000 also creates an arch-shaped void space between the second flat transparent plate 2006 and the curved transparent plate 2008. This created void space can house and display one or more 3D arts if desired.

Also included in FIG. 12 are two 3D arts 2028 and 2030. The 3D art 2028 is a miniature sculpture of the terrorist Osama bin Laden, captured, handcuffed and kneeled on a support plate. Adhered to the bottom of the support plate is a magnet 2060. This 3D art 2028 can be placed on the bottom edge transparent plate 2014 within the arch-shaped void space. It is securely held by the magnetic force between the magnet 2060 and the magnetic plate 2016. The 3D art 2030 is a miniature US flag with pole and can be similarly mounted and secured inside the same arch-shaped void space.

FIG. 13 shows an actual completed 3D framed display of the present invention. All visible components including the 3D picture frame 2000, self trimmed composite picture 2020, first 3D art 2028, and second 3D art 2030 have been shown in FIG. 12 and described above. The curved background picture 2022 is a picture of Afghanistan mountain showing an entrance to an underground cave. A top edge picture 2024 and a bottom edge picture 2026 are also displayed but not visible in FIG. 13. The self trimmed composite picture shows a young soldier proudly showing off his or her biggest catch of the day. A text message "Afghanistan 2003" is also engraved on the bottom edge picture 2026 to commemorate this "historic" event.

FIG. 14

FIG. 14 shows a fourth embodiment of the 3D picture frame of the present invention and a 3D framed display produced with this 3D picture frame. The 3D picture frame 2100 shown in FIG. 14 comprises a frame body 2102, a first flat transparent plate 2104, second flat transparent plate 2106, a magnetic plate 2108 and two edge holders 2110 and 2112.

The 3D framed display shown in FIG. 14 comprises the 3D picture frame 2100 and several contents to be displayed in the 3D picture frame 2100. These contents are a floating picture 2120, a background picture 2122, a top edge picture 2124, a bottom edge picture 2126, and one or more 3D arts 2128. The floating picture 2120 is not shown, but can be the floating picture 2020 shown in FIG. 12. The 3D art 2128 is not shown, but can be the 3D arts 2028, 2030 shown in FIG. 12.

The frame body 2102 is similar to the frame body 2002 shown in FIG. 12. It includes a frame rabbet 2132, a frame window 2134, a hanger 2144, and one or more straps 2140. This strap 2140 is similar to the strap 2024 shown in FIG. 12, but is anchored to the frame inside wall at a position somewhat further away from the rabbet 2132 as is clear from the discussion later.

The first flat transparent plate 2104, the second flat transparent 2106 and the magnetic plate 2108 are virtually identical to the first flat transparent plate 2004, the second flat transparent plate 2006 and the magnetic plate 2016, respectively, shown in FIG. 12.

The background picture 2122, the top edge picture 2124 and the bottom edge picture 2126 are of the same size as that of the background picture 2022, the top edge picture 2024 and the bottom edge picture 2026, respectively, shown in FIG. 12, except for their thickness. The picture sheets 2122, 2124 and 2126 are made of thick cardboard stock laminated with a thin layer of photo quality sheet on which the picture image is printed. The top edge picture 2124 and bottom edge picture 2126 are rigid enough to maintain its shape without the need of any support of any glass sheets such as the edge transparent plates 2012 and 2014 shown in FIG. 12. The background picture 2122 is also firm but flexible so that once it is bent it will maintain its curved shape as will be further described later.

The edge holder 2110 is made of extruded plastic column with its length same as that of the background picture 2122. It has a cross section 2114 largely as shown in FIG. 14. A tapered slot 2116 runs down the entire length of the edge holder 2110. The width of the tapered slot at its closed end is approximately the same as the thickness of the background picture 2122. The front side of the edge holder 2110 is shown facing the frame rabbet 2132. The edge holder 2112 is a duplicate of the edge holder 2110 but is positioned upside down while maintaining the same front side facing the frame rabbet 2132.

The assembling of the 3D picture frame 2100 is started by positioning the frame body 2102 vertically on a table. The bottom edge picture 2126 and the magnetic plate 2108 are first placed in the frame body 2102 resting on the bottom inside frame wall of the frame body 2102. The two flat transparent plates 2104 and 2106, along with the sandwiched floating picture 2120, are next placed inside the frame body 2102 against the frame rabbet 2132. The 3D arts 2128 are now placed in the frame body 2102 and magnetically held in position.

The two edge holders 2110 and 2112 are next placed in the frame body 2102 in the orientation as shown in FIG. 14. The front sides of both edge holders 2110 and 2112 are in contact with the second flat transparent plate 2106. These two edge holders are positioned spaced apart and each in contact with one of the two opposing vertical inside frame wall. Make sure both edge holders are clear from the strap 2140 and its anchors on the frame wall.

The background picture 2122 can now be manually bent to form a curved shape and inserted into the two tapered slots 2116 of the two edge holders 2110 and 2112. The one or preferably two straps 2140 are then applied to hold down the background picture 2122. Due to the tapered structure of the two slots 2116, only the closed ends of the slots 2116 are in contact with the background picture 2122. This will help maintain the background picture 2122 at its ideal curved position.

The top edge picture 2124 is next inserted into the clearance just beneath the top inside frame wall of the frame body 2102 and be supported by the plates 2104, 2106 and 2122. The four turn buttons 2142 can now be rotated to its closed position for retaining the two edge pictures 2124 and 2126 and the magnetic plate 2108. The assembling of the 3D picture frame 2100 is now completed. It can be hung on a wall using its hanger 2144.

Compared with the 3D picture frame 2000 in FIG. 12, the 3D picture frame 2100 shown in FIG. 14 is somewhat simpler in construction. The elimination of the curved transparent and backing plates will reduce its cost significantly. Because of the use of the edge holders the background picture will be more securely held in the frame body. The flat transparent plates and the sandwiched floating picture can also be held more securely due to the larger contact area between the second flat transparent plate and the edge holders. However, in spite of the above advantages it is not clear how well this 3D picture frame 2100 can be accepted because many commercially available studio printers are not capable of printing on cardboard sheets. One bright area of future application is the mass production of cardboard picture made in large commercial printing house.

FIG. 15

FIG. 15 shows a fifth embodiment of the 3D picture frame of the present invention and a 3D framed display produced with this 3D picture frame. The 3D picture frame 2200 shown in FIG. 15 is identical to the 3D picture frame 2000 shown in FIG. 12 except that a new pair of edge holders 2210 and 2212 are included and the anchoring position of the strap 2040 has been moved to accommodate these two edge holders.

The 3D framed display shown in FIG. 15 comprises the 3D picture frame 2200 and several contents to be displayed in the 3D picture frame 2200. These contents are the floating picture 2020, the top edge picture 2024, the bottom edge picture 2026, 3D arts 2028 and 2030, and the background picture 2022. All these contents have been shown in FIG. 12 and described previously.

The major improvement in the 3D picture frame 2200 over the 3D picture frame 2000 is the addition of the two edge holders 2210 and 2212. These two edge holders are very similar to the edge holders 2110 and 2112 shown in FIG. 14 and described previously.

The curved transparent plate 2008 and the backing plate 2010 are permanently curved. The two plates are shown held together by the two edge holders 2210 and 2212. The background picture 2022 is sandwiched between the curved transparent plate 2008 and the curved backing plate 2010 and bent to a curvature same as that of the curved transparent plate 2008. The resulted one-dimensional concave-convex shape will impart a 3D effect to the displayed background picture 2022.

The assembled background picture 2022 and the plates 2008 and 2010 along with the edge holders 2210 and 2212 can be directly placed inside the frame body 2002 as one unit during the 3D picture frame 2200 assembling process. This is done after the bottom edge transparent plate 2014, bottom edge picture 2026, magnetic plate 2016, flat transparent plates 2004 and 2006 and the sandwiched floating picture 2020, 3D arts 2028 and 2030, in that order, have already been installed in the frame body 2002. Make sure the edge holders 2210 and 2212 are firmly in contact with the second flat transparent plate 2006 and two opposing inside frame walls and clear from the anchor of the strap 2040.

The one or preferably two straps 2040 can next be applied to hold down the curved backing plate 2010. The top edge picture 2024 and the top edge transparent plate 2012 are then inserted into the clearance just beneath the top inside frame wall of the frame body 2002. After this the backboard 2018 is next installed in the frame body 2002 and held in place by the turn buttons 2038. The assembling of the 3D picture frame 2200 is now completed.

With the use of the straps 2040 it is possible to employ the transparent plate 2008 and backing plate 2010 which are flat and flexible but can be flexed and curved when they are mounted in the frame body 2002. The background picture 2022 will also be properly curved as it is sandwiched between the transparent plate 2008 and the backing plate 2010.

Presently, most commercially available photographic papers are of heavy gauge. With such papers used in the background picture 2022, it is possible to eliminate the curved transparent plate 2010 or the curved backing plate 2010 or even both and still be able to maintain the background picture 2022 in the desired curved shape with the use of the two straps 2040. Obviously, in this case the width of the tapered slots of the edge holders must be reduced accordingly.

FIG. 16

FIG. 16 shows a sixth embodiment of the 3D picture frame of the present invention and a 3D framed display produced with this 3D picture frame. The 3D picture frame 2300 shown in FIG. 16 is identical to the 3D picture frame 2000 shown in FIG. 12 except that the curved transparent plate 2008 is now replaced by a three-panel transparent plate 2310; and the curved backing plate 2010 and the strap 2040 are now eliminated.

The 3D framed display shown in FIG. 16 comprises the 3D picture frame 2300 and several contents to be displayed in the 3D picture frame 2300. These contents are the floating picture 2020, the top edge picture 2024, the bottom edge picture 2026, 3D arts 2028 and 2030, and a background picture 2320. Except for the background picture 2320 all other contents have been shown in FIG. 12 and described previously.

The main reason for the existence of the 3D framed display shown in FIG. 16 is due to the consideration that in certain situation the background picture 2320 is best presented as a three sided background scene such as a three-wall interior room. This, coupled with the top edge picture 2024, and the bottom edge picture 2026, depicts a five-sided 3D background scene.

The most unique member of the 3D picture frame 2300 is the three-panel transparent plate 2310. This three-panel transparent plate 2310 is typically formed by plastic molding process and is consist of a left-panel transparent plate 2312, a right-panel transparent plate 2314 and a center-panel transparent plate 2316. The center-panel transparent plate 2316 is integrally joined to the left-panel transparent plate 2312 and the right-panel transparent plate 2314 each by a thin-out portion 2318. This thin-out portion 2318 is flexible and can allow the left-panel transparent plate 2312 and the right-panel transparent plate 2314 to be bent to a position at right angle with respect to the center-panel transparent plate 2316.

The assembling of the 3D picture frame 2300 and the associated 3D framed display starts by installing the bottom edge transparent plate 2014, bottom edge picture 2026, magnetic plate 2016, flat transparent plates 2004 and 2006 and the sandwiched floating picture 2020, 3D arts 2028 and 2030, in that order, in the frame body 2002. The three-panel transparent plate 2310 can next be installed in the frame body 2002. This is achieved by first bending the left-panel transparent plate 2312 and the right-panel transparent plate 2314 forward toward the center and then inserting it into the frame body 2002. The three-panel transparent plate 2310 is continued pushed forward until it is stopped by the second flat transparent plate 2006.

The next item to be installed is the background picture 2320. Before installation the background picture 2320 is curled forward to form an U-shaped sheet with its two ends projecting forward. These two ends are then carefully inserted simultaneously into the two clearances between the transparent plates 2312, 2314 and the two opposing inside frame walls of the frame body 2002. The background picture 2320 is continuously pushed forward until the center portion of the background picture 2320 is stopped at the center-panel transparent plate 2316

The top edge picture 2024 and the top edge transparent plate 2012 can now be inserted into the clearance just beneath the top inside frame wall of the frame body 2002. After this the backboard 2018 is next installed in the frame body 2002 and held in place by the turn buttons 2038. The assembling of the 3D picture frame 2300 is now completed.

It is important that once installed the left-panel transparent plate 2312 and the right-panel transparent plate 2314 will be in contact with the second flat transparent plate 2006 and at right angle with respect to the center-panel transparent plate 2316. The combined volume of the three-panel transparent plate 2310 and the two flat transparent plate 2004 and 2006 should nearly occupy the entire internal space of the frame body 2002. The width of the background picture 2320 is approximately equal to the linear width of the three-panel transparent plate 2310. After the installation of the background picture 2320 and the backboard 2018, the center portion of the background picture 2320 will be in contact with the and flatten by the backboard 2018. The background picture 2320 will present a three-sided scene with no gap at the corner.

It should be pointed out that the background picture 2320 can also be trimmed to form three separated picture sheets and displayed through the three-panel transparent plate 2310. But in this way it may be difficult, although not impossible, to avoid the presence of gap between two adjacent sheets.

FIGS. 17–21

Figure 18:
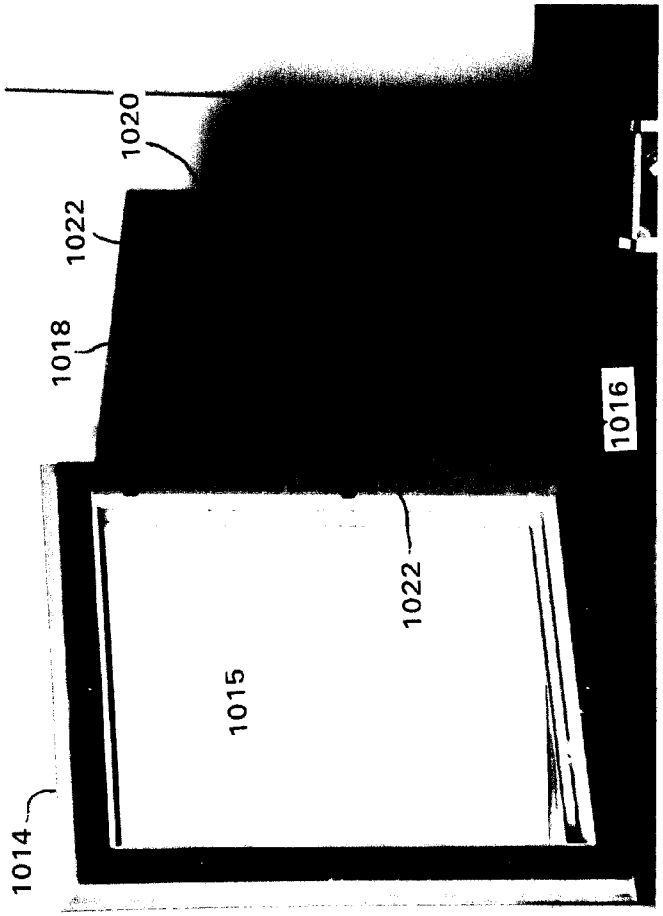
FIG. 18 is a perspective view showing the back side of a frame of the frame calendar system of FIG. 17, in the open position.

FIGS. 17–21 show a first embodiment of the frame calendar system of the present invention. It comprises a frame 1010 and a calendar sheet assembly 1012. As seen in FIG. 18, the frame 1010 has a frame body 1014 with a window 1015 and a swing type back door 1016. Attached to the back door 1016 is a spring plate 1018 which includes four inner spring leaf 1020 and four outer spring leaf 1022.

Figure 19:
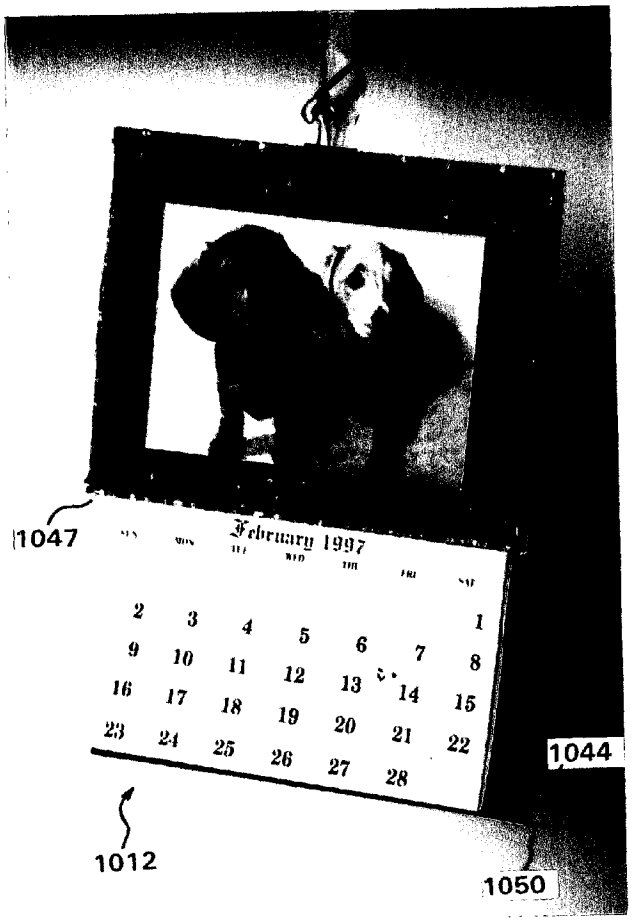
FIG. 19 is a perspective view showing a calendar sheet assembly of the frame calendar system of FIG. 17.

FIG. 19 shows the calendar sheet assembly 1012 which is assembled and ready to be mounted in the frame 1010. FIG. 20 also shows the same calendar sheet assembly, but which is disassembled to illustrate the details of a stack of calendar sheets 1024 and other components.

Referring to FIG. 20, a window glass 1026 with four slot holes 1028 is shown. Also shown is an inner frame 1030 with four L-shaped stud walls 1032 and four spring clips 1034. This inner frame 1030 can be mounted on the window glass 1026 with the four stud walls 1032 extended through the four slot holes 1028. The four spring clips 1034 will also engage with the four slot holes and lock the inner frame onto the window glass 1026.

Placed behind the window glass 1026 is a stack of calendar sheets 1024. Each of these sheets 1024 has a calendar picture section 1036, a calendar date table section 1038 and border section 1040. A perforation line is located between the border section 1040 and the calendar date table section 1038. Perforation lines are also located between the calendar picture section 1036 and the border section 1040. All these perforation lines are provided to facilitate the separation of all these sections.

Each of the calendar sheets 1024 has four L-shaped slot holes 1042. All these calendar sheets 1024 can be mounted behind the window glass 1026 with the slot holes 1042 engaged with the stud walls 1032 of the frame 1030 for hanging the calendar sheets 1024.

Placed behind the calendar sheets 1024 are one border backing plate 1044 and one picture backing plate 1046. It is preferable that these two plates be cut out of a elastic plastic sheet such as polycarbonate.

The first thing to be noticed in the border backing plate 1044 is a large opening 1048 cut out of the border backing plate 1044. This opening 1048 allows the border backing plate 1044 to clear the four stud walls 1032 of the inner frame 1030 when the border backing plate 1044 is mounted behind the calendar sheets 1024, as seen in FIG. 19.

As implied by its name, this border backing plate 1044 serves as a backing to the border section 1040 of the calendar sheets 1024. It will prevent the appearance of unevenness or wrinkle in the border section 1040 when it is mounted behind the window glass 1026 and placed in the frame 1010.

It is seen in FIG. 19 that the border backing plate 1044 has a length slightly longer than that of the calendar sheets 1024. Also notice that it has a bent section 1050 at its bottom. More details will be disclosed below in connection with the operation of the border backing plate 1044.

The picture backing plate 1046 is simply a rectangular plate made of plastic sheet or cardboard. It should have a size slightly smaller than the calendar picture section 1036 and can be fit inside the four studs 1032 of the inner frame 1030 when placed behind the calendar sheets 1024.

Figure 17:
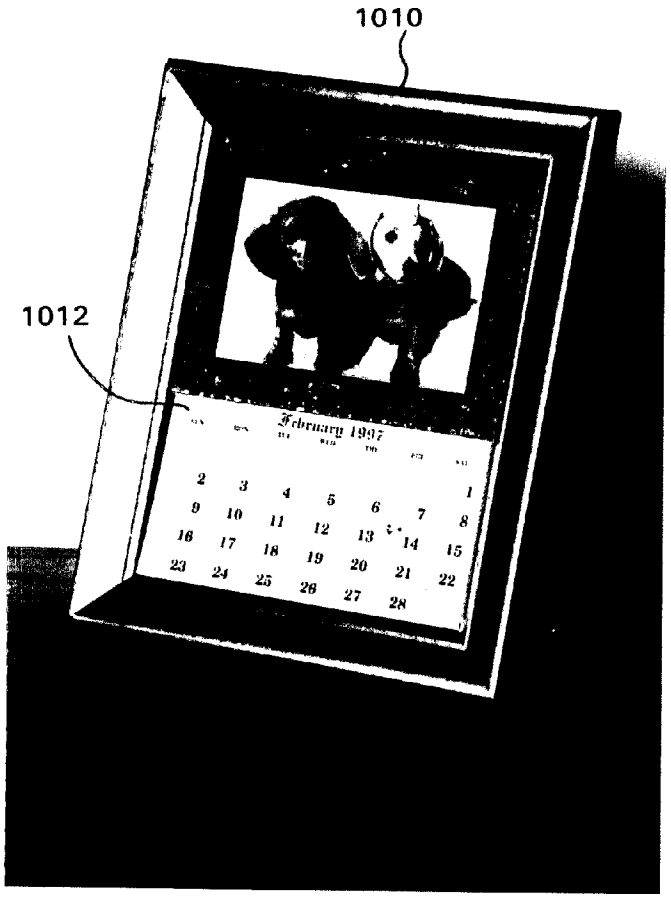
FIG. 17 is a perspective view showing a first embodiment of the frame calendar system of the present invention.

After all the components shown in FIG. 20 are assembled into a calendar sheet assembly 1012 as shown in FIG. 19, they can be placed in the frame body 1014 shown in FIG. 18. The border backing plate 1044 is loosely fit within the rabbet of the frame body 1014. The back door 1016 can now be closed and locked which produces a assembled frame calendar as shown in FIG. 17.

It is to be noticed that when assembled the four stud walls 1032 of the inner frame 1030 are inserted into the opening 1048 of the border backing plate 1044. As long as the border backing plate 1044 is held in place in the frame 1010, the inner frame 1030 is also secured in position. Further more, since the inner frame 1030 is locked into the window glass 1026, the window glass 1026 will also be held by the border backing plate 1044 when mounted in the frame 1010 vertically. At this point, the calendar sheets 1024 are also properly hung on display due to the engagement between the slot holes 1042 and the stud walls 1032.

It is clear from the above disclosure that the border backing plate 1044 of the present invention will serve a new function in addition to being a backing to the border section 1040. When assembled and placed in the frame 1010 the border backing plate 1044 will hold the window glass 1026 and the inner frame 1030 in place without falling. It will also support the calendar sheets 1024 for display in the frame 1010.

When the back door 1016 is closed the four outer spring leaf 1022 will be in contact with the border backing plate 1044, while the inner spring leaf 1020 will be in contact with the picture backing plate 1046. This will allow the border section 1040 and calendar picture section 1036 to be urged toward the window glass 1026, independent of each other, regardless of the number of sheets in each section, up to the capacity of the frame 1010.

It is seen in FIG. 19 that the width of the calendar date table section 1038 is narrower than that of the border section 1040. This is achieved by providing a step 1047 on each side of the calendar sheet 1024. The width of the calendar date table section should also be slightly narrower than that of the window 1015 of the frame body 1014. This is to assure that when mounted in the frame 1010 the calendar date table section 1038 can be freely turned without opening the frame 1010. Obviously, the length of the calendar date table section must also be short enough to clear the bottom rabbet of the frame body 1014.

The depth of the bent section 1050 of the border backing plate 1044 is about the same as that of the rabbet of the frame body 1014. When the back door 1016 is closed and locked it will be in contact with this bent section 1050 and force the bottom of the border backing plate 1044 forward toward the rabbet of the frame body 1014. This will allow the lower half of the border backing plate 1044 to support writing memo on the calendar date table section 1038.

In FIG. 21, a different border backing plate 1060 is disclosed. Similar to the previous version, this border backing plate 1060 also has a top opening 1062 and a bent section 1064. The difference is that the lower half of the border backing plate 1060 has a raised section 1066 which is achieved by typical sheet forming process.

As seen in FIG. 21, this raised section 1066 has a raised surface which is more raised toward the bottom of the plate 1060. It is important that the raised section 1066 must clear the rabbet of the frame body 1014 when the border backing plate 1060 is mounted in the frame 1010.

There are several new advantages provided by this improved border backing plate 1060. First of all, the raised section 1066 will add some structure rigidity and thus allow thinner sheet at lower cost to be used. This raised structure will render more support to the writing on the calendar date table section, and will not cave in easily under the pressure exerted during writing.

When mounted the calendar date table section should extend slightly below the bottom of the raised section 1066. It is to be noticed that this raised section 1066 will push the mounted calendar date table section forward and away from the frame body 1014. This will facilitate the grabbing of the top calendar sheet by its bottom edge, for turning the page for date checking.

The frame calendar system of the present invention as embodied by FIGS. 17–21 allows both the calendar picture 1036 and the date table 1038 to be displayed through the frame window 1015. The calendar picture 1036 is elegantly frame and protected behind the window glass 1026. The date table 1038 is also framed but exposed to facilitate memo writing and page turning.

At the end of the month, the expired calendar sheet can be removed after opening the frame 1010. Alternatively, the date table 1038 can also be torn off along the perforation line to expose the next month's date table without opening the frame 1010. In this case, the current calendar picture will be continuously displayed for the new month.

With the present frame calendar system any calendar picture 1036 can be displayed at any time by simply removing the calendar picture 1036 from the calendar sheet along the perforation lines and placing it immediately behind the window glass 1026. Of course, a custom picture of appropriate size can also be similarly displayed as taught previously.

Upon the expiration of the calendar sheet the border section 1040 can also be separated from the calendar picture 1036 and date table 1038 and stored in the frame 1010. This allows any one border among the stored borders to be chosen for display to complement the displayed calendar picture or custom picture.

FIGS. 22–24

FIGS. 22–24 disclose several further improvements on the frame calendar system of the present invention previously shown in FIGS. 17–21. For the sake of clarity the frame shown in FIGS. 17–18 is again shown in FIG. 22. The major components of this frame 1010 including the frame body 1014 with the frame window 1015, the back door 1016, and the mounted spring plate 1018 are also identified in FIG. 22. An easel attached to the back of the back door 1016, not seen in the figure is indicated by a dash line 1460.

A new item added to the frame 1010 shown in FIG. 22 is a spacer 1400. This spacer 1400 can be simply a wood or molded plastic block glued to the back door 1016. The purpose of this spacer 1400 will be described in the later section below.

Also shown in FIG. 22 is the window glass 1026 with four slot holes 1028. The inner frame 1030 is seen as a dash line outline 1030. The four L-shaped stud walls 1032 are seen inserted through the slot holes 1028 and the four spring clips 1034 engaged with the slot holes 1028 for mounting the inner frame 1030 on the window glass 1026. The inner frame 1030, as well as the four stud walls 1032, divides the window glass 1026 into a center display area 1464 inside the inner frame and a border display area 1466 outside the inner frame.

As described previously and shown in FIGS. 19–20, in each calendar sheet 1024 a perforation line is located between the border section 1040 and the calendar date table section 1038. In FIG. 22 the calendar sheet 1024 is not shown in its entirety. But the calendar picture sheet 1035 of the calendar sheet 1024 including the calendar center picture section 1036 and the calendar border picture section 1040 is shown in FIG. 22. This calendar picture sheet 1035 is obtained from the calendar sheet 1024 by simply removing the calendar date table section 1038 along the perforation line.

The calendar sheet 1024, as well as the calendar picture sheet 1035, can be mounted behind the window glass 1026 with the four slot holes 1042 engaged with the four stud walls 1032. The calendar center picture section 1036 is displayed through the center display area 1464 while the calendar border picture section 1040 is displayed through the border display area 1466.

The picture backing plate 1046 is the same as the one shown in FIG. 20. But the border backing plate 1044 shown previously is now divided into a new border backing plate 1408 and a calendar date table backing plate 1410.

After the calendar sheet 1024 is placed behind the window glass 1026, the picture backing plate 1046 is next placed behind the calendar center picture section 1036, while the border backing plate 1408 is placed behind the calendar border picture section 1040. The assembled calendar sheet assembly is then placed in the frame body 1014. The back door 1016 can now be closed and locked which produces an assembled frame calendar system with the calendar sheet 1024 properly displayed.

When this assembled frame calendar system is vertically positioned, the calendar sheet assembly is held in place without slipping because the two bottom stud walls 1032 are held by the two lower outer spring leaf 1022. Since the calendar date table backing plate 1410 is not installed in this assembled frame calendar system, the calendar date table section 1038 is free hung and touching the spacer 1400. This spacer 1400 will provide support to the calendar sheet 1024 for memorandum writing.

After the expiration of the present calendar sheet, the calendar date table section can be removed along the perforation line while the calendar center picture section 1036 and the border picture section 1040 can still be saved for future display. After a year or two, there will be enough of such calendar pictures and borders saved and there is no longer much need to accumulate any more of such calendar pictures and borders. It would be desirable that, for the purpose of reducing the cost, the calendar sheets of future years may be consisting of only the calendar date table section 1038 with no calendar borders and no calendar pictures. This is possible only if the new calendar sheets can be independently mounted on the frame 1010 without attaching to any saved calendar pictures and borders. This is the thrust for the further improvement of the present frame calendar system.

As the Internet is gaining more wide acceptance it will be possible to provide download of such calendar templates for many users at low cost. Different templates to include different holiday and/or religious events for different countries or ethnic groups can also be readily provided for such download. Once downloaded into the user's computer, the user can add custom memo, personal events, and clip arts to each standard calendar template to make the printed calendar sheet more suitable for each user's own individual needs.

As seen in FIG. 22, a compact disc 1462 also comes as a part of the calendar system of the present invention. This compact disc is a electronic storage medium or media that contains a calendar template data base and necessary software for making the calendar sheets. This calendar template data base is basically a compilation of many calendar templates covering different time periods, different sizes and shapes, and different holiday and/or religious event listings for different countries and different groups of people.

A calendar sheet may cover one particular month or week of one particular year. The size and shape may vary depending on the frame 1010, or more particularly, depending on the size and orientation of the calendar backing plate 1410 on which the calendar sheets are to be mounted.

US residents of Chinese origin may wish Chinese lunar calendar date in Chinese be included in a regular English calendar. People with strong Christian faith may wish a Bible script be printed in each calendar sheet. The calendar template data base should be devised to cover all these variations so that one particular template most suitable to the user's need can be chosen.

Once a calendar template is copied from the data base, the user can add custom memo, personal events and cliparts to this calendar. This task can be done either using the software in the CD 1462 or certain word processors owned by the user. The completed calendar can then be saved in the user's computer and printed to make the calendar sheet.

One other important advantage of such calendar customization is that once the calendar date table is stored in the computer, it can be revised to include any new memo, events, or graphics. This can be done any time when needed. The revised calendar sheet can then be printed and displayed replacing the current calendar sheet.

FIG. 22 shows two such customized calendar sheets, a horizontal custom calendar sheet 1422 and a vertical custom calendar sheet 1424, printed from a user's computer. The details of these two calendar sheets are shown in FIG. 23. It is seen here that in addition to regular calendar some personal message such as "Steve's birthday" and "Florida trip" are also included in the printed calendars. Several dashed lines 1450, 1454, 1456, and 1458 are used for indicating the mounting of these calendar sheets on the calendar backing plate 1410 to be describer later. The boundary lines 1426 and 1452 indicate the exact size of these calendar sheets. A paper cutter or scissors will be needed to trim the paper along these boundary lines for making these calendar sheets.

Before converting the present frame calendar system for mounting and displaying the custom horizontal calendar sheet 1422 or the custom vertical calendar sheet 1424 make sure there is no more old style calendar sheet 1024 still remains mounted in the frame 1010. If so just tear the calendar date table section 1038 off along the perforation line. From now on only the calendar picture sheet 1035 without the attached calendar date table section 1038 are allowed to be mounted on the frame 1010.

The calendar date table backing plate 1410 will be needed for mounting the calendar sheets 1422 and/or 1424 in the frame 1010. This plate 1410 can be placed in the frame 1010 below the window glass 1026 with a small gap there between. With the frame back door 1016 in the closed position the calendar backing plate 1410 will be held in place by the frame rabbet at its front and the spacer 1400 at its back With the help of the easel 1460, the frame assembly 1010 can stand on a table either in a vertical or horizontal position. Here the vertical position refers to the position of the frame 1010 as seen in FIG. 22 in which the long side of the assembled frame 1010 is standing vertically. The horizontal position refers to the position of the frame 1010 after the frame body 1014, as viewed in FIG. 22, is rotated 90 degree clockwise so that the short side of the frame 1010 is standing vertically. In both these two positions the frame always stands vertically and not laying flat on a table.

The horizontal calendar sheet 1422 has a width larger than its height and is mountable on the calendar backing plate 1410 for display when the assembled frame 1010 is in its vertical position. The vertical calendar sheet 1424 has a width smaller than its height and is mountable on the calendar backing plate 1410 for display when the assembled frame 1010 is in its horizontal position.

Two types of holding means are disclosed in the present invention to hold the calendar sheets 1422 and 1424 on the calendar backing plate 1410. The first holding means is a spring clamp 1412 and the second holding means include magnets 1414, 1416 and 1418. Normally only one of these holding means is required for the holding of the calendar sheets 1422 and 1424.

To begin the mounting of the calendar sheets 1422 and 1424 it is assumed that the frame 1010 is assembled as previously described and is placed face up on a table. Only the spring clamp 1412 is present with no magnets 1414, 1416 and 1418 installed on the calendar backing plate 1410. The spring clamp 1412 is mounted on the calendar backing plate 1410 as shown in FIG. 22. But all the magnets 1414, 1416 and 1418 are assumed removed.

FIG. 24 shows an enlarged view of this spring clamp 1412. This spring clamp can be made of cast metal or molded plastics. It includes a clamp base 1432 and a clamp plunger 1434. The clamp base is in the shape of a rotated "U". The top portion of the clamp base 1432 is a base handle 1436 which provides a straight hole 1438. The bottom portion of the clamp base is a base plate 1440 with a rectangular foot. The upper part of the clamp plunger 1434 is a plunger handle 1442 which is integrally connected to a plunger stem 1444 inserted through the straight hole 1438 and a compression spring 1446. The lower end of the plunger stem 1444 is threaded and is threaded into a disk 1448. Due to the compression spring 1436 the clamp plunger 1434 always rests at its lowest position with the disk 1448 firmly pressed on the base plate 1440.

Assume for now the horizontal calendar sheet 1422 is to be displayed and the vertical calendar sheet 1424 is not needed and can be just stacked behind the horizontal calendar sheet 1422. More calendar sheets can also be added to this stack. This calendar sheet stack can be installed on the calendar backing plate 1410 by simply lifting up the clamp plunger 1434 with one hand while placing the calendar sheet stack underneath the disk 1448. Make sure the disk 1448 is properly aligned with a dash line 1450 printed on the top center of the horizontal calendar sheet 1422 positioned right below the disk 1448. The clamp plunger 1434 is then released which will allow the disk 1448 clamped onto the calendar sheet stack.

The assembled calendar system can now be picked up from the table and positioned on its vertical position. At this position the calendar picture sheet 1035 is elegantly displayed through the frame window glass 1026. The horizontal calendar sheet 1422 is also framed but is exposed and displayed below the calendar picture sheet 1035. It will facilitate memorandum writing on the horizontal calendar sheet 1422 and page flipping for date checking without opening the frame.

When the vertical calendar sheet 1424 is to be displayed, naturally, this same sheet will need to be placed to the top of the calendar sheet stack. The mounting of this calendar sheet stack is achieved by lifting the clamp plunger 1434, placing the calendar sheet stack in its proper position, and sliding the spring clamp 1412 to the upper left corner of the vertical calendar sheet 1424. The clamp plunger 1434 is then released allowing the disk 1448 clamped onto the vertical calendar sheet 1424 at the position indicated by a dash line 1454.

The assembled frame 1010 can now be positioned to its horizontal position. At this position the calendar picture sheet 1035 is elegantly displayed through the frame window glass 1026. The vertical calendar sheet 1424 is also framed but is exposed and displayed beside the calendar picture sheet 1035. It again will facilitate memorandum writing on the vertical calendar sheet 1424 and page flipping for date checking without opening the frame 1010.

Both the horizontal calendar sheet 1422 and the vertical calendar sheet 1424 can also be supported by the magnet blocks 1414, 1416 and 1418 without the spring clamp 1412. As shown in FIG. 22, the two magnet blocks 1414 are integrally mounted on the back side of calendar backing plate 1410 by adhesive or other suitable means. Two more magnet blocks 1416 are also shown in FIG. 22. These two magnet blocks 1416 are freely movable and can be placed on the front side of the calendar backing plate 1410 near the two magnet blocks 1414. Once the hand holding these magnet blocks 1416 is released, the magnetic force between the magnet blocks 1414 and the magnet blocks 1416 will force each magnet block 1416 to jump and rest on the same position shown next to the magnet block 1414 across the calendar backing plate 1410.

Not shown in FIG. 22, but also mounted behind the calendar backing plate 1410 in the similar manner as the magnet blocks 1414, are two other magnet blocks 1418. Two dash line rectangles 1420 are shown indicating the position of these two magnet blocks 1418 on the back side of the calendar backing plate 1410.

To begin the mounting process, the assembled calendar system without the calendar sheets is first laid flat face up on a table. The two magnet blocks 1416 are temporarily removed. The stack of horizontal calendar sheets 1422 or vertical calendar sheets 1424 are placed on the calendar backing plate 1410 properly aligned and oriented. The two magnet blocks 1416 can now be placed on the calendar sheet stack near the two rectangle dash lines 1456 of the horizontal calendar sheet 1422 or the two rectangle dash lines 1458 of the vertical calendar sheet 1424. These two magnet blocks 1416 will "jump" to its final positions indicated by the rectangle dash lines 1456 or 1458. This completes the calendar sheet mounting process.

It is clear from the above description that the spring clamp holding means or the magnetic holding means will hold the top portion of the horizontal calendar sheets to display the calendar below the window glass and the calendar picture when the frame is in the vertical position, and will also hold the top portion of the vertical calendar sheets to display the calendar beside the window glass and the calendar picture when the frame is in the horizontal position. These calendar sheets are easily mounted on or removed from the frame body without opening the frame assembly. A firm support is provided for memorandum writing on the calendar sheet. Since this calendar sheet is exposed, it can be readily lifted for date checking without opening the frame assembly.

When there are more calendar picture sheets available beside the calendar picture sheet 1035, the user is free to choose any one such calendar picture sheet for display. It is interesting to note that as seen in FIG. 22, the calendar center picture section 1036 and the calendar border picture section 1040 can be separated along the perforation lines 1404. Both these two sections can be mounted on and held by the four stud walls 1032 independent of each other. This means that one can display a calendar center picture section from one calendar picture sheet along with a calendar border picture section from any other calendar picture sheet.

Also shown in FIG. 22 is a personal photo 1470 which can be placed immediately behind the window glass and be displayed along with the calendar border picture section 1040 of the calendar picture sheet 1035 and thus becomes part of the present frame calendar system. More such photos can also be stored behind the calendar picture sheet 1035.

Most commercially available photos are rectangular in shape with unequal width and height. So if the photo to be displayed is a vertical photo, i.e., one with its height larger than its width, it can be displayed in the present frame 1010 beside the vertical calendar sheet 1424 when the frame is in a horizontal position. If the photo to be displayed is a horizontal photo, i.e., one with its width larger than its height, as is the case with the personal photo 1470, it can be displayed in the frame 1010 above the horizontal calendar sheet 1422 when the frame 1010 is in the vertical position.

The calendar picture sheet 1035 with a calendar border picture section 1040 is especially beneficial when a photo is displayed in the frame 1010 of the present invention. The freedom in the change of the calendar border picture section in display is an inexpensive way to change the appearance of a picture frame. The ability of choosing one border pattern complementing the photo in display is very desirable. The most popular size of photos available for picture frame display is probably 4"×6" (10 cm×15 cm) which is too small to match a calendar sheet considering the amount of information needed to be included in a typical calendar sheet. The addition of a calendar border picture section surrounding such a photo will enable the size of a matching calendar sheet to be increased to a much more desirable value.

FIG. 25

FIG. 25 shows a second embodiment of the frame calendar system of the present invention. It comprises a frame assembly 1510, a calendar sheet 1520 and more calendar sheets covering different time periods, and an electronic storage medium or compact disc (CD) 1530.

The frame assembly 1510 includes a frame body 1532 having a first frame window 1534 and a second frame window 1536, a back door or back board 1540 rotatably mounted on said frame body 1532 using two hinges 1543 of conventional design. Mounted behind the back door 1540 is an easel 1542 which enables the frame assembly 1510 to stand on a table in a vertical position and a horizontal position. Here the vertical position refers to the position of the frame 1510 as seen in FIG. 25 in which the long side of the assembled frame 1510 is standing vertically. The horizontal position refers to the position of the frame 1510 after the frame body 1532, as viewed in FIG. 25, is rotated 90 degree clockwise so that the short side of the frame 1510 is standing vertically. In both these two positions the frame always stands vertically and not laying flat on a table.

In additional to the easel, two hangers 1544 and 1546 of conventional design are also mounted on the back side of the back door for hanging said frame assembly 1510 on a wall in a vertical position and a horizontal position, respectively. Four rubber feet 1548 are attached to the four corners of the back side of the back door 1540 to support the frame assembly 1510 evenly on a wall or when the frame assembly 1510 is placed face up on a table.

Mounted behind the first frame window 1534 is a window glass 1550 of conventional design. A horizontal picture or photo 1552 and a vertical picture or photo 1554 can be placed behind the window glass 1550 for displaying either one there through. This will make the photos 1552 and 1554 part of the present frame calendar system. A cardboard 1556 can be optionally placed behind the two photos for urging the photos toward the window glass 1550 when the back door 1540 is closed and locked.

Also shown in FIG. 25 is a calendar backing plate 1558 which is preferably made of molded plastics to receive four magnet blocks 1560, 1562, 1564, and 1566 imbedded in the calendar backing plate 1558 and held in place by adhesive or other suitable means. The front face of these four magnet blocks are largely flush with the front surface of the calendar backing plate 1558. The size of the calendar backing plate is preferably square. It is to be mounted behind the second frame window 1536 snugly. The thickness of the calendar backing plate 1558 is such so that it will make the calendar backing plate 1558 firmly held in place once the back door 1540 is closed and locked.

As stated above, the compact disc 1530 also comes as a part of the calendar system of the present invention. This compact disc contains a calendar template data base and necessary software for making the calendar sheets such as the calendar sheet 1520 which is also part of the calendar system of the present invention. This calendar template data base is basically a compilation of many calendar templates covering different time periods, different sizes and shapes, and different holiday and/or religious event listings for different countries and different groups of people.

The calendar sheet 1520 of the present invention is preferably square in size. It will be mounted on the calendar backing plate 1558 with the use of two magnet blocks 1568 and 1570 also shown in FIG. 25. These two magnet blocks are of the same size as that of the magnet blocks 1560, 1562, 1564, and 1566, but are freely movable.

Before mounting the calendar sheet 1520, the assembled frame 1510 is placed face up on a table with the mounted photo showing properly upright. The calendar sheet 1520 can now be placed upright on the calendar backing plate 1558. The magnet blocks 1568 and 1570 are then placed near the positions indicated by the two rectangular dash line 1572 on the top portion of the calendar sheet 1520. Once the hand holding the magnet blocks 1568 and 1570 is released, these two magnet blocks will automatically "jump" to its final locations right above their counterpart magnet blocks and firmly hold the calendar sheet 1520 in place. The mounting of the calendar sheet 1520 is now completed.

The frame assembly 1510 can now be hung on a wall or stand on a table in the vertical position or the horizontal position. The horizontal photo 1552 is elegantly displayed through the window glass 1550 while the calendar sheet 1520 is also framed but is exposed below the horizontal photo 1552 when the frame 1510 is placed in the vertical position. The vertical photo 1554 is elegantly displayed through the window glass 1550 while the calendar sheet 1520 is also framed but is exposed beside the vertical photo 1554 when the frame 1510 is placed in the horizontal position. In either case the two magnet blocks 1568 and 1570 hold the top portion of the calendar sheet 1520 to facilitate memorandum writing and page flipping without opening the frame 1510.

The magnet blocks 1560, 1562, 1564, 1566, 1568 and 1570 should be chosen to hold at least twelve calendar sheets of conventional papers. It is also important that the embedded magnet blocks 1560, 1562, 1564 and 1566 should be flush with the front surface of the calendar backing plate 1558 so that the distance between these embedded magnet blocks and the magnet blocks 1568 and 1570 can be maintained at a minimum in order to maximize the magnetic attractive force.

It is also preferable that the width and height of the square calendar sheet 1520 be either 8.5" (216 mm) or 210 mm. These are the widths of the short sides of a letter size paper (8.5"×11", 216 mm×279 mm) and a A4 size paper (210 mm×297 mm), respectively, commonly used in printers. This means that only one trim is needed to make the square calendar sheet 1520. It is also possible to simply fold back the paper along the trim line without actual trimming. Once this calendar sheet is mounted the fold back portion tends to push out the bottom of the calendar sheet which actually makes it easier to flip the page for date checking.

FIG. 26

FIG. 26 shows a third embodiment of the frame calendar system of the present invention. It comprises a frame assembly 1610, a calendar sheet 1620 and more calendar sheets covering different time periods, and an electronic storage medium or compact disc (CD) 1630.

The frame assembly 1610 includes a frame body 1632 having a frame window 1634, and a back door or back board 1640 rotatably mounted on said frame body 1632 using two hinges 1643 of conventional design. Mounted behind the back door 1640 is an easel 1642 which enables the frame assembly 1610 to stand on a table in a vertical position and a horizontal position. Here the vertical position refers to the position of the frame 1610 as seen in FIG. 26 in which the long side of the assembled frame 1610 is standing vertically. Note here since the back door 1640 is the longest element in the frame assembly 1610, the long side of the frame refers to the long side of the back door 1640. The horizontal position refers to the position of the frame 1610 after the frame body 1632, as viewed in FIG. 26, is rotated 90 degree clockwise so that the short side of the frame 1610 is standing vertically. In both these two positions the frame always stands vertically and not laying flat on a table.

In additional to the easel two hangers 1644 and 1646 of conventional design are also mounted on the back side of the back door for hanging said frame assembly 1610 on a wall in a vertical position and a horizontal position, respectively. Four rubber feet 1648 are attached to the four corners of the back side of the back door 1640 to support the frame assembly 1610 evenly on a wall or when the frame assembly 1610 is placed face up on a table.

Mounted behind the frame window 1634 is a window glass 1650 of conventional design. A horizontal picture or photo 1652 and a vertical picture or photo 1654 can be placed behind the window glass 1650 for displaying either one there through. This will make the photos 1652 and 1654 part of the present frame calendar system. A cardboard 1656 can be optionally placed behind the two photos for urging the photos toward the window glass 1650 when the back door 1640 is closed and locked.

As stated above, the compact disc 1630 also comes as a part of the calendar system of the present invention. This compact disc contains a calendar template data base and necessary software for making the calendar sheets such as the calendar sheet 1620 which is also part of the calendar system of the present invention. This calendar template data base is basically a compilation of many calendar templates covering different time periods, different sizes and shapes, and different holiday and/or religious event listings for different countries and different groups of people.

The calendar sheet 1620 of the present invention is preferably square in size. A single calendar sheet 1620 for each calendar period is needed regardless whether the vertical photo 1654 or the horizontal photo 1652 is to be displayed. It is also preferable that the width and height of the square calendar sheet 1620 be either 8.5" (216 mm) or 210 mm. These are the widths of the short sides of a letter size paper (8.5"×11", 216 mm×279 mm) and a A4 size paper (210 mm×297 mm), respectively, commonly used in printers. This means that only one trim is needed to make the square calendar sheet 1620. It is also possible to simply fold back the paper along the trim line without actual trimming. Once this calendar sheet is mounted the fold back portion tends to push out the bottom of the calendar sheet which actually makes it easier to flip the page for date checking.

As seen in FIG. 26 the back door 1640 is considerably longer than the frame body 1632. When the back door 1640 is closed a large portion of the back door 1640 is still exposed beyond the frame body 1632. This exposed portion of the back door 1640 will be used for holding the calendar sheet 1620.

There are three different mounting mechanism, namely, magnets, spring clamp, and hanging hooks, shown in FIG. 26 and described below for holding the calendar sheet 1620 on the back door 1640. All these mechanism are independent of each other and to be employed alone without the others. When each of these mechanism is described and in operation, the other two mechanism are assumed to be non-existent and their associated elements in the drawing should be ignored.

The first mounting mechanism to be described includes four stationary magnet blocks 1660, 1662, 1664 and 1666 mounted on, preferably embedded in, the back door 1640 by adhesive or other suitable means. The front surface of these magnet blocks should be nearly flush or slightly above the front face of the back door 1640. Also shown in FIG. 26 are two other magnet blocks 1668 and 1670 which are freely movable.

Before mounting the calendar sheet 1620, the assembled frame 1610 is placed face up on a table with the mounted photo showing properly upright. The calendar sheet 1620 can now be placed upright on the exposed portion of the back door 1640. The magnet blocks 1668 and 1670 are then placed near the positions indicated by the two rectangular dash line 1672 on the top portion of the calendar sheet 1620. Once the hand holding the magnet blocks 1668 and 1670 is released, these two magnet blocks will automatically "jump" to its final locations right above their counterpart magnet blocks and firmly hold the calendar sheet 1620 in place. The calendar sheet 1620 is now properly mounted magnetically.

Also integrally mounted on the back door 1640 are four hanging hooks 1674, 1676, 1678 and 1680. Before mounting the calendar sheet 1620 using these hanging hooks the assembled frame 1610 is placed face up on a table with the mounted photo showing properly upright. The calendar sheet 1620 can now be placed upright on the exposed portion of the back door 1640 with two hanging holes 1682 on the calendar sheet 1620 engaged with two of the four hanging hooks 1674, 1676, 1678 and 1680 depending on the orientation of the frame 1610. The mounting of the calendar sheet 1620 using the hanging hook mechanism is now completed.

The last mounting mechanism to be described is a spring clamp 1684 which is bent to the shape as shown in FIG. 26. One end of this spring clamp 1684 is integrally wrapped around a stop bar 1686. This spring clamp 1684 is held in place by an "U" shaped bar 1688 and a "L" shaped bar 1690 integrally mounted on the back door 1640. A second set of "U" shaped bar 1692 and "L" shaped bar 1694 are also integrally mounted on the back door 1640 as shown in FIG. 26.

Before mounting the calendar sheet 1620, the assembled frame 1610 is placed face up on a table with the mounted horizontal photo 1652 showing properly upright. The spring clamp 1684 is next loosened from the mounted position as viewed in FIG. 26 by pressing down the free end of the spring clamp 1684 at its right, and turn it away from the "L" shaped bar 1690. The calendar sheet 1620 can now be placed on the back door 1640 with the top portion of the calendar sheet 1620 positioned underneath the loosened spring clamp 1684. While holding down the calendar sheet 1620 with one hand, the other hand can press down the free end of the spring clamp 1684 and turn it until it is underneath and stopped by the "L" shaped bar 1690. Both hands are now released which completes the mounting of the calendar sheet 1620 using the spring clamp 1684.

If the calendar sheet 1620 is to be mounted on the back door 1640 for viewing along with the displayed vertical photo 1654, the spring clamp 1684 needs to be first removed from the "L" shaped bar 1690 and followed by pulling it off the "U" shaped bar 1688. Again place the assembled frame face up on a table with the mounted vertical photo 1654 displayed properly upright. The spring clamp 1684 is next inserted through the "U" shaped bar 1692 all the way until the stop bar 1686 is stopped at the "U" shaped bar 1692. The calendar sheet 1620 can now be placed on the back door 1640 with the top portion of the calendar sheet 1620 positioned underneath the loosened spring clamp 1684. While holding down the calendar sheet 1620 with one hand, the other hand can press down the free end of the spring clamp 1684 and turn it until it is underneath and stopped by the "L" shaped bar 1694. Both hands are now released which completes the mounting of the calendar sheet 1620 using the spring clamp 1684.

After mounting the calendar sheet 1620 by any one of the three mounting mechanism the frame assembly 1610 is ready to be hung on a wall or stand on a table in the vertical or horizontal position. A photo is elegantly displayed through the window glass 1650 while the calendar sheet is exposed to facilitate memorandum writing and page flipping without opening the frame 1610. The horizontal photo 1652 and the calendar sheet 1620 are displayed uprightly and lined up vertically when the frame 1610 is placed in the vertical position. The vertical photo 1654 and the calendar sheet 1620 are displayed uprightly and lined up horizontally when the frame 1610 is placed in the horizontal position.

FIGS. 27–29

FIG. 27 shows a fourth embodiment of the frame calendar system of the present invention. It comprises a frame assembly 1710, an electronic storage medium or compact disc (CD) 1714, a horizontal calendar sheet 1722, a vertical calendar sheet 1724, and more calendar sheets covering different time periods.

The frame assembly 1710 includes a frame body 1732 having a frame window 1734, and a back door or back board 1740 rotatably mounted on said frame body 1732 using two hinges 1743 of conventional design. Mounted behind the back door 1740 is an easel 1742 which enables the frame assembly 1710 to stand on a table in a vertical position and a horizontal position. Here the vertical position refers to the position of the frame 1710 as seen in FIG. 27 in which the long side of the assembled frame 1710 is standing vertically. Note here since the back door 1740 is the longest element in the frame assembly 1710, the long side of the frame refers to the long side of the back door 1740. The horizontal position refers to the position of the frame 1710 after the frame body 1732, as viewed in FIG. 27, is rotated 90 degree clockwise so that the short side of the frame 1710 is standing vertically. In both these two positions the frame always stands vertically and not laying flat on a table.

In additional to the easel, two hangers 1744 and 1746 of conventional design are also mounted on the back side of the back door for hanging said frame assembly 1710 on a wall in a vertical position and a horizontal position, respectively. Four rubber feet 1748 are attached to the four corners of the back side of the back door 1740 to support the frame assembly 1710 evenly on a wall or when the frame assembly 1710 is placed face up on a table.

Mounted behind the frame window 1734 is a window glass 1750 of conventional design. A horizontal picture or photo 1752 and a vertical picture or photo 1754 can be placed behind the window glass 1750 for displaying either one there through. This will make the photos 1752 and 1754 part of the present frame calendar system. A cardboard 1756 can be optionally placed behind the two photos for urging the photos toward the window glass 1750 when the back door 1740 is closed and locked.

As stated above, the compact disc 1714 also comes as a part of the calendar system of the present invention. This compact disc contains a calendar template data base and necessary software for making the calendar sheets such as the calendar sheets 1722 and 1724 which are also part of the calendar system of the present invention. This calendar template data base is basically a compilation of many calendar templates covering different time periods, different sizes and shapes, and different holiday and/or religious event listings for different countries and different groups of people.

The calendar sheets 1722 and 1724 of the present invention is preferably of rectangular shape with a plurality of mounting holes 1758 near the edge of one long side of the calendar sheets 1722 and 1724. It is also preferable that the calendar sheets 1722 and 1724 has a size of 8.5"×11" (216 mm×279 mm) or 210 mm×297 mm. These are the sizes of a standard letter size paper and a A4 size paper, respectively, commonly used in printers. This means that no trimming is needed to make the calendar sheets 1722 and 1724. One other reason is that such standard sheets are commonly available with mounting holes already provided.

As seen in FIG. 27 the back door 1740 is considerably longer than the frame body 1732. When the back door 1740 is closed a large portion of the back door 1740 is still exposed beyond the frame body 1732. This exposed portion of the back door 1740 will be used for holding the calendar sheets 1722 and 1724.

As seen in FIG. 27, three hanging hooks 1760 are integrally attached to a metal plate 1762 which is mounted on the back door 1740 by four screws 1764 or other suitable means. Each hanging hook 1760 is in the shape of a rotated "U" with a long leg and a short leg. The long leg is attached to the metal plate 1762 which leaves a gap between the end of the short leg and the metal plate 1762. This gap will be used for inserting the calendar sheets as will be explained below.

The calendar sheets 1722 or 1724 can be mounted on the frame 1710 by simply inserting the edge of the calendar sheet on the side of the mounting holes 1758 into the gap between the short legs of the hanging hooks 1760 and the metal plate 1762. Run the mounting holes 1758 down the short legs and turn the calendar sheet until it is resting on the long legs of the hanging hooks 1760 as shown in FIG. 27. This completes the calendar sheet mounting process.

The above described calendar sheet mounting can be done regardless whether the frame 1710 is face up laying on a table, hanging on a wall, or resting on its easel 1742. The calendar sheet 1722 and the calendar sheet 1724 are mounted on the frame in the same manner. Of course, one needs to be certain that the horizontal calendar sheet 1722 is intended to be displayed along with the horizontal photo 1752, while the vertical calendar sheet 1724 is intended to be displayed along with the vertical photo 1754.

After mounting the calendar sheets 1722 or 1724 the frame assembly 1710 is ready to be hung on a wall or stand on a table in the vertical or horizontal position. A calendar picture or photo is elegantly displayed through the window glass 1750 while the calendar sheet is exposed to facilitate memorandum writing and page flipping without opening the frame 1710. The horizontal photo 1752 and the horizontal calendar sheet 1722 are displayed uprightly and lined up vertically when the frame 1710 is placed in the vertical position. The vertical photo 1754 and the vertical calendar sheet 1724 are displayed uprightly and lined up horizontally when the frame 1710 is placed in the horizontal position.

It is worthwhile pointing out that the present design of the hanging hook 1760 with a short leg is better than the hanging hook 1674 without a short leg shown in FIG. 26. When the calendar sheet 1620 is flipped for date checking, it is likely that the calendar sheet 1620 may inadvertently slide off the hanging hook 1674. This type of slip is very unlikely when the calendar sheet 1722 or 1724 is flipped for date checking since the movement of the calendar sheet along the hanging hook 1760 will be stopped by this short leg.

Also shown in FIG. 27 is a rotatable stop 1770 mounted on the back door 1740 at the lower right side of the calendar sheet 1722 as viewed in the figure. This rotatable stop 1770 can be rotated to hold down the calendar sheet 1722. Such stop is mainly desirable to prevent the upper right corner of the calendar sheet 1724 from falling down when the calendar sheet 1724 is displayed with the frame 1710 hanging on a wall in the horizontal position. There is no such problem when the frame 1710 is supported by the easel 1742 in the horizontal position since the frame 1710 is still tilted backward somewhat and the calendar sheet 1724 will lay flat on the back door 1740.

FIG. 28 shows the detailed toggle mechanism of this rotatable stop 1770. The main component in this rotatable stop or toggle stop 1770 is a toggle plate 1772 which is rotatably mounted on an angle bracket 1774 which is rigidly mounted on the back door 1740. This toggle plate has two legs 1774 and 1776. A spring is shown with two end hooks 1780 and 1782 which are mounted on a stud 1784 on the toggle plate 1772 and a stud 1786 on the angle bracket 1774, respectively.

The structure of the rotatable stop 1770 as above described allows the toggle plate 1772 to be toggled between a first position and a second position. In its first position the leg 1774 is seen firmly holding down the calendar sheet 1722 as the toggle plate is pulled down under the force exerted by the spring 1778. The calendar sheet 1724, when mounted on the frame 1710, will also be similarly held in place by this toggle plate 1772 rest in this first position.

The toggle plate 1772 is released from its first position by simply pushing the leg 1776 to its right as viewed in FIG. 28. Once the spring 1778 is rotated beyond its vertical position the pulling force of the spring 1778 will accelerate the further rotation of the toggle plate 1772 until the leg 1776 hits and is thus stopped by the back door 1740. This is the second position of the toggle plate 1772 as indicated by the dash outline 1788. In this position the calendar sheet 1722 can be freely lifted for date checking.

FIG. 29 shows the same frame calendar system of FIG. 27 except that the three hanging hooks 1760 are replaced by a three ring binder 1790. This type three ring binder is commonly known installed in a binder folder for holding note paper sheets. Compared with the three hanging hooks 1760, the three ring binder 1790 will hold the calendar sheets 1722 and 1724 even more securely when the three ring binder 1790 is in the closed position. However, one additional step of opening and closing the three ring binder 1790 will be required when installing or removing a calendar sheet.

FIG. 30

FIG. 30 shows a fifth embodiment of the frame calendar system of the present invention. It comprises a frame assembly 1810, an electronic storage medium or compact disc (CD) 1814, a horizontal calendar sheet 1822, a vertical calendar sheet 1824, and more calendar sheets covering different time periods.

The frame assembly 1810 includes a frame body 1832 having a frame window 1834, and a back door or back board 1840 rotatably mounted on said frame body 1832 using two hinges 1843 of conventional design. Mounted behind the back door 1840 is an easel 1842 which enables the frame assembly 1810 to stand on a table in a vertical position and a horizontal position. Here the vertical position refers to the position of the frame 1810 as seen in FIG. 30 in which the long side of the assembled frame 1810 is standing vertically. Note here since the back door 1840 is the longest element in the frame assembly 1810, the long side of the frame refers to the long side of the back door 1840. The horizontal position refers to the position of the frame 1810 after the frame body 1832, as viewed in FIG. 30, is rotated 90 degree clockwise so that the short side of the frame 1810 is standing vertically. In both these two positions the frame always stands vertically and not laying flat on a table.

In additional to the easel, two hangers 1844 and 1846 of conventional design are also mounted on the back side of the back door for hanging said frame assembly 1810 on a wall in a vertical position and a horizontal position, respectively. Four rubber feet 1848 are attached to the four corners of the back side of the back door 1840 to support the frame assembly 1810 evenly on a wall or when the frame assembly 1810 is placed face up on a table.

Mounted behind the frame window 1834 is a window glass 1850 of conventional design. A horizontal picture or photo 1852 and a vertical picture or photo 1854 can be placed behind the window glass 1850 for displaying either one there through. This will make the photos 1852 and 1854 part of the present frame calendar system. A cardboard 1856 can be optionally placed behind the two photos for urging the photos toward the window glass 1850 when the back door 1840 is closed and locked.

As stated above, the compact disc 1814 also comes as a part of the calendar system of the present invention. This compact disc contains a calendar template data base and necessary software for making the calendar sheets such as the calendar sheets 1822 and 1824 which are also part of the calendar system of the present invention. This calendar template data base is basically a compilation of many calendar templates covering different time periods, different sizes and shapes, and different holiday and/or religious event listings for different countries and different groups of people.

The calendar sheets 1822 and 1824 of the present invention is preferably of rectangular shape. It is also preferable that the calendar sheets 1822 and 1824 have a size of 8.5"×11" (216 mm×279 mm) or 210 mm×297 mm. These are the sizes of a standard letter size paper and a A4 size paper, respectively, commonly used in printers. This means that no trimming is needed to make the calendar sheets 1822 and 1824.

As seen in FIG. 30 the back door 1840 is considerably longer than the frame body 1832. When the back door 1840 is closed a large portion of the back door 1840 is still exposed beyond the frame body 1832. This exposed portion of the back door 1840 will be used for holding the calendar sheets 1822 and 1824.

Two spring clamps 1860 and 1862 are shown in FIG. 30 integrally mounted on the back door 1840. Such spring clamps are commonly used in the conventional clipboards for holding note pads. In the present invention these two spring clamps 1860 and 1862 are arranged in such a way so that the horizontal calendar sheet 1822 can be held by the spring clamp 1860 to be displayed below the horizontal picture 1852 when the frame 1810 is in its vertical position, and the vertical calendar sheet 1824 can be held by the spring clamp 1862 to be displayed beside the vertical picture 1854 when the frame 1810 is in its horizontal position.

In FIG. 30 the vertical calendar sheet 1824 is shown held by the spring clamp 1862. This is done by pressing down the handle of the spring clamp 1862 to open this clamp while inserting the calendar sheet 1824 into the spring clamp 1862. Once the calendar sheet 1824 is inserted the hand pressing is released which allows the spring clamp 1862 to return to its normal closed position and hold down the calendar sheet 1824.

Also shown in FIG. 30 is a dash outline 1864 indicating the position of the horizontal calendar sheet 1822 if it is to be mounted on the back door 1840 and held by the spring clamp 1860. Unlike the spring clamp 1684 shown in FIG. 26 which is removable, the spring clamps 1860 and 1862 are permanently fixed on the back door 1840. Since only one clamp is to be needed at a time for holding the vertical calendar sheet 1824 or horizontal calendar sheet 1822, the other clamp not in use will simply take up some space on the back door 1864 and prevent the use of this space for the mounted calendar sheet.

The above described calendar sheet mounting can be done regardless whether the frame 1810 is face up laying on a table, hanging on a wall, or resting on its easel 1842. Once mounted, a calendar picture or photo is elegantly displayed through the window glass 1850 while the calendar sheet is exposed to facilitate memorandum writing and page flipping without opening the frame 1810. The horizontal photo 1852 and the horizontal calendar sheet 1822 are displayed uprightly and lined up vertically when the frame 1810 is placed in the vertical position. The vertical photo 1854 and the vertical calendar sheet 1824 are displayed uprightly and lined up horizontally when the frame 1810 is placed in the horizontal position.

FIGS. 31–32

FIGS. 31–32 show a sixth embodiment of the frame calendar system of the present invention. It comprises a frame assembly 1910, an electronic storage medium or compact disc (CD) 1914, a horizontal calendar sheet 1922, a vertical calendar sheet 1924, and more calendar sheets covering different time periods.

The frame assembly 1910 includes a frame body 1932 having a frame window 1934, and a back door or back board 1940 rotatably mounted on said frame body 1932 using two hinges 1943 of conventional design. Mounted behind the back door 1940 is an easel 1942 which enables the frame assembly 1910 to stand on a table in a vertical position and a horizontal position. Here the vertical position refers to the position of the frame 1910 as seen in FIG. 31 in which the long side of the assembled frame 1910 is standing vertically. Note here since the back door 1940 is the longest element in the frame assembly 1910, the long side of the frame refers to the long side of the back door 1940. The horizontal position refers to the position of the frame 1910 after the frame body 1932, as viewed in FIG. 31, is rotated 90 degree clockwise so that the short side of the frame 1910 is standing vertically. In both these two positions the frame always stands vertically and not laying flat on a table.

In additional to the easel, two hangers 1944 and 1946 of conventional design are also mounted on the back side of the back door for hanging said frame assembly 1910 on a wall in a vertical position and a horizontal position, respectively.

Four rubber feet 1948 are attached to the four corners of the back side of the back door 1940 to support the frame assembly 1910 evenly on a wall or when the frame assembly 1910 is placed face up on a table.

Mounted behind the frame window 1934 is a window glass 1950 of conventional design. A horizontal picture or photo 1952 and a vertical picture or photo 1954 can be placed behind the window glass 1950 for displaying either one there through. This will make the photos 1952 and 1954 part of the present frame calendar system. A cardboard 1956 is shown placed behind the two photos.

Also shown in FIG. 31 is a molded spring plate 1960 mounted on the back door 1940. This spring plate 1960 has four molded spring leaf 1962 and is a simplified version of the spring plate 1018 shown in FIG. 22. It is also noted that the rabbet 1964 of the frame body 1932 is much deeper than that of the frame body 1832 shown in FIG. 30. This deeper rabbet 1964, coupled with the spring plate 1960, will allow many calendar pictures to be stored in the frame body 1932, which is desirable for a calendar system.

It should be pointed out that the spring plate 1960 does not have to be permanently attached to the back door 1940. In either case this spring plate 1960, when placed behind the cardboard 1956 with the back door closed and locked, will serve as a spacer with flexible thickness. It will urge the calendar pictures toward the window glass 1950 regardless of the number of picture sheets, up to the capacity of the frame 1910.

As stated above, the compact disc 1914 also comes as a part of the calendar system of the present invention. This compact disc contains a calendar template data base and necessary software for making the calendar sheets such as the calendar sheets 1922 and 1924 which are also part of the calendar system of the present invention. This calendar template data base is basically a compilation of many calendar templates covering different time periods, different sizes and shapes, and different holiday and/or religious event listings for different countries and different groups of people.

The calendar sheets 1922 and 1924 of the present invention is preferably of rectangular shape. It is also preferable that the calendar sheets 1922 and 1924 has a size of 8.5"×11" (216 mm×279 mm) or 210 mm×297 mm. These are the sizes of a standard letter size paper and a A4 size paper, respectively, commonly used in printers. This means that no trimming is needed to make the calendar sheets 1922 and 1924.

As seen in FIG. 31 the back door 1940 is considerably longer than the frame body 1932. When the back door 1940 is closed a large portion of the back door 1940 is still exposed beyond the frame body 1932. This exposed portion of the back door 1940 will be used for holding the calendar sheets 1922 and 1924.

Two identical spring clamps 1970 and 1972 are shown in FIG. 31 integrally mounted on the back door 1940. The spring clamp 1970 serves to hold the vertical calendar sheet 1924, while the spring clamp 1972 serves to hold the horizontal calendar sheet 1922. FIG. 32 shows the detailed cross sectional view of the spring clamp 1970.

Each of the spring clamps 1970 and 1972 has two angle brackets 1974 spaced apart and mounted on the back door 1940. A toggle plate 1976 is rotatably mounted on each angle bracket 1974. A tension spring 1978 is shown with two end hooks 1980 and 1982 which are mounted on a stud 1984 on the toggle plate 1976 and a stud 1986 on the angle bracket 1974, respectively. Two cylindrical rods 1988 and 1990 are each mounted on the two spaced apart toggle plate 1976 as shown in FIG. 31.

The structure of the spring clamps or toggle clamps 1970 and 1972 as above described allows the toggle plate 1976 to be toggled between a first position and a second position. In its first position the rod 1988 is seen firmly holding down the vertical calendar sheet 1924 as the two toggle plates are pulled down under the force exerted by the two tension springs 1978. The toggle plates 1976 are released from its first position by simply pushing the rod 1990 to its right as viewed in FIG. 32. Once each tension spring 1978 is rotated beyond its vertical position the pulling force of the tension spring 1978 will accelerate the further rotation of the toggle plate 1976 until the rod 1990 hits and is thus stopped by the back door 1940. This is the second position of the toggle plate 1976 as indicated by the dash outline 1992. In this position the calendar sheet 1924 can be freely removed from the frame 1910.

The toggle clamps 1970 and 1972 as above described are structurally similar to the toggle stop 1770 shown in FIGS. 27 and 28, except for the fact that each toggle clamp has two spaced apart toggle plates holding two cylindrical rods in between. However, the main difference lies in their different functions. The toggle stop 1770 is merely a stop for preventing the upper right corner of the vertical calendar sheet 1724 from falling down when the calendar sheet 1724 is displayed with the frame 1710 hanging on a wall in the horizontal position.

On the other hand, the toggle clamps 1970 or 1972 is responsible for holding the entire weight of the stack of calendar sheets. Therefore, the demand on the strength of the tension spring 1978 is more critical. Since in most case the number of calendar sheets to be supported is less than 12 sheets of letter size paper, such demand can be easily met using commonly available tension springs.

The use of the present toggle clamps 1970 and 1972 is more desirable than the spring clamps or clipboard clamps 1860 and 1862 shown in FIG. 30 for several reasons. The "flip" action in the toggle clamp is inherently easier than the "pressing" action needed in the clipboard clamp. In the toggle clamp, once the tension spring is rotated pass the mid point it will be automatically rotated to its second position. On the other hand, the pressing force must be continuously applied to the clipboard clamp during the entire clamp opening process and beyond until all calendar sheets are removed or properly placed for mounting.

The fact that the toggle clamp can be left in its non-holding position indefinitely is also very beneficial. It will allow the user ample time to adjust or reposition the stack of calendar sheets until it is properly placed before the clamp is turned to its holding position. This advantage may make the present toggle clamp useful in a new kind of clipboard or bulletin board for holding any stack of sheets.

One other advantage of the toggle clamps 1970 and 1972 over the clipboard clamps 1860 and 1862 shown in FIG. 30 is that while only one toggle clamp is used at a time, the other toggle clamp not in use can be toggled to a position not interfering with the mounting of the calendar sheet. This means that the vertical calendar sheet 1924 and the horizontal calendar sheet 1922 are mounted on the same location on the back door 1940. The overall size of the back door 1940 can thus be made slightly smaller than that of the back door 1840 shown in FIG. 30.

The above described calendar sheet mounting can be done regardless whether the frame 1910 is face up laying on a table, hanging on a wall, or resting on its easel 1942. Once mounted, a calendar picture or photo is elegantly displayed through the window glass 1950 while the calendar sheet is exposed to facilitate memorandum writing and page flipping without opening the frame 1910. The horizontal photo 1952 and the horizontal calendar sheet 1922 are displayed uprightly and lined up vertically when the frame 1910 is placed in the vertical position. The vertical photo 1954 and the vertical calendar sheet 1924 are displayed uprightly and lined up horizontally when the frame 1910 is placed in the horizontal position.

FIGS. 33A–33B

FIGS. 33A and 33B show a vertical blank note sheet 1474 and a horizontal blank note sheet 1472, respectively, that can be mounted on and displayed in the frame calendar system of the present invention as shown in FIGS. 22–24. Many blank note templates such as the one shown in FIGS. 33A and 33B can be provided in the CD 1462. The user can simply choose one desired template and add the text "From the desk of Mary Smith" or other suitable text to make it a personal blank note sheet.

In FIGS. 33A and 33B, the horizontal blank note sheet 1472 and the vertical blank note sheet 1474 have a boundary line 1478 and a boundary line 1480, respectively, with their sizes same as that of the boundary lines 1426 and 1452, respectively, as shown in FIG. 23. A paper cutter or scissors will be needed to trim the paper along these boundary lines for making these blank note sheets.

Just as the calendar sheets 1422 and 1424, the blank note sheets 1472 and 1474 can also be held by either the spring clamp 1412 or the magnets 1414, 1416 and 1418. The dash lines 1482 and 1484 indicate the contact points when the blank note sheets 1472 and 1474, respectively, are to be held by the spring clamp 1412. The rectangle dash lines 1486 and 1488 indicate the contact points when the blank note sheets 1472 and 1474, respectively, are to be held under the magnets 1416.

The user can write memo, To-do list, etc., on such blank note sheet, and then post it on the frame. It is normally temporarily placed on top of the calendar sheets and is removed once it is expired.

The main advantage in the use of the blank note sheets in the present frame calendar system is its ease of placement and high visibility. The placement and removal of this sheet is extremely easy which involves nothing more than the lifting of the magnet 1416 or the plunger handle 1442. Since the frame is usually vertically placed on a desk directly facing the user, the note placed in the frame is highly visible. It will easily grab the attention of the user.

The blank note sheets 1472 and 1474 can be referred to as non-calendar sheets. This means that the present calendar frame can be used to hold and display any sheet, regardless whether it is a calendar sheet or a non-calendar sheet, as long as it is of appropriate size. As a matter of fact, a blank note sheet with size smaller than that of the calendar sheets 1422 and 1424 can also be held and displayed in the present calendar frame. This will open up the possibility of using many commercially available note pads as the blank note sheets.

FIG. 34

FIG. 34 shows the same sixth embodiment of the frame calendar system of the present invention shown in FIG. 31, and two additional calendar sheets and two non-calendar sheets. In the present discussion only the two additional calendar sheets and the two non-calendar sheets will be described.

In the previous section the CD 1914 was described as only containing monthly calendar templates. Two of such templates were open to create the monthly calendar sheets 1922 and 1924 as shown in FIG. 31. But it is desirable that this CD should also contain weekly calendar templates. Two of such weekly calendar templates can also be open to create a second horizontal calendar sheet 1994 and a second vertical calendar sheet 1995 as now shown in FIG. 34. In this situation a weekly calendar sheet should be mounted on the frame and displayed as a first page while a monthly calendar sheet should be mounted as a second page. The weekly calendar which contains more detailed event information about the current week will now be readily visible as a first page. The user can flip the page to expose the second page if he or she needs to check the date information on the future weeks of the month.

For a user with very busy daily activities it is advisable that his or her calendar should comprise of a daily calendar sheet as its first page, a weekly calendar sheet as its second page, and a monthly calendar sheet as its third page. In this case, a more advanced calendar software will be desirable to sort out all entered event information such that only the most important events will be briefly listed in the monthly calendar sheet while the daily calendar will contain more detailed description of each daily event.

With the availability of Internet more specialized calendar can be downloaded and printed. For example, a professor specialized in analytical chemistry can download and post a three-page calendar of all worldwide analytical chemistry conferences in the next six months. A frequent movie goer may want to download and post a calendar of all local movie schedule each week. A person needing a new set of tires can download and post a calendar of all local sales of tires for the next two weeks. It can be seen that the calendar system of the present invention can really be tailored to fit each individual's interest and personal needs.

Also shown in FIG. 34 is a first non-calendar sheet 1996 in a horizontal format and a second non-calendar sheet 1997 in a vertical format. These two non-calendar sheets 1996 and 1997 are preferably of the size same as and are intended to be mounted in the same way as the calendar sheets 1922 and 1924, respectively.

These non-calendar sheets, as well as more such sheets, may contain any non-calendar written or printed materials that are of interest to the user. An interesting poem may be down-loaded from Internet, and printed preferably on a standard sheet of letter or A4 size, and posted on the frame for ready viewing in the next few days. A two-page love letter from oversea husband on military mission can be similarly posted beside his photo in the privacy of the wife's own study room. The fact that this letter is slightly smaller than the standard size paper certainly should not matter.

Although the preferred embodiments of the frame calendar systems of the present invention have been described, it will be understood that within the purview of this invention various changes can be made in the form, details, proportion and arrangement of parts, the combination thereof and the construction thereof, which generally stated, consist in a 3D framed display or frame calendar system within the scope of the appended claims.

The invention having thus been described, the following is claimed:

1. A 3D framed display comprising:

(A) a first picture, and (B) a picture frame having (a) a top opening, (b) a front opening, (c) a bending member for bending said first picture into a concavo-convex shape and for forming a concave front surface for imparting a three dimensional effect to said first picture, and (c) a transparent member for detachably covering said top opening and said front opening.

2. The 3D framed display of claim 1 in which said top opening is contiguous to said front opening.

3. The 3D framed display of claim 1 also comprising a second picture attached to said transparent member and displayed in front of and spaced apart from said first picture.

4. The 3D framed display of claim 3 in which said second picture is a self trimmed composite picture made by a method including the following steps:

(a) merging two pre-existing images electronically to form a composite picture, (b) printing said composite picture on a printer sheet having a pre-existing perforation line or die-cut line, and (c) removing a portion of said printer sheet outside of said perforation line or die-cut line.

5. The 3D framed display of claim 1 also comprising a bottom edge picture positioned at right angle to said first picture.

6. The 3D framed display of claim 1 also comprising a 3D art placed in front of and spaced apart from said first picture.

7. The 3D framed display of claim 6 in which said 3D art is a display stand.

8. The 3D framed display of claim 7 also comprising a label attached to said display stand.

9. The 3D framed display of claim 6 in which said 3D art is an electrically activatable 3D art.

10. The 3D framed display of claim 1 also comprising a plurality of building blocks assembled together and displayed in front of said first picture.

11. A picture frame for mounting and displaying one or more of the following contents:

(a) a background picture, (b) a floating picture, (c) a bottom edge picture, (d) a 3D art, comprising:

(A) a bending member for bending said background picture into a concavo-convex shape with a concave front surface for imparting a three dimensional effect to said background picture, (B) a top opening, (C) a front opening, and (D) a transparent member for detachably covering said front opening and said top opening.

12. The picture frame of claim 11 in which said transparent member includes a glass sheet for holding and displaying said floating picture.

13. The picture frame of claim 12 in which said glass sheet has:

(a) a top portion, (b) a front portion, and (c) a curved portion between said top portion and said front portion, said curved portion having:

(i) a thickness of "d", (ii) an outside radius of "r", and (iii) a radius-over-thickness ratio (r/d) often (10) or more.

14. The picture frame of claim 11 in which said transparent member includes two glass sheets for sandwiching said floating picture in between.

15. The picture frame of claim 11 in which said bending member includes a curved back wall.

16. The picture frame of claim 15 also comprising a bottom plate positioned at right angle to said curved back wall for supporting and displaying said bottom edge picture.

17. The picture frame of claim 15 also comprising a magnetic bottom plate positioned at right angle to said curved back wall for supporting and displaying said 3D art.

18. The picture frame of claim 11 also comprising a bottom plate having an up-and-down surface structure engageable with said 3D art.

19. The picture frame of claim 11 also comprising a bottom opening.

20. The picture frame of claim 19 also comprising an insertion member for:

(a) holding said 3D art, (b) inserting said 3D art through said bottom opening, and (c) displaying said 3D art in said picture frame.

* * * * *